US006510698B2

(12) United States Patent
Kasai et al.

(10) Patent No.: US 6,510,698 B2
(45) Date of Patent: Jan. 28, 2003

(54) REFRIGERATION SYSTEM, AND METHOD OF UPDATING AND OPERATING THE SAME

(75) Inventors: Tomohiko Kasai; Mitsunori Kurachi; Hidekazu Tani; Moriya Miyamoto; Yoshihiro Sumida; Takashi Ikeda; Toshihiro Kikukawa, all of Tokyo; Shohichiroh Masuda, Kanagawa; Hirofumi Koge, Tokyo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/572,300

(22) Filed: May 17, 2000

(65) Prior Publication Data

US 2002/0026800 A1 Mar. 7, 2002

(30) Foreign Application Priority Data

May 20, 1999 (JP) ..... 11-140304
Oct. 25, 1999 (JP) ..... 11-303188
Oct. 25, 1999 (JP) ..... 11-303189

(51) Int. Cl.[7] ..... F25B 45/00
(52) U.S. Cl. ..... 62/77; 62/292
(58) Field of Search ..... 62/77, 292, 84, 62/475, 324.1, 324.6, 474

(56) References Cited

U.S. PATENT DOCUMENTS 3,175,342 A 3/1965 Balogh
4,261,178 A * 4/1981 Cain ..... 62/292 X
4,266,408 A 5/1981 Krause
4,912,937 A * 4/1990 Nakamura et al.
5,347,817 A 9/1994 Kim
5,415,003 A * 5/1995 Bertva et al. ..... 62/77 X

FOREIGN PATENT DOCUMENTS

| | | |
|---|---|---|
| EP | 0 952 407 | 10/1999 |
| GB | 2 269 004 | 1/1994 |
| JP | 1-273956 | 11/1989 |
| JP | 06-249551 | 9/1994 |
| JP | 7-083545 | 3/1995 |
| JP | 08094216 A * | 4/1996 |
| JP | 08-159618 | 6/1996 |
| JP | 8-261606 | 10/1996 |
| JP | 10-197171 | 7/1998 |
| JP | 10-300244 | 11/1998 |
| JP | 2000-146369 | 5/2000 |

* cited by examiner

*Primary Examiner*—Chen-Wen Jiang
(74) *Attorney, Agent, or Firm*—Oblon, Spivak, McClelland, Maier & Neustadt, P.C.

(57) ABSTRACT

A heat source unit and refrigerant used in an existing refrigeration system are replaced with new refrigerant and a new heat source unit which employs the new refrigerant and is equipped with an oil separator and extraneous-matter trapping device. An indoor unit of the existing refrigeration system may be used, in its present form, or replaced with a new indoor unit. Further, connecting pipes used for the existing refrigeration are reused. After replacement of refrigerant, the refrigeration system performs an ordinary operation after having performed a cleaning operation. The extraneous-matter trapping device is provided in a refrigerant pipe close to the heat source unit or in a bypass channel connected to the refrigerant pipe close to the heat source unit. Alternatively, only the heat source unit of the existing refrigeration system is replaced with a new one, and there is employed refrigeration oil which has no mutual solubility with respect to HFC or has very low mutual solubility.

23 Claims, 29 Drawing Sheets solubility of HFC refrigeration oil in HFC refrigerant mixed with mineral oil (critical solubility curve)

REFRIGERATION SYSTEM, AND METHOD OF UPDATING AND OPERATING THE SAME

BACKGROUND OF THE INVENTION

1. Field of the Invention

The present invention relates to a method of replacing and operating a refrigeration system or an air conditioning system employing the refrigeration system. Further, the present invention relates to a method of replacing a refrigerant in a refrigeration system.

More particularly, the present invention relates to a refrigeration system which employs a refrigeration cycle (hereinafter referred to as a "refrigeration system") and enables replacement of a heat source unit with a new one or replacement of a heat source unit and an indoor unit with new ones and which enables replacement of a previous-employed refrigerant with a new refrigerant of different type without involvement of replacement of at least connecting pipes for connecting the heat source unit with the indoor unit. The present invention further relates to a method of operating such refrigeration system.

2. Background Art

FIG. 27 shows a popular standalone-type refrigeration system which has already been used. In FIG. 27, reference symbol AA designates a heat source unit accommodating a compressor 1, a four-way valve 2, a heat exchanger 3 at a heat-source-unit side, a first control valve 4, a second control valve 7, and an accumulator 8. Reference symbol BB designates an indoor unit including a flow rate regulator 5 (or a flow rate control valve 5) and a heat exchanger 6 at a user-side. The heat source unit AA and the indoor unit BB are remotely separated from each other and are interconnected together by way of a first connecting pipe CC and a second connecting pipe DD, thus constituting a refrigeration system (i.e., a system employing the refrigeration cycle).

One end of the first connecting pipe CC is connected to the heat exchanger 3 on the heat-source-unit-side by way of the first control valve 4, and the other end of the first connecting pipe CC is connected to the flow rate regulator 5. One end of the second connecting pipe DD is connected to the four-way valve 2 by way of the second control valve 7, and the other end of the second connecting pipe DD is connected to the heat exchanger 6 on the user-side. Further, an oil return hole 8*a* is formed in a lower portion of a U-shaped outlet pipe of the accumulator 8.

The circulation of a refrigerant within the refrigeration system will now be described by reference to FIG. 27. In the drawing, solid arrows depict the circulation of the refrigerant during a cooling operation, and dotted arrows depict the circulation of the refrigerant during a heating operation.

First will be explained the circulation of a refrigerant during a cooling operation. The refrigerant is compressed by the compressor 1 to assume the form of a hot, high-pressure gas; flows via the four-way valve 2 into the heat-source-unit-side heat exchanger 3, where the gaseous refrigerant exchanges heat with a heat source medium, such as water or air; and is condensed. The thus-condensed refrigerant flows, via the first control valve 4 and the first connecting pipe CC, to the flow rate regulator 5, where the refrigerant is decompressed to a low-pressure two-phase state. By way of the user-side heat exchanger 6, the refrigerant exchanges heat with a user-side medium, such as air, and evaporates. The thus-evaporated refrigerant returns to the compressor 1 via the second connecting pipe DD, the second control valve 7, the four-way valve 2, and the accumulator B.

Next will be explained the circulation of the refrigerant during a heating operation. The refrigerant is compressed by the compressor 1 to assume the form of a hot, high-pressure gas; and flows via the four-way valve 2, the second control valve 7, and the second connecting pipe DD into the user-side heat exchanger 6, where the gaseous refrigerant exchanges heat with a heat source medium, such as air, and is condensed. The thus-condensed refrigerant flows to the flow rate regulator 5, where the refrigerant is decompressed to assume a low-pressure two-phase state. By way of the first connecting pipe CC, the first control valve 4, and the heat-source-unit-side heat exchanger 3, the refrigerant exchanges heat with a heat-source-unit-side medium, such as air or water, and is vaporized. The thus-vaporized refrigerant returns to the compressor 1 via the four-way valve 2 and the accumulator 8.

Chlorofluorocarbon (CFC) or a hydrochlorofluorocarbon (HCFC) has been used as a refrigerant of such a refrigeration system. However, since chlorine contained in molecules of a CFC or HCFC depletes the ozone layer of the stratosphere, use of CFC has been phased out. Moreover, production of HCFCs has been subjected to regulation.

A refrigeration system using a hydrofluorocarbon (HFC) whose molecules do not contain chlorine has already been put into actual use. In a case where a refrigeration system using a CFC or HCFC (hereinafter referred to also as a "CFC/HCFC-using refrigeration system) is deteriorated and becomes unusable, the refrigeration system must be replaced with a new refrigeration system using an HFC (hereinafter referred to also as an "HFC-using refrigeration system), because use of CFCs has been phased out and production of HCFCs is regulated.

The heat source unit AA and the indoor unit BB for use with an HFC employ refrigeration oil, an organic material, and a heat exchanger which differ in type from those employed by the heat source unit AA and the indoor unit BB for use with an HCFC. Therefore, the refrigeration oil, the organic material, and the heat exchanger must be replaced with those designed specifically for use with an HFC. Further, let us assume that the heat source unit AA and the indoor unit BB for use with a CFC or HCFC have deteriorated and hence must be replaced with new ones. The heat source unit AA and the indoor unit BB can be replaced with new ones with comparative ease.

In a case where the first connecting pipe CC and the second connecting pipe DD interconnecting the heat source unit AA and the indoor unit BB are lengthy and embedded in a structure, such as a pipe shaft or a ceiling, difficulty is encountered in replacing the connecting pipes with new pipes. Further, these connecting pipes are not susceptible to deterioration, and hence if the first connecting pipe CC and the second connecting pipe DD used in the CFC/HCFC-using refrigeration system are usable, in their present forms, piping work can be facilitated.

In the first connecting pipe CC and the second connecting pipe DD used in the CFC/HCFC-using refrigeration system, there still remains residual mineral oil which has been used as a refrigeration oil for the CFC/HCFC-using refrigeration system (hereinafter called a "CFC/HCFC refrigeration oil), CFC/HCFC, or depleted substances).

FIG. 28 is a graph showing critical solubility curves which represent the solubility of an oil for use with an HFC (hereinafter called simply as an "HFC refrigeration oil") in an HFC refrigerant when the HFC refrigeration oil is mixed with a mineral oil. The horizontal axis of the graph represents amount of oil (wt. %), and the vertical axis of the graph represents temperature (° C.).

As shown in FIG. 28, if a predetermined amount of mineral oil is mixed into an oil for use with a refrigeration system using an HFC (hereinafter also called an "HFC refrigeration oil") (e.g., a synthetic fluid such as an ester oil or an ether oil), the refrigeration oil loses compatibility with an HFC refrigerant. If a puddle of liquid refrigerant is present in the accumulator 8, the HFC refrigeration oil is isolated from and suspended in the liquid refrigerant. Accordingly, the HFC refrigeration oil does not return to the compressor 1 by way of the oil return hole 8*a* formed in the lower portion of the accumulator 8, thus causing a sliding section of the compressor 1 to seize up.

If a mineral oil is mixed into the HFC refrigeration oil, the HFC refrigeration oil becomes deteriorated. Alternatively, if a CFC or HCFC is mixed into the HFC refrigeration oil, a chlorine component contained in the CFC or HCFC deteriorates the HFC refrigeration oil; otherwise, a chlorine component contained in sludge formed from a depleted substance of the CFC/HCFC refrigeration oil may deteriorate the HFC refrigeration oil.

The first connecting pipe CC and the second connecting pipe DD are cleansed with a cleaning fluid (HCFC 141b or HCFC 225) through use of cleaning equipment (this method will hereinafter be called a "first cleaning method").

Another cleaning method described in Japanese Patent Laid-Open No. 83545/1995 (hereinafter referred to as a "second cleaning method") has already been put forward. As shown in FIG. 29, the heat source unit AA for use with an HFC (hereinafter also called an "HFC heat source unit"), the indoor unit BB for use with an HFC (hereinafter also called an "HFC indoor unit"), the first connecting pipe CC, and the second connecting pipe DD are interconnected without use of the cleaning equipment (step 100). After having been charged with an HFC refrigerant and an HFC refrigeration oil (step 101), the refrigeration system is operated for cleaning (step 102). Subsequently, the HFC refrigerant and the HFC refrigeration oil remaining in the refrigeration system are recovered, and the refrigeration system is charged with a new refrigerant and a new refrigeration oil (step 103). The refrigeration system is again operated for cleaning. These operations are repeated a predetermined number of times (steps 104 and 105).

The first conventional cleaning method has encountered the following problems. Specifically, since an HCFC which depletes the ozone layer is used as a cleaning fluid, the first method is inconsistent with the plan to change the refrigerant of the refrigeration system from an HCFC to an HFC. Particularly, HCFC 141b has an ozone layer depletion factor of 0.11 and poses a big problem.

A second problem of the first method is that a cleaning fluid is not completely safe in terms of flammability and toxicity. HCFC 141b is flammable and has low toxicity. HCFC 225 is not flammable but has low toxicity.

A third problem of the first method is that the cleaning fluid has a high boiling point (HCFC 141b has a boiling point of 32° C., and HCFC 225 has a boiling point of 51.5 to 56.1° C.). When the outside air temperature is lower than the boiling point, which is likely to be the case during the winter, the cleaning fluid remains, in a liquid state, in the first connecting pipe CC and the second connecting pipe DD after cleaning. Since the cleaning fluid is made of an HCFC, the chlorine component contained in the cleaning fluid deteriorates the HFC refrigeration oil.

A fourth problem of the first method is a necessity for recovering the total amount of cleaning fluid so as to prevent environmental destruction. If the refrigeration system is cleansed again through use of high-temperature nitrogen gas so as to prevent occurrence of the third problem, the cleansing operation requires expenditure of much effort.

The second conventional cleaning method has encountered the following problems. The embodiment described in Japanese Patent Laid-Open No. 83545/1995 requires three-time cleaning operation using the HFC refrigerant. Further, the HFC refrigerant used in the cleaning operation contains impurities, and hence the recovered HFC refrigerant cannot be reused in its present form. The cleaning operation requires HFC refrigerant in an amount of three times that usually used for charging a refrigeration system, and hence the second method imposes problems in relation to cost and the environment.

A second problem of the second method is that the refrigeration oil is replaced with new refrigeration oil after cleaning operation of the refrigeration system, which requires a refrigeration oil in an amount of three times that usually used for charging a refrigeration system, thus imposing problems in relation to cost and the environment. The HFC refrigeration oil is an ester oil or an ether oil and possesses a high hydroscopic property, and hence control of moisture content of a refrigeration oil for replacement purpose is also required. Further, the refrigeration oil is charged by a human worker who cleans the refrigeration system, and there may arise a shortage or excess in the amount of refrigeration oil to be charged, which in turn induces a problem in subsequent operation of the refrigeration system (in the event of the refrigeration system having been excessively charged with a refrigeration oil, there may arise destruction of a compression section and overheating of a motor, whereas in the event of the refrigeration system having been insufficiently charged with a refrigeration oil, a lubrication failure may arise).

The present invention has been conceived to solve these problems of the conventional methods and is aimed at providing a method of constructing a refrigeration system which enables replacement of an existing refrigeration system using an environmentally-hazardous refrigerant with a refrigeration system using an environmentally-friendly refrigerant, a method of replacing a refrigerant, and a method of operating the refrigeration system for cleaning purposes.

SUMMARY OF THE INVENTION

According to one aspect of the present invention, a method of operating a refrigeration system is provided in which an old refrigerant used in a refrigerant circuit is replaced with a new refrigerant. The refrigerant circuit comprises a compressor, a heat-source-unit-side heat exchanger, a user-side heat exchanger, a first connecting pipe interconnecting one end of the heat-source-unit-side heat exchanger and one end of the user-side heat exchanger, a second connecting pipe interconnecting the other end of the user-side heat exchanger and the compressor, and an extraneous-matter trapping apparatus for trapping extraneous matter contained in the refrigerant inserted in the refrigerant circuit upstream of the compressor. In the refrigeration system, after the old refrigerant is replaced, the new refrigerant is caused to flow while the compressor is taken as a drive source, thereby cleaning the refrigerant circuit. (c1)

According to another aspect of the present invention, a method is provided for replacing an old refrigeration system to a new refrigeration system. The old refrigeration system uses first refrigerant and comprises a first heat source unit including at least a compressor and a heat-source-unit-side heat exchanger, an indoor unit including at least a user-side heat exchanger and a flow rate regulator, and first and second connecting pipes interconnecting the first heat source unit and the indoor unit, to thereby constitute a refrigerant circuit. Wherein, the new refrigeration system is constituted by means of replacing at least the first heat source unit with a second heat source unit. The second heat source unit uses second refrigerant and comprises a heat source unit refrigerant circuit including at least a heat source refrigerant and a heat-source-unit-side heat exchanger, an oil separation apparatus which is inserted in the heat source unit refrigerant circuit, which separates refrigeration oil from the refrigerant of the heat source unit refrigerant circuit, and which returns the refrigeration oil to the compressor, and extraneous-matter trapping means for separating and trapping extraneous matter from the refrigeration oil separated by the oil separation apparatus. Further, the first refrigerant is replaced with the second refrigerant. (c5)

According to another aspect of the present invention, a refrigeration system comprises at least a compressor, a heat-source-unit-side heat exchanger, a user-side diaphragm, a user-side heat exchanger, an accumulator, a first connecting pipe for interconnecting the heat-source-unit-side-unit heat exchanger and the user-side diaphragm, and a second connecting pipe for interconnecting the user-side heat exchanger and the compressor. Wherein, at least the compressor and the heat-source-unit-side heat exchanger are replaced with a new compressor and a new heat-source-unit-side heat exchanger which use HFC refrigerant. A refrigerant circuit is constituted by use of at least the first and second connecting pipes, as well as by use of the user-side heat exchanger and the user-side diaphragm. A refrigerant used in the refrigeration system is replaced with HFC refrigerant. Further, a refrigeration oil is used which has no mutual solubility with respect to HFC refrigerant or has very low mutual solubility. (c7)

Other and further objects, features and advantages of the invention will appear more fully from the following description.

PREFERRED EMBODIMENTS OF THE PRESENT INVENTION

Figure 1:
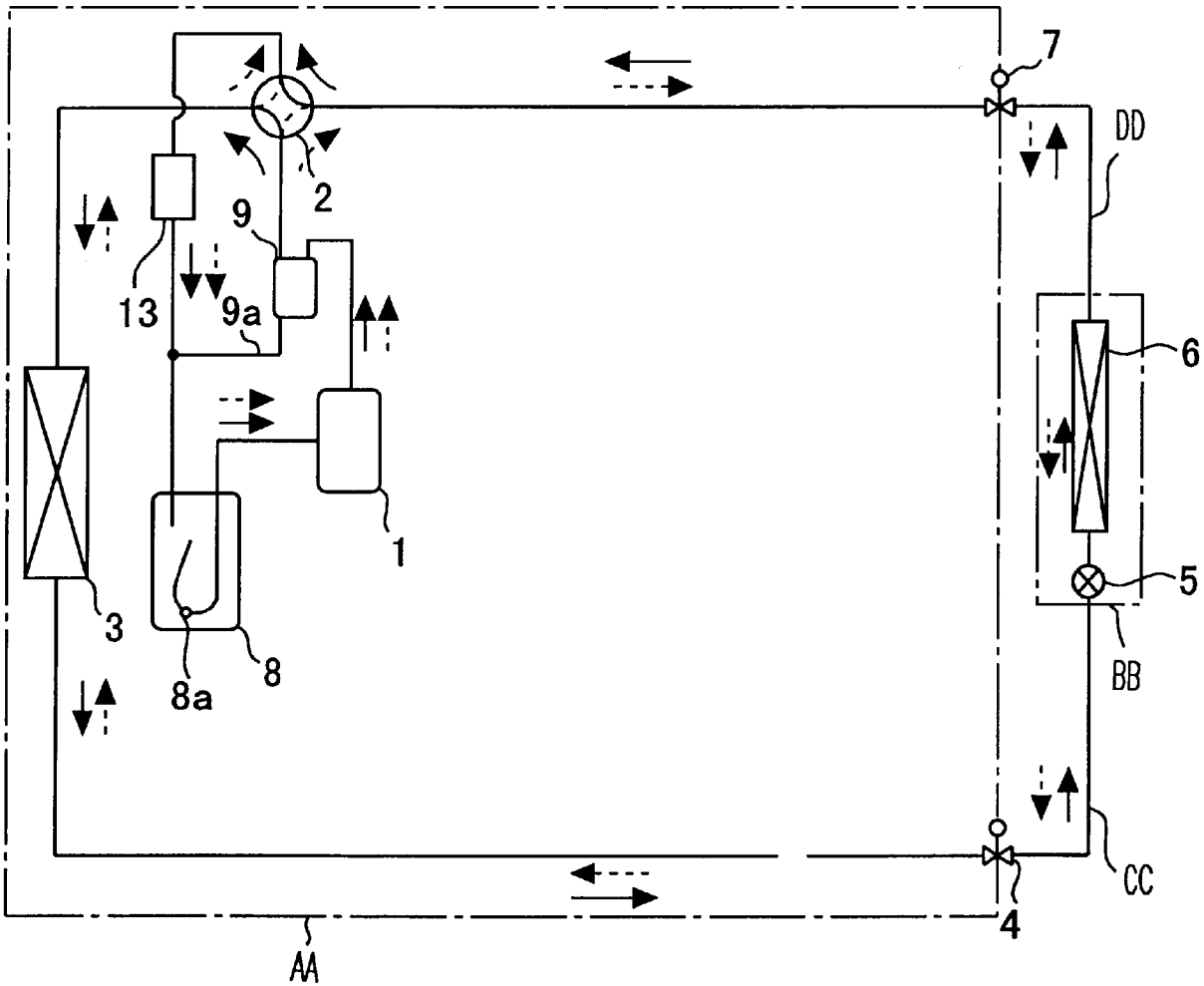
FIG. 1 is a schematic diagram showing a refrigerant circuit of a refrigeration system, as an example refrigeration system according to a first embodiment of the present invention.

Preferred embodiments of the present invention will be described hereinbelow by reference to the accompanying drawings. Throughout the drawings, like reference numerals designate like or corresponding elements, and repetition of their explanations is omitted for brevity or simplified.

First Embodiment

FIG. 1 is a schematic diagram showing a refrigerant circuit of a refrigeration system which effects heat exchange by means of a refrigerant, as an example refrigeration system according to a first embodiment of the present invention.

In FIG. 1, reference symbol AA designates a heat source unit accommodating a compressor 1, a four-way valve 2, a heat exchanger 3 on a heat-source-unit-side , a first control valve 4, a second control valve 7, an accumulator 8, an oil separator 9 (corresponding to oil separation means), and extraneous-matter trapping means 13.

The oil separator 9 is provided in an outlet pipe of the compressor 1 and separates a refrigeration oil which is discharged from the compressor 1 together with a refrigerant. The extraneous-matter trapping means 13 is interposed between the four-way valve 2 and the accumulator 8. Reference numeral 9*a* designates a bypass channel extending from the bottom of the oil separator 9 to a downstream position relative to the exit of the extraneous-matter trapping means 13. An oil return hole 8*a* is formed in a lower portion of a U-shaped outlet pipe of the accumulator 8.

Reference symbol BB designates an indoor unit equipped with a flow rate regulator 5 and a user-side heat exchanger 6.

Reference symbol CC designates a first connecting pipe whose one end is connected to a heat exchanger 3 on a heat-source-unit-side via a first control valve 4 and whose other end is connected to the flow rate regulator 5.

Reference symbol DD designates a second connecting pipe whose one end is connected to the four-way valve 4 via the second control valve 7 and whose other end is connected to the user-side heat exchanger 6.

A heat source unit AA and an indoor unit BB are remotely separated from each other and interconnected via the first connecting pipe CC and the second connecting pipe DD, thus constituting a refrigeration system (i.e., a system employing the refrigeration cycle).

The refrigeration system uses an HFC (hereinafter also called a "new refrigerant," as required).

Next will be described procedures for replacing a deteriorated refrigeration system using a CFC or HCFC (hereinafter called as an "old refrigerant," as required) with a refrigeration system using an HFC. A CFC or HCFC is recovered from the existing refrigeration system, and the heat source unit AA and the indoor unit BB are replaced with a new heat source unit AA and a new indoor unit BB using an HFC as shown in FIG. 1. The first connecting pipe CC and the second connecting pipe DD used for the HCFC-using refrigeration system are reused, thus constituting the refrigerant circuit shown in FIG. 1.

Since the heat source unit AA has been filed with an HFC in advance, the refrigeration system is evacuated while the first control valve 4 and the second control valve 7 remain closed and while the new indoor unit BB, the first connecting pipe CC, and the second connecting pipe DD are connected to the refrigeration system. Subsequently, the first control valve 4 and the second control valve 7 are opened, and the refrigeration system is additionally charged with an HFC. Thereafter, the refrigeration system performs an ordinary cooling and cleaning operation.

The ordinary cooling and cleaning operation will now be described by reference to FIG. 1. Solid arrows in the drawing depict the flow of a refrigerant during a cooling operation of the refrigeration system, and broken arrows depict the flow of a refrigerant during a heating operation.

First will be described the flow of a refrigerant during a cooling operation. The refrigerant is compressed by the compressor 1 to become a hot, high-temperature gas; is discharged from the compressor 1 together with an HFC refrigeration oil; and enters the oil separator 9.

In the oil separator 9, the HFC refrigeration oil is completely separated from the gaseous refrigerant, and only the gaseous refrigerant flows, via the four-way valve 2, into the heat-source-unit-side heat exchanger 3, where the gaseous refrigerant exchanges heat with a heat source medium, such as water or air, and is condensed. The thus-condensed refrigerant flows into the first connecting pipe CC via the first control valve 4.

During the course of the liquid HFC refrigerant flowing through the first connecting pipe CC, a CFC, an HCFC, a mineral oil, or a deteriorated mineral oil (hereinafter referred to as "residual extraneous matter") remaining in the first connecting pipe CC is cleaned little by little. The thus-cleared residual extraneous matter flows into the flow rate regulator 5 together with the liquid HFC refrigerant. In the flow rate regulator 5, the liquid HFC refrigerant is decompressed to a low pressure and into a low-pressure two-phase state. The refrigerant then exchanges heat with a user-side medium, such as air, in the user-side heat exchanger 6 and evaporates.

The thus-evaporated refrigerant flows into the second connecting pipe DD together with the residual extraneous matter exfoliated from the first connecting pipe CC. Since the refrigerant flowing through the second connecting pipe DD is in a gaseous state, a portion of residual extraneous matter adhering to the interior surface of the second connecting pipe DD flows in the gaseous refrigerant in the form of a mist. The majority of the liquid residual extraneous matter flows at a speed slower than the flow rate of the gaseous refrigerant, thus inducing generation of a shearing force in the boundary plane between gas and liquid. By means of the shearing force, the liquid residual extraneous matter annularly flows along the interior surface of the second connecting pipe DD while being drawn by the gaseous refrigerant. Although cleaning of the second connecting pipe DD requires cleaning time longer than that required for cleaning the first connecting pipe CC, the second connecting pipe DD is cleaned thoroughly.

Subsequently, the gaseous refrigerant flows into the extraneous-matter trapping means 13 via the second control valve 7 and the four-way valve 2, together with the residual extraneous matter removed from the first connecting pipe CC and that removed from the second connecting pipe DD. According to boiling point, the components of the residual extraneous matter differ in phase from each other and can be classified into three phases: i.e., solid extraneous matter, liquid extraneous matter, and gaseous extraneous matter.

The extraneous-matter trapping means 13 completely separates solid extraneous matter and liquid extraneous matter from the gaseous refrigerant, thus trapping the thus-separated extraneous matter. Some of the gaseous extraneous matter is trapped by the extraneous-matter trapping means 13, but some of the same escapes. The gaseous refrigerant returns to the compressor 1 via the accumulator 8 along with the gaseous extraneous matter which has escaped the extraneous-matter trapping means 13.

The refrigerant circuit used for a cooling operation; specifically, the refrigerant circuit which extends from and returns to the compressor 1 via the flow rate regulator 5, the user-side heat exchanger 6, and the accumulator 8, in the sequence given, is taken herein as a first refrigerant circuit.

The HFC refrigeration oil which has been completely separated from the gaseous refrigerant by the oil separator 9 merges with the principal stream of HFC refrigeration oil at a downstream position relative to the extraneous-matter trapping means 13, via the bypass channel 9*a*. The thus-merged flow of HFC refrigeration oil returns to the compressor 1. Thus, the HFC refrigeration oil is prevented from being mixed with the mineral oil remaining on the first and second connecting pipes CC and DD and is prevented from being incompatible with an HFC. Further, there can be prevented deterioration of the HFC refrigeration oil, which would otherwise be caused by mixing with a mineral oil.

Further, the solid extraneous matter does not mix with the HFC refrigeration oil, thus preventing deterioration of the HFC refrigeration oil. During a single circulation of the HFC refrigerant through the refrigerant circuit and through the extraneous-matter trapping means 13, only a portion of the gaseous extraneous matter is trapped. The gaseous extraneous matter is mixed with the HFC refrigeration oil. However, deterioration in the HFC refrigeration oil is attributable to chemical reaction and does not proceed abruptly.

Figure 2:
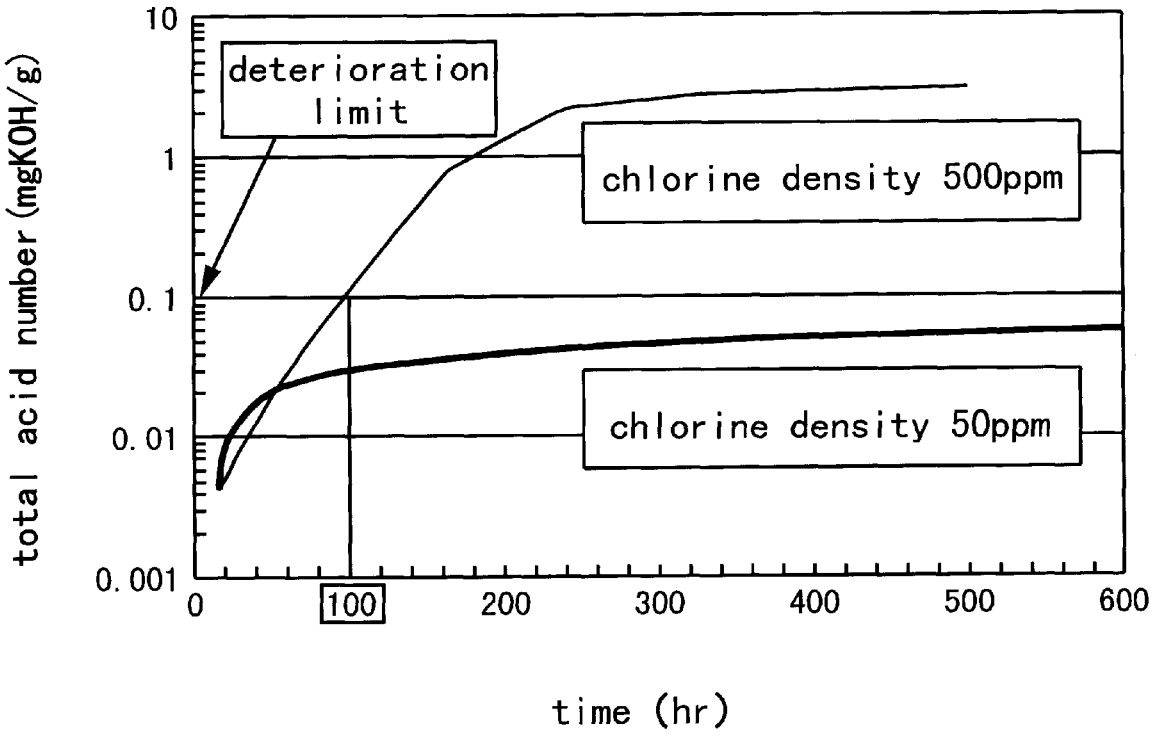
FIG. 2 is a graph showing chronological deterioration of an HFC refrigeration oil (at a temperature of 175° C.) when mixed with chlorine.

FIG. 2 shows an example of deterioration in the HFC refrigeration oil. A graph shown in FIG. 2 represents chronological deterioration of the HFC refrigeration oil (at a temperature of 175° C.) when chlorine is mixed in the HFC refrigeration oil. The horizontal axis of the graph represents time (hr), and the vertical axis of the same represents total acid number (mgKOH/g).

The gaseous extraneous matter which has not been trapped during the single passage of the gaseous refrigerant through the extraneous-matter trapping means 13 passes through the extraneous-matter trapping means 13 again and again, along with circulation of the HFC refrigerant. Hence, the only requirement is that the gaseous matter is trapped by the extraneous-matter trapping means 13 faster than the rate at which the HFC refrigeration oil deteriorates.

Next will be described the flow of a refrigerant during a heating operation of the refrigeration system. The refrigerant is compressed by the compressor 1 to become a hot, high-pressure gas; is discharged from the compressor 1 together with an HFC refrigeration oil; and enters the oil separator 9, where the HFC refrigeration oil is completely separated from the gaseous refrigerant. Only the gaseous refrigerant flows into the second connecting pipe DD via the four-way valve 2 and the second control valve 7.

Since the refrigerant flowing through the second connecting pipe DD is in a gaseous state, a portion of residual extraneous matter adhering to the interior surface of the second connecting pipe DD flows in the gaseous refrigerant in the form of a mist. The majority of the liquid residual extraneous matter flows at a speed slower than the flow rate of the gaseous refrigerant, thus inducing generation of a shearing force in the boundary plane between gas and liquid. By means of the shearing force, the liquid residual extraneous matter annularly flows along the interior surface of the second connecting pipe DD while being drawn by the gaseous refrigerant. Although cleaning of the second connecting pipe DD requires cleaning time longer than that required for cleaning the first connecting pipe CC during the cooling operation, the second connecting pipe DD is cleaned thoroughly.

Subsequently, the gaseous refrigerant flows, together with the residual extraneous matter removed from the second connecting pipe DD, into the user-side heat exchanger 6, where the gaseous refrigerant exchanges heat with a heat source medium, such as air, and is condensed and liquefied. The thus-condensed-and-liquefied refrigerant flows to the flow rate regulator 5, where the refrigerant is decompressed to a low-pressure two-phase state. The gaseous refrigerant then flows into the first connecting pipe CC. Since the gaseous refrigerant is in a gas-liquid two-phase state and flows at high speed. The gaseous refrigerant cleans the extraneous matter remaining in the first connecting pipe CC together with the liquid refrigerant at a speed faster than that achieved during a cooling operation.

The refrigerant in the gas-liquid two-phase state flows, together with the residual extraneous matters removed from the second connecting pipe DD and the first connecting pipe CC, into the heat-source-unit-side heat exchanger 3, via the first control valve 4. In the heat-source-unit-side heat exchanger 3, the refrigerant exchanges heat with a heat source medium, such as water or air, and is evaporated. The thus-evaporated refrigerant flows into the extraneous-matter trapping means 13 via the four-way valve 2.

According to a boiling point, the components of the residual extraneous matter differ in phase from each other and can be classified into three phases: i.e., solid extraneous matter, liquid extraneous matter, and gaseous extraneous matter. The extraneous-matter trapping means 13 completely separates solid extraneous matter and liquid extraneous matter from the gaseous refrigerant, thus trapping the thus-separated extraneous matter. Some of gaseous extraneous matter is trapped by the extraneous-matter trapping means 13, but some of the same escapes.

The gaseous refrigerant returns to the compressor 1 via the accumulator 8 along with the gaseous extraneous matter which has escaped the extraneous-matter trapping means 13.

The refrigerant circuit used for a heating operation; specifically, the refrigerant circuit which extends from and returns to the compressor 1 via the user-side heat exchanger 6, the flow rate regulator 5, the heat-source-unit-side heat exchanger 3, and the accumulator 8, in the sequence given, is herein taken as a second refrigerant circuit.

The HFC refrigeration oil which has been completely separated from the gaseous refrigerant by the oil separator 9 merges with the principal stream of HFC refrigeration oil at a downstream position relative to the extraneous-matter trapping means 13, via the bypass channel 9*a*. The thus-merged flow of HFC refrigeration oil returns to the compressor 1. Thus, the HFC refrigeration oil is prevented from being mixed with the mineral oil remaining on the first and second connecting pipes CC and DD and is prevented from being incompatible with HFCs. Further, there can be prevented deterioration of the HFC refrigeration oil, which would otherwise be caused by mixing with a mineral oil.

Further, the solid extraneous matter does not mix with the HFC refrigeration oil, thus preventing deterioration of the HFC refrigeration oil.

During a single circulation of the HFC refrigerant through the refrigerant circuit and through the extraneous-matter trapping means 13, only a portion of the gaseous extraneous matter is trapped. The gaseous extraneous matter is mixed with the HFC refrigeration oil. However, deterioration in the HFC refrigeration oil is attributable to chemical reaction and does not proceed abruptly. FIG. 2 shows an example of deterioration in the HFC refrigeration oil. The gaseous extraneous matter which has not been trapped during the single passage of the gaseous refrigerant through the extraneous-matter trapping means 13 passes through the extraneous-matter trapping means 13 again and again, along with circulation of the HFC refrigerant. Hence, the only requirement is that the gaseous matter be trapped by the extraneous-matter trapping means 13 faster than the rate at which the HFC refrigeration oil deteriorates.

Figure 3:
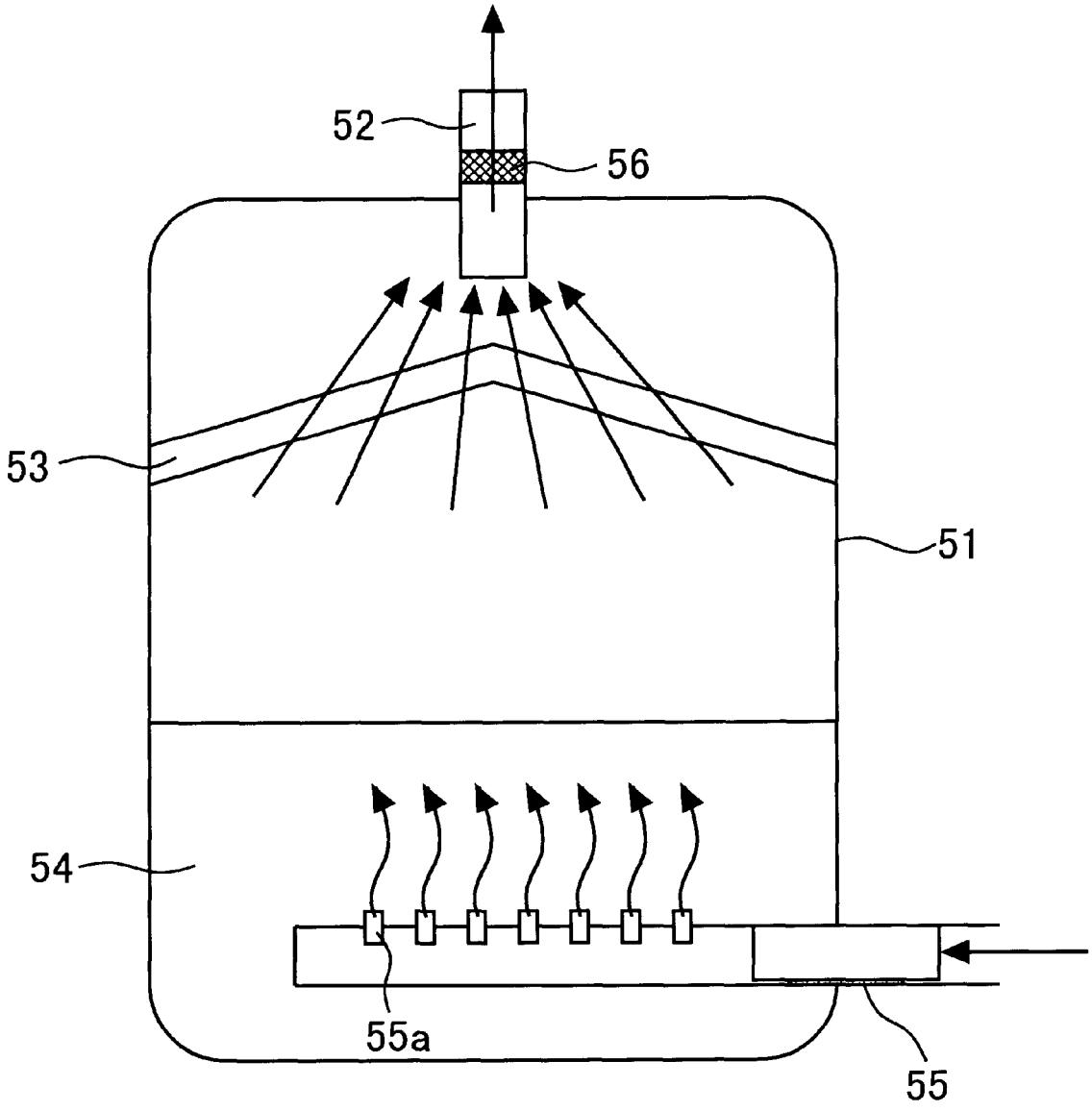
FIG. 3 is a cross-sectional view showing an example extraneous-matter trapping means of the present invention.

Next will be described an example of the extraneous-matter trapping means 13. FIG. 3 illustrates an example cross-sectional structure of the extraneous-matter trapping means 13. Reference numeral 51 designates a cylindrical container; 52 designates an outlet pipe provided on top of the container 51; 53 designates a funnel-shaped filter provided along an upper interior surface of the container 51; 54 designates a mineral oil charged in the container 51 beforehand; 55 designates an inlet pipe provided in a lower side surface of the container 51; and 55*a* designates a plurality of outlet holes formed in the side surface of a portion of the inlet pipe 55 located within the container 51.

The filter 53 corresponds to a net formed from fine line; specifically, the filter is formed from sintered metal so as to have a mesh measuring from several microns to tens of microns. Therefore, a piece of extraneous matter larger than the size of the mesh cannot pass through the filter 53. Even mist-like liquid extraneous matter which may be present in trace amount in an upper space of the container 51 is trapped by the filter 53, and the thus-trapped extraneous matter falls flows laterally along the filter 53 under the influence of gravity and falls to a lower portion of the container 51. Reference numeral 56 designates an ion-exchange resin for trapping chlorine ions.

The outlet pipe 52 is connected to the accumulator 8 shown in FIG. 1 via the ion-exchange resin 56, and the inlet pipe 55 is connected to the four-way valve 2.

The gaseous refrigerant which has flowed into the container 51 from the inlet pipe 55 passes through the mineral oil 54 in the form of air bubbles, via the outlet holes 55*a*, and flows out the container 51 from the outlet pipe 52 by way of the filter 53 and the ion-exchange resin 56.

The extraneous matter which has flowed into the container 51 from the inlet pipe 55 together with the gaseous refrigerant flows into the mineral oil 54 from the outlet holes 55*a*. Since the flow rate of the refrigerant (gaseous) drops, and individual pieces of extraneous matter are separated from the refrigerant (gaseous) and precipitate on the bottom of the container 51.

Even if the container 51 does not contain the mineral oil 54, the cross section of the container 51 is larger than that of the inlet pipe 55. Upon entrance into the container 51, the refrigerant (gaseous) is subjected to a drop in flow rate, and individual pieces of extraneous matter are separated from the refrigerant (gaseous) under the influence of gravity. The thus-separated pieces of extraneous matter precipitate in a lower portion of the container 51.

Even if the flow rate of the gaseous refrigerant in the mineral oil 54 is high and the pieces of extraneous matter spring up to an upper portion of the mineral oil 54, the filter 53 traps the pieces of extraneous matter.

The liquid extraneous matter which has flowed into the container 51 from the inlet pipe 55 together with the gaseous refrigerant flow into the mineral oil 54 from the outlet holes 55*a*. The speed of the liquid extraneous matter drops under the resistance of the mineral oil 54, thereby separating the liquid extraneous matter from the gaseous refrigerant. The thus-separated liquid extraneous matter stays with the mineral oil 54.

Even if the container 51 does not contain the mineral oil 54, the cross section of the container 51 is larger than that of the inlet pipe 55. Upon entrance into the container 51, the flow rate of the refrigerant (gaseous) drops, and the liquid extraneous matter is separated from the refrigerant (gaseous) under the influence of gravity. The thus-separated liquid extraneous matter stays in a lower portion of the container 51.

Even if the flow rate of the gaseous refrigerant in the mineral oil 54 is high and the liquid becomes turbulent to thereby change the mineral oil 54 into a mist and cause the mist to move with the flow of the gaseous refrigerant, the mist is trapped by the filter 53. As mentioned above, the thus-trapped mist flows laterally within the container 51 and falls into a lower portion of the container 51.

Gaseous extraneous matter which has flowed into the container 51 from the outlet holes 55*a* of the inlet pipe 55 together with the gaseous refrigerant passes through the mineral oil 54 in the form of air bubbles and flows out from the outlet pipe 52 via the filter 53 and the ion-exchange resin 56. The principal component of the gaseous extraneous matter is a CFC or HCFC and is soluble in the mineral oil 54.

Figure 4B:
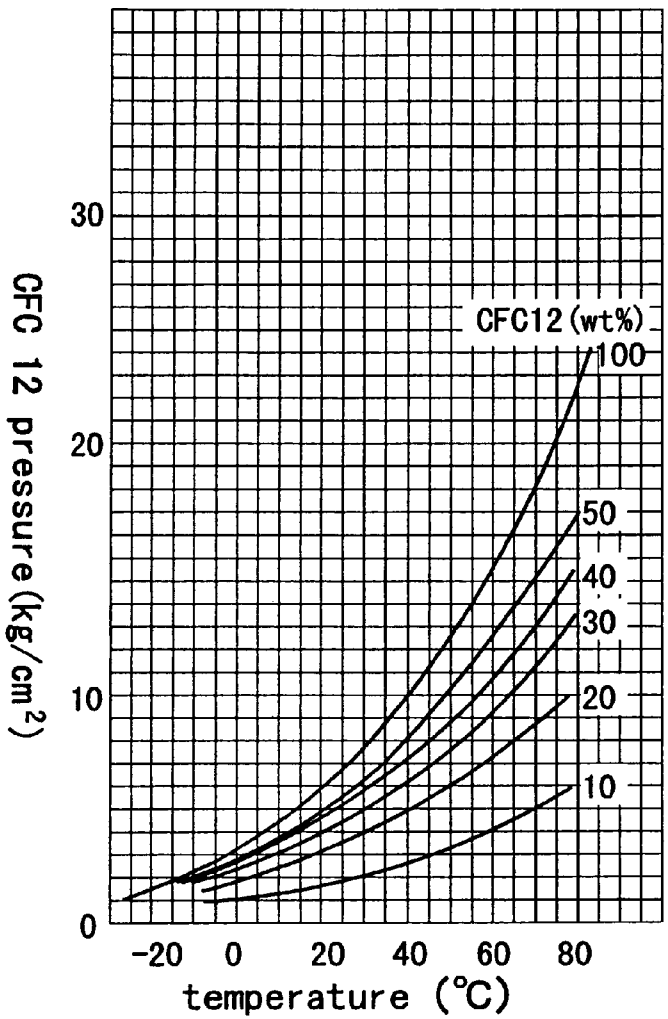
FIGS. 4A and 4B are graphs showing a solubility curve relating to the solubility of a CFC in a mineral oil and a solubility curve relating to the solubility of an HCFC in a mineral oil.
Figure 4A:
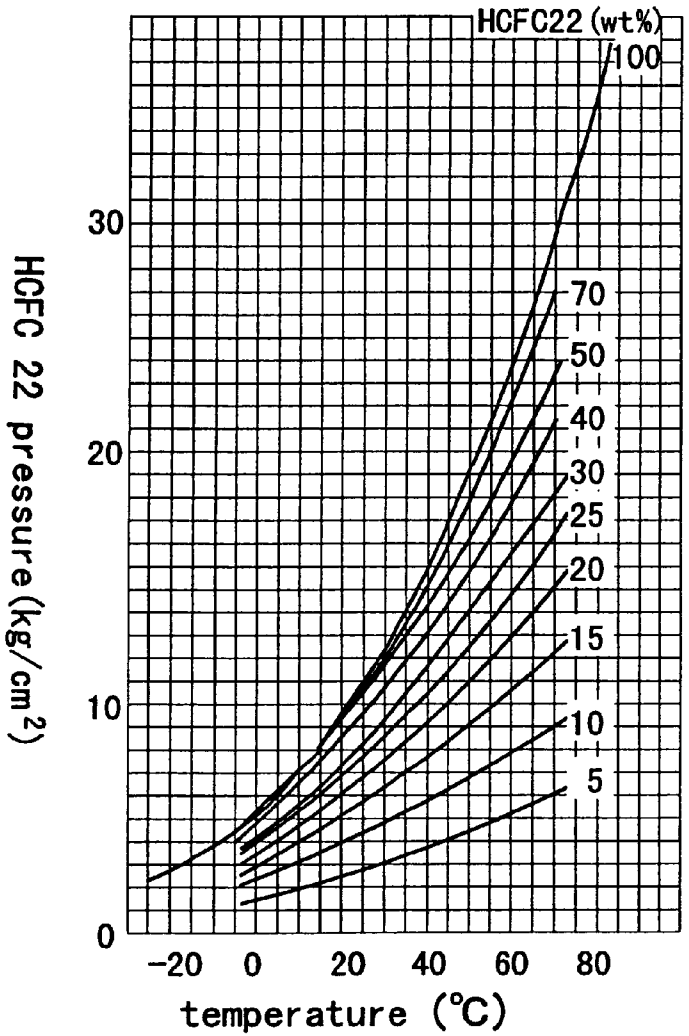

FIGS. 4A and 4B show example solution of an extraneous matter in a mineral oil; specifically, FIG. 4A is a solubility curve showing the solubility of an HCFC in a mineral oil, and FIG. 4B is a solubility curve showing the solubility of a CFC in a mineral oil. In the drawings, the horizontal axis represents temperature (° C.), and the longitudinal axis represents the pressure of the CFC or HCFC ($kg/cm^2$). In the solubility curve, the concentration of the CFC or HCFC (wt. %) is taken as a parameter.

The gaseous extraneous matter which has flowed into the container 51 from the outlet holes 55*a* of the inlet pipe 55 together with the gaseous refrigerant changes into bubbles. As a result, contact between the gaseous extraneous matter and the mineral oil 54 is increased, so that the CFC or HCFC is dissolved into the mineral oil 54 more thoroughly. Since the HFC is not dissolved in the mineral oil 54, all the HFC components are discharged from the outlet pipe 52. As mentioned above, solid extraneous matter and liquid extraneous matter are completely separated from the gaseous refrigerant within the container 51, and the thus-separated extraneous matter is trapped. Further, the majority of the CFC or HCFC which constitutes the principal component of the gaseous extraneous matter is dissolved into the mineral oil 54 while passing through the ion-exchange resin 56 several times. Thus, the CFC or HCFC is also trapped.

Chlorine components contained in the residual extraneous matter other than CFC or HCFC are dissolved into a trace amount of water existing in the refrigerant circuit and are present in the form of chlorine ions. Therefore, the chlorine ions are trapped during the course of gaseous refrigerant passing through the ion-exchange resin 56 several times.

Figure 5:
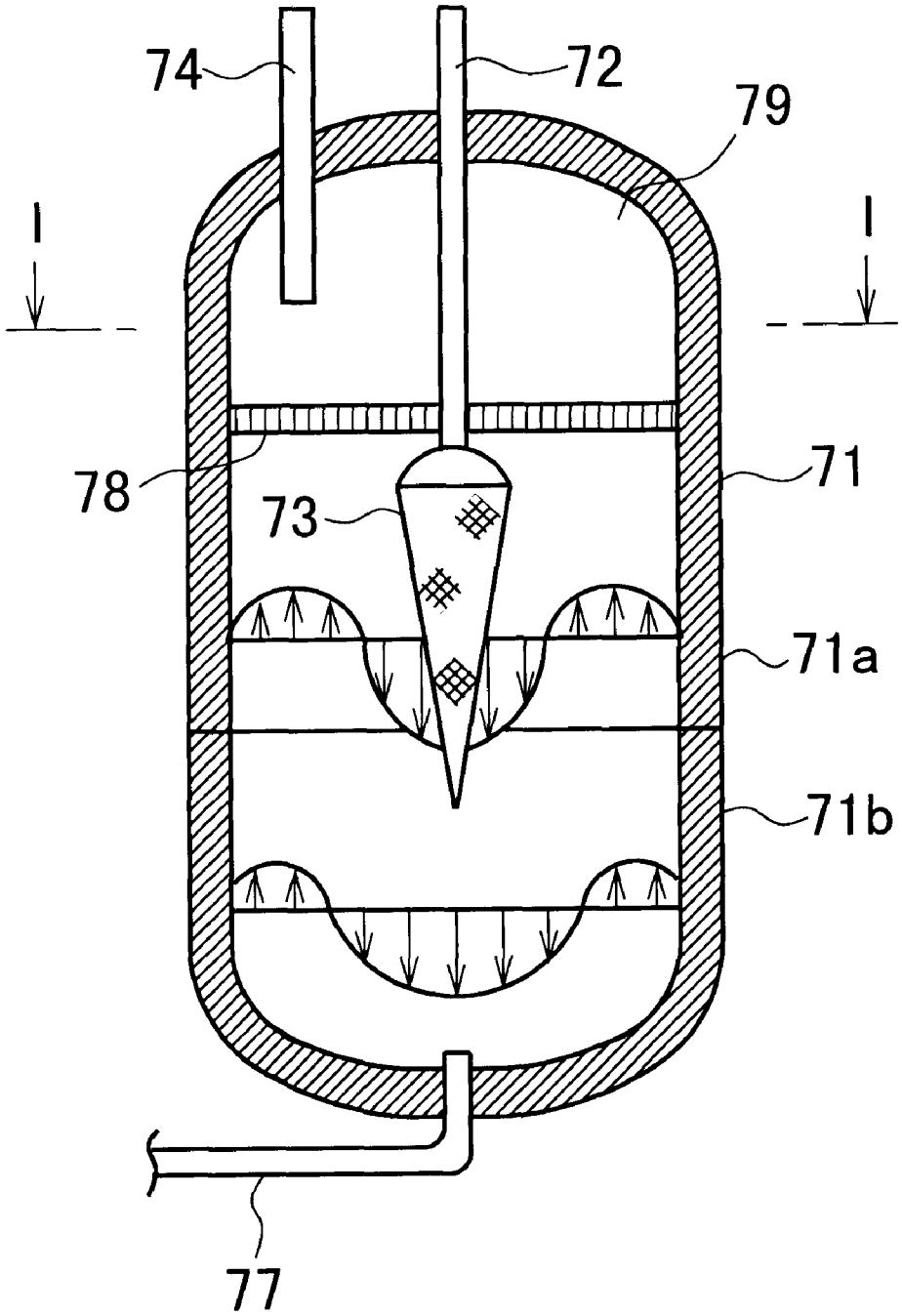
FIG. 5 is a cross-sectional view showing the structure of an oil separator of the present invention.

Next will be described the oil separator 9. An example high-performance oil separator is described in Japanese Utility Model Publication No. 19721/1993. FIG. 5 is a cross-sectional view showing the interior structure of the oil separator. Reference numeral 71 designates a hermetic container having a cylindrical body consisting of an upper shell 71*a* and a lower shell 71*b*; and 72 designates an entrance pipe whose leading end is provided with a net-like member 73. The entrance pipe 72 is attached to the hermetic container 71 in such a way as to pass through substantially the center of the upper shell 71*a* and protrude to the inside of the container 71. Refrigerant is introduced into the hermetic container 71 via the entrance pipe 72. Reference numeral 78 designates a circular uniform-velocity plate which is provided in an elevated position relative to the net-like member 73 and is formed from punching metal having a plurality of pores; 79 designates an upper space which is defined in an upper portion above the uniform-velocity plate 78 and serves as a refrigerant outlet space; 74 designates a refrigerant exit pipe whose leading end is located within the refrigerant outlet space; and 77 designates an oil drainage pipe.

An oil separator achieving a separation efficiency of 100% can be embodied by tandem connection of a plurality of such high-performance oil separators.

Figure 6:
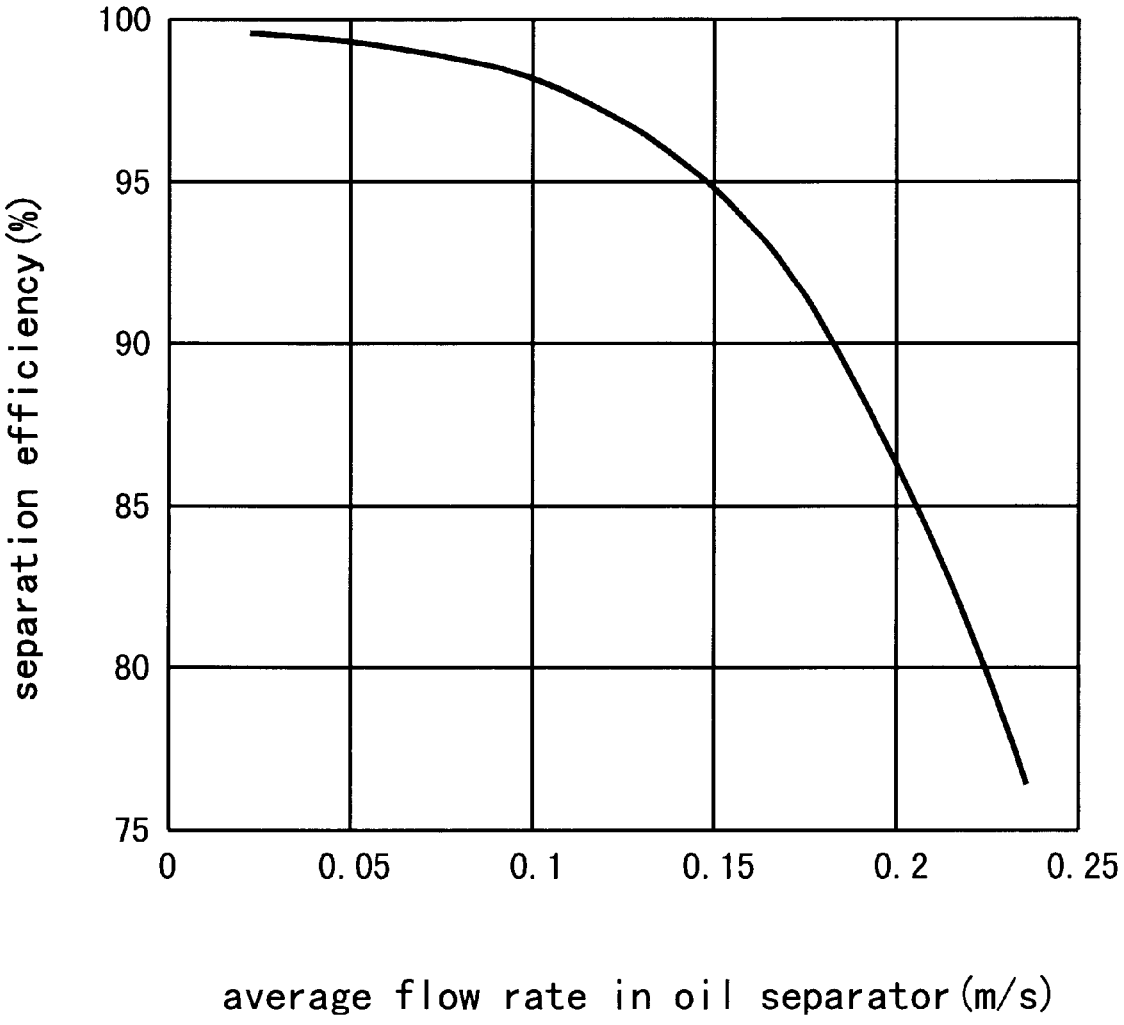
FIG. 6 is a graph showing the relationship between the flow rate of a gaseous refrigerant in the oil separator and the efficiency of separation of the gaseous refrigerant from the refrigeration oil.

FIG. 6 shows the results of a test relating to the flow rate of gaseous refrigerant in the oil separator having the structure shown in FIG. 5 and the separation efficiency of the oil separator. In the drawing, the horizontal axis represents mean flow rate (m/s) of gaseous refrigerant within a container, and the vertical axis represents the separation efficiency (%) of the oil separator.

The internal diameter of the first oil separator of the tandem oil separator is set such that the maximum flow rate of gaseous refrigerant assumes a value of 0.13 m/s or less. The refrigerator oil discharged from the compressor 1 usually assumes an oil-to-refrigerant flow ratio of 1.5 wt. % or less. The refrigerator oil assumes an oil-to-refrigerant flow ratio of 0.05 wt. % or less at the outlet side of the first oil separator.

At this ratio, the flow regime of a gas-liquid two-phase flow consisting of gaseous refrigerant and a refrigerator oil is a mist flow. The internal diameter of the second oil separator is set to be equal to or greater than that of the first oil separator. Further, the mesh of the net-like member 73 attached to the entrance pipe 72 is made very fine, thus enabling complete separation of the refrigerator oil from the gaseous refrigerant. As mentioned above, an oil separator achieving an isolation efficiency of 100% can be embodied by dimensional adjustment of an existing oil separator or by combination of a plurality of existing oil separators. The oil separator 9 shown in FIG. 1 corresponds to an oil separator embodied in such a way.

The entrance pipe 72 of the first oil separator of tandem-connected oil separators is connected to an outlet pipe of the compressor 1 shown in FIG. 1, and the exit pipe 74 of the final oil separator is connected to an intermediate point between the pipe connecting the outlet of the extraneous-matter trapping means 13 and the inlet of the accumulator 8.

As mentioned above, the oil separator 9 and the extraneous-matter trapping means 13 are incorporated into the heat source unit AA. Accordingly, a deteriorated CFC/HCFC-using refrigeration system can be replaced with a new HFC-using refrigeration system without replacement of the first connecting pipe CC and the second connecting pipe DD, by means of replacing only the heat source unit AA and the indoor unit BB with new ones. In contrast with the conventional first cleaning method, the existing pipe reuse method of the present invention eliminates a necessity of cleaning the refrigeration system with a specifically-designed cleaning solvent (HCFC 141b or HCFC 225) through use of cleaning equipment. Therefore, the method completely eliminates the possibility of depletion of the ozone layer, the use of a flammable and toxic substance, a fear of a residual cleaning solvent, and a necessity for recovery of a cleaning solvent.

In contrast with the conventional second cleaning method, the method of the present invention eliminates a necessity of operating the refrigeration system three times repeatedly for cleaning, as well as a necessity of replacing an HFC refrigerant and HFC refrigerator oil with new refrigerant and oil three times. The method of the present invention involves use of only the amount of HFC refrigerant and HFC refrigerator oil required for one refrigeration system, thus yielding an advantage in terms of cost and environmental cleanliness. Further, the method completely eliminates a necessity of managing refrigeration oil for replacement purpose and the chance of excess or shortage of the refrigeration oil. Further, there is no chance of the HFC refrigerator oil being incompatible with the HFC refrigerant or being deteriorated.

The previous embodiment has described the method of replacing the heat source unit AA and the indoor unit BB with new ones. However, the present invention also enables replacement of only the heat source unit AA with a new one without involvement of replacement of the first connecting pipe CC, the indoor unit BB, and the second connecting pipe DD.

Further, the previous embodiment described an example in which one indoor unit BB is connected to the refrigeration system. Needless to say, the present invention yields the same advantage as that yielded in the embodiment even when applied to a refrigeration system comprising a plurality of indoor units BB connected in series or parallel.

As is obvious, the same advantage is yielded even when a thermal storage ice bath or a thermal storage water bath (including hot water) is connected in parallel or series with the heat-source-unit-side heat exchanger 3.

The same advantage as that yielded by the previous embodiment is not limited to the refrigeration unit; the same advantage as in the previously-described embodiment is yielded so long as a thermo-compression refrigeration application comprises a unit incorporating a heat-source-unit-side heat exchanger and another unit incorporating a user-side heat exchanger, the units being remotely spaced away from each other.

The configuration of the refrigeration-system of the first embodiment can be summarized as follows:

The refrigeration system comprises the first refrigerant circuit for circulating a refrigerant from and to the compressor via the heat-source-unit-side heat exchanger, the flow-rate controller, the user-side heat exchanger, and the accumulator, in the sequence given. Further, the refrigeration system comprises the second refrigerant circuit for circulating a refrigerant from and to the compressor via the user-side heat exchanger, the flow-rate controller, the heat-source-unit-side heat exchanger, and the accumulator, in the sequence given.

Extraneous-matter trapping means for trapping extraneous matter contained in the refrigerant is interposed between the user-side heat exchanger and the accumulator of the first refrigerant circuit, as well as between the heat-source-unit-side heat exchanger and the accumulator of the second refrigerant circuit.

Further, oil separation means for separating an oil component from a refrigerant is interposed between the compressor and the heat-source-unit-side heat exchanger of the first refrigerant circuit, as well as between the compressor and the user-side heat exchanger of the second refrigerant circuit.

Next will be described methods of controlling the cleaning operation of the refrigeration system of the first embodiment after replacement of a refrigerant.

(1) First Control Method

According to a first method of controlling the cleaning operation of the refrigeration system of the first embodiment, the heat source unit AA and the indoor unit BB of the refrigerant circuit (i.e., the refrigeration system) which use a CFC or HCFC (i.e., an old refrigerant) are replaced with a heat source unit AA and an indoor unit BB which use an HFC (i.e., a new refrigerant). Depending on the situation, the indoor unit BB may not be replaced. After having been additionally recharged, the refrigeration system performs a cooling operation in step A of a cleaning operation procedure.

As indicated by solid arrows shown in FIG. 1, in step A the refrigerant flows from the compressor 1 to the first connecting pipe CC via the heat-source-unit-side heat exchanger 3, to the second connecting pipe DD via the flow-rate controller 4 and the user-side heat exchanger 6, and to the compressor 1 via the extraneous-matter trapping means 13 and the accumulator 8, thus cleaning the refrigeration system.

In the CFC/HCFC-using refrigeration system whose refrigerant has not yet been replaced, the first connecting pipe CC is in a liquid-refrigerant single-phase state or a gas-liquid two-phase state even during the heating or cooling operation of the refrigeration system. The mineral oil is not much dispersed in the first connecting pipe CC.

In contrast, the refrigerant contained in the second connecting pipe DD is in a gaseous single-phase state even during the cooling or heating operation of the refrigeration system, and the mineral oil flows over the interior wall surface of the second connecting pipe DD in the form of a liquid film while being drawn by the flow of gaseous refrigerant. Accordingly, a large mount of mineral oil is dispersed over the interior surface of the second connecting pipe DD. As mentioned above, at the beginning of the cleaning operation, the refrigeration system is operated such that the refrigerant flows from the first connecting pipe CC to the second connecting pipe DD, thereby enabling the extraneous-trapping means 13 to recover the mineral oil without a flow of the mineral oil, which is widely dispersing over the interior surface of the second connecting pipe DD, into the first connecting pipe CC.

Consequently, cleaning time can be shortened, and the amount of mineral oil remaining in the first and second connecting pipes CC and DD can be diminished.

(2) Second Control Method

According to a second method of controlling the cleaning operation of the refrigeration system of the first embodiment, the heat source unit AA and the indoor unit BB of the refrigerant circuit (i.e., the refrigeration system) which use a CFC or HCFC are replaced with a heat source unit AA and an indoor unit BB which use an HFC. After having been additionally recharged, the refrigeration system performs a heating operation in step B of a cleaning operation procedure.

As indicated by broken arrows shown in FIG. 1, in step B the refrigerant flows from the compressor 1 to the second connecting pipe DD, to the first connecting pipe CC via the user-side heat exchanger 6 and the flow-rate controller 4, and to the compressor 1 via the heat-source-unit-side heat exchanger 3, the extraneous-matter trapping means 13, and the accumulator 8, thus cleaning the refrigeration system.

In step B, the refrigeration system is cleaned by causing a refrigerant to flow in the sequence given from the second connecting pipe DD to the first connecting pipe CC.

In the refrigeration system of the first embodiment shown in FIG. 1, the inner diameter of the first connecting pipe CC is usually larger than that of the second connecting pipe DD. The reason for this is that the magnitude of friction loss arising in the second connecting pipe DD during a cooling operation is related to an evaporation temperature and greatly affects cooling capability. Therefore, the inner diameter of the second connecting pipe DD is made as large as possible. In contrast, the friction loss arising in the first connecting pipe CC does not directly affect an evaporation temperature or condensation temperature. Since the refrigerant flowing through the first connecting pipe CC is in a liquid single-phase state or a gas-liquid two-phase state, the inner diameter of the first connecting pipe CC is made as small as possible, in order to prevent an increase in the amount of refrigerant to be recharged.

It can also be said that in step B the first and second connecting pipes CC and DD are cleaned such that a refrigerant is caused to flow in the sequence given from a large-diameter pipe to a small-diameter pipe.

Figure 7:
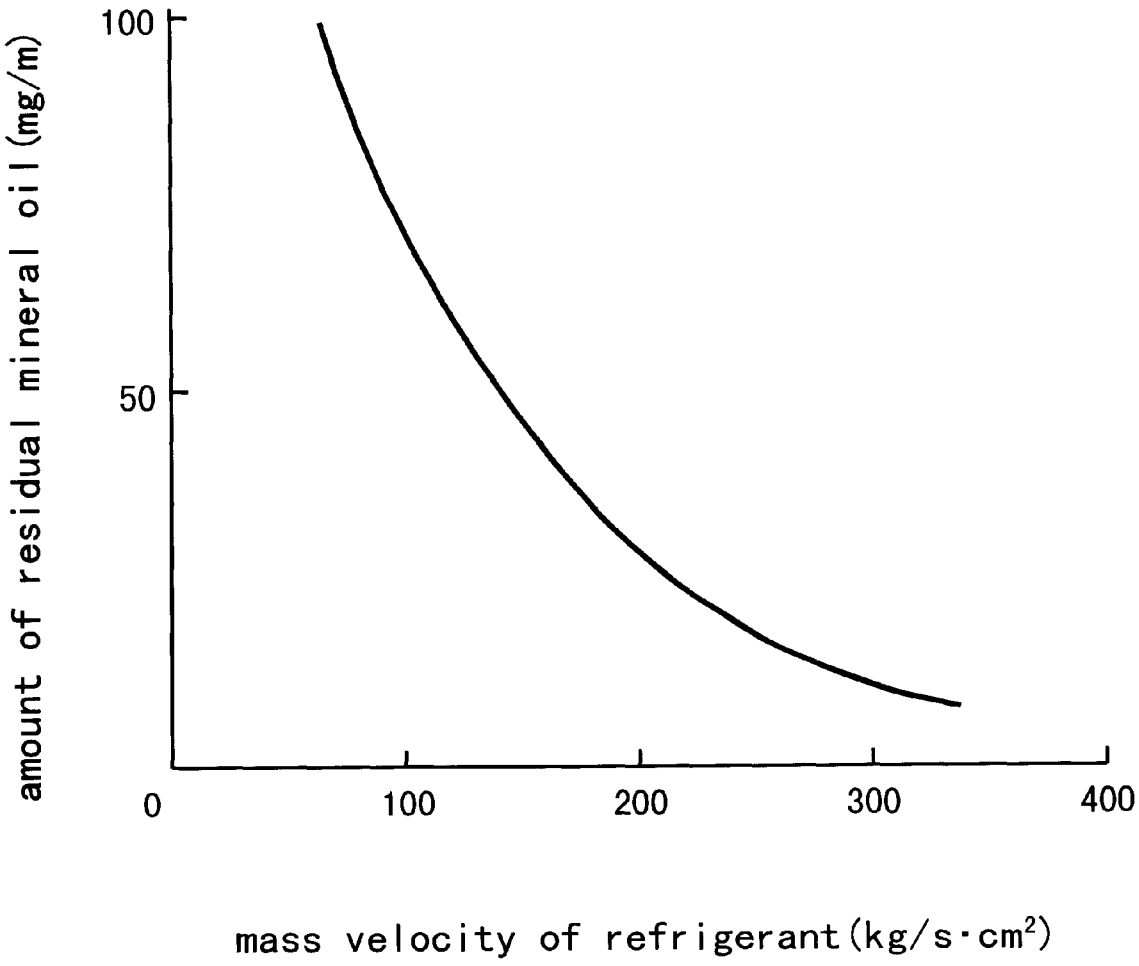
FIG. 7 is a graph showing one example relationship between the mass velocity of a refrigerant circulating through a refrigerant pipe and the amount of mineral oil remaining in the refrigerant pipe.

FIG. 7 shows the amount of residual mineral oil in a case where R407C, which is one type of HFC refrigerant, is used for cleaning the mineral oil remaining in the pipe while in a liquid or a gas-liquid two-phase state. In FIG. 7, the horizontal axis represents the mass velocity of a refrigerant ($kg/s \cdot cm^2$), and the vertical axis represents the amount of mineral oil remaining in the pipe (mg/m). As can be seen from FIG. 7, the higher the mass velocity of the refrigerant, the stronger the cleaning effect, thus achieving a very strong cleaning effect. The inner diameter of the second connecting pipe DD is large, and the mass velocity of the refrigerant is small. In these points, the cleaning effect is weak. However, the second connecting pipe DD is located upstream of the first connecting pipe CC with respect to the flow direction of the refrigerant. Further, the refrigerant has a high temperature, thereby increasing the solubility of the refrigerant in the mineral oil. This in turn makes the viscosity of the mineral oil high, thus improving the cleaning effect.

(3) Third Control Method

According to a third method of controlling the cleaning operation of the refrigeration system of the first embodiment, the heat source unit AA and the indoor unit BB of the refrigerant circuit (i.e., the refrigeration system) which use a CFC or HCFC are replaced with a heat source unit AA and an indoor unit BB which use an HFC. After having been additionally recharged, the refrigeration system performs a cleaning operation in the sequence given from the cooling operation in step A to the heating operation in step B of the cleaning operation procedure.

As a result of the cleaning operation being performed in the sequence given from step A to step B, the extraneous-matter trapping means 13 recovers the mineral oil, by avoiding a flow of the mineral oil, which is widely dispersing over the interior surface of the second connecting pipe DD, into the first connecting pipe CC. Subsequently, the refrigeration system is subjected to cleaning which has a stronger effect in terms of mass velocity and solubility. Consequently, there can be achieved a stronger cleaning effect and a shorter cleaning time.

(4) Fourth Control Method

According to a fourth method of controlling the cleaning operation of the refrigeration system of the first embodiment, the heat source unit AA and the indoor unit BB of the refrigerant circuit (i.e., the refrigeration system) which use a CFC or HCFC are replaced with a heat source unit AA and an indoor unit BB which use an HFC. After having been additionally recharged, an operating capacity of the refrigeration system for a cleaning operation is controlled according to the inner diameters of the first and second connecting pipes CC and DD which are objects of cleaning. Further, the mass velocity of the refrigerant flowing through the first and second connecting pipes CC and DD currently being cleaned is set to be greater than a predetermined value or to fall within a certain range, thereby ensuring a strong cleaning effect. By way of an example, a preferred predetermined mass velocity of the refrigerant is 150 kg/s·cm$^2$ or more. This applies to step A and step B.

As described above, FIG. 7 shows an example relationship between the mass velocity of a refrigerant and the amount of mineral oil remaining in a pipe, showing that the higher the mass velocity of the refrigerant in the pipe, the stronger the cleaning effect.

Second Embodiment

Figure 8:
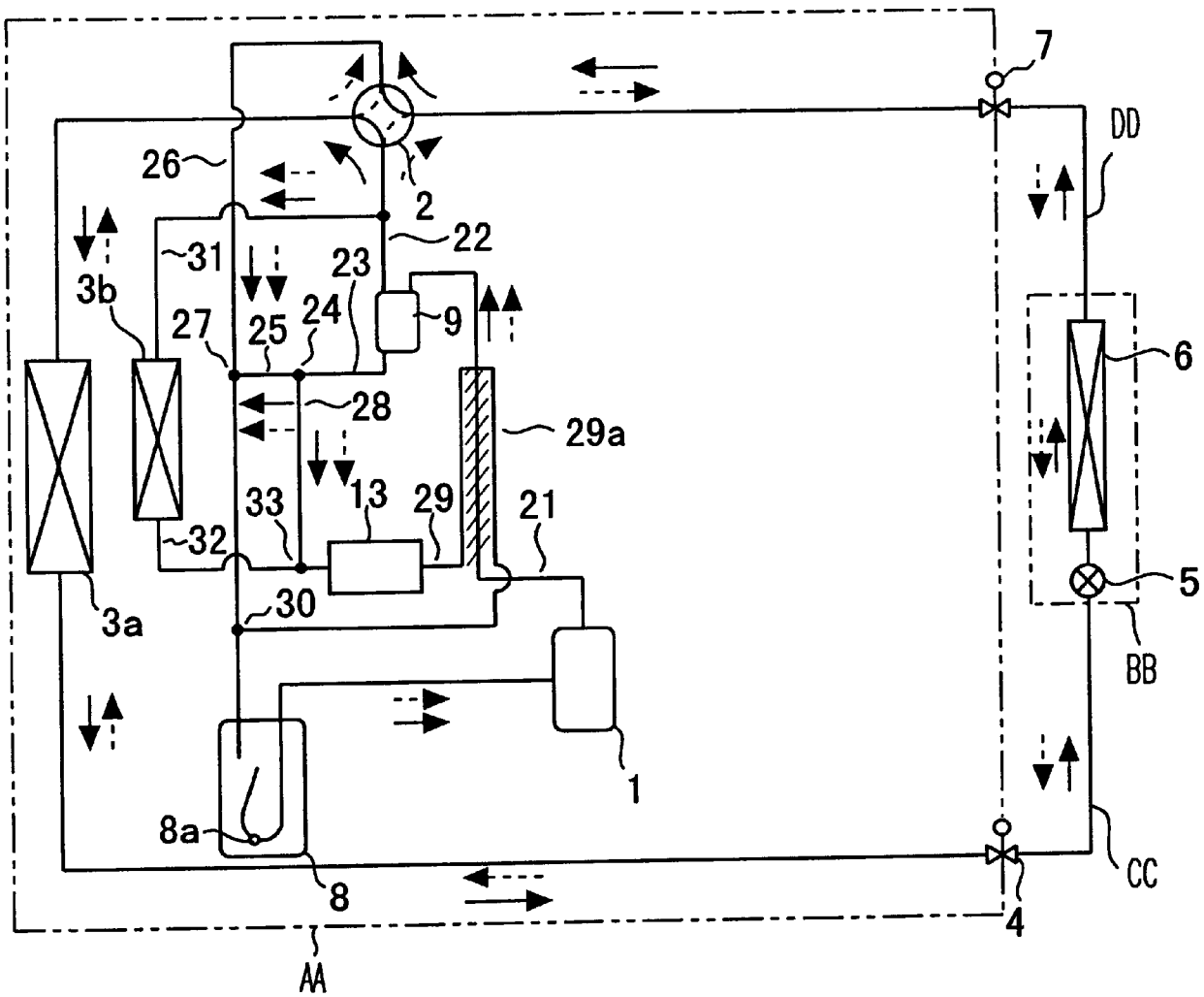
FIG. 8 is a schematic diagram showing a refrigerant circuit of a refrigeration system, as an example refrigeration system according to a second embodiment of the present invention.

FIG. 8 is a schematic diagram showing a refrigerant circuit of a refrigeration system which effects heat exchange by means of a refrigerant, as an example refrigeration system according to a second embodiment of the present invention.

In FIG. 8, reference symbol AA designates a heat source unit accommodating a compressor 1, a four-way valve 2, heat exchangers 3*a* and 3*b* on heat-source-unit-side, a first control valve 4, a second control valve 7, an accumulator 8, an oil separator 9 (corresponding to oil separation means), and extraneous-matter trapping means 13.

The oil separator 9 is interposed between an outlet pipe 21 of the compressor 1 and an inlet pipe 22 of the four-way valve 2 for separating a refrigeration oil discharged from the compressor 1 together with a refrigerant and for discharging the thus-separated refrigeration oil to a refrigeration oil return pipe 23. The return pipe 23 is connected to a branch line 25 at a junction 24, and the branch line 25 is connected, by way of a junction 27, to a pipe 26 connecting the four-way valve 2 with the accumulator 8. The return pipe 23 and the branch line 25 constitute a bypass extending from the bottom of the oil separator 9 to the pipe 26 connected to the accumulator 8.

The extraneous-matter trapping means 13 is connected to a branch line 28 originating from the junction 24 between the return pipe 23 and the branch line 25. An exit pipe 29 of the extraneous-matter trapping means 13 is brought into contact with the outlet pipe 21 of the compressor 1 in a contact section 29*a*. The exit pipe 29 is then connected to the pipe 26 extending from the four-way valve 2 to the accumulator 8, by way of a junction 30.

The second heat exchanger 3*b* on the heat-source-unit-side is connected to the pipe 22 connected to the exit of the oil separator 9, by way of a branch line 31. An outlet pipe 32 of the second heat-source-unit-side heat exchanger 3*b* is connected to the branch line 28 extending from the oil separator 9 to the extraneous-matter trapping means 13, by way of a junction 33. The refrigeration oil which has been separated by the oil separator 9 and passed through the return pipe 23 and the branch line 28 merges with the refrigerant which has flowed from the oil separator 9 and passed through the second heat-source-unit-side heat exchanger 3*b*, and the thus-merged flow enters the extraneous-matter trapping means 13.

The branch line 28—which is branched at the junction 24 from the refrigeration oil return pipe 23 of the oil separator 9 and is connected to the extraneous-matter trapping means 13—is made wider than the branch line 25 connected to the accumulator 8 by way of the junction 24. The refrigeration oil separated by the oil separator 9 readily flows into the branch line 28 until a large amount of extraneous matter is trapped by the extraneous-matter trapping means 13. An oil return hole 8*a* is formed in a lower portion of a U-shaped outlet pipe of the accumulator 8.

Each of the branch lines 25, 28, and 31 may be provided with a flow rate control valve, as required.

Reference symbol BB designates an indoor unit equipped with a flow rate regulator 5 (or a flow rate control valve 5) and a heat exchanger 6 on a user-side.

Reference symbol CC designates a first connecting pipe whose one end is connected to a heat exchanger 3 on a heat-source-unit-side via a first control valve 4 and whose other end is connected to the flow rate regulator 5.

Reference symbol DD designates a second connecting pipe whose one end is connected to the four-way valve 4 via the second control valve 7 and whose other end is connected to the user-side heat exchanger 6.

The heat source unit AA and the indoor unit BB are remotely separated from each other and interconnected via the first connecting pipe CC and the second connecting pipe DD, thus constituting a refrigeration system (i.e., a system employing the refrigeration cycle).

The refrigeration system uses an HFC (hereinafter also called a "new refrigerant," as required).

Next will be described procedures for replacing a deteriorated refrigeration system using a CFC or HCFC (hereinafter called as an "old refrigerant," as required) with a refrigeration system using an HFC. A CFC or HCFC is recovered from the existing refrigeration system, and the heat source unit AA is replaced with a new heat source unit AA using an HFC as shown in FIG. 8. The first connecting pipe CC, the indoor unit BB and the second connecting pipe DD used for the HCFC-using refrigeration system are reused, thus constituting the refrigerant circuit shown in FIG. 8.

Since the new heat source unit AA has been filed with an HFC in advance, the refrigeration system is evacuated while the first control valve 4 and the second control valve 7 remain closed and while the indoor unit BB, the first connecting pipe CC, and the second connecting pipe DD are connected to the refrigeration system. Subsequently, the first control valve 4 and the second control valve 7 are opened, and the refrigeration system is additionally charged with an HFC. Thereafter, the refrigeration system performs an ordinary cooling and cleaning operation.

The ordinary cooling and cleaning operation will now be described by reference to FIG. 8. Solid arrows in the drawing depict the flow of a refrigerant during a cooling operation of the refrigeration system, and broken arrows depict the flow of a refrigerant during a heating operation.

First will be described the flow of a refrigerant during a cooling operation. The refrigerant is compressed by the compressor 1 to become a hot, high-temperature gas; is discharged from the compressor 1 together with an HFC refrigeration oil; and enters the oil separator 9.

The gaseous refrigerant which has been separated from the HFC refrigeration oil by the oil separator 9 flows, via the four-way valve 2, into the heat-source-unit-side heat exchanger 3*a*, where the gaseous refrigerant exchanges heat with a heat source medium, such as air or water, and is condensed. At this time, some of the gaseous refrigerant, which has exited from the oil separator 9, is diverted to the second heat-source-unit-side heat exchanger 3*b*, where the gaseous refrigerant similarly exchanges heat with a heat source material, such as air or water, and is condensed.

The HFC refrigeration oil is completely separated from the HFC refrigerant in the oil separator 9, and the thus-separated hot refrigeration oil flows from the bottom of the oil separator 9 to the refrigerator return pipe 23. The hot refrigeration oil discharged from the oil separator 9 flows through the branch line 28 and merges with the refrigerant which has been condensed by the heat-source-unit-side heat exchanger 3*b*. The refrigeration oil and the refrigerant flow into the extraneous-matter trapping means 13, where the refrigeration oil is separated and trapped. The refrigerant, which has flowed from the extraneous-matter trapping means 13, exchanges heat with the discharge pipe 21 at the contact section 29*a* of the pipe 29, whereupon the refrigerant is evaporated. The thus-evaporated refrigerant merges with the principal stream of refrigerant in the pipe 26, thus flowing into the accumulator 8.

As mentioned above, a predetermined amount of liquid refrigerant is poured from the heat-source-unit-side heat exchanger 3*b* into the refrigeration oil having residual extraneous matter dissolved therein, thereby increasing the temperature of the refrigerant in the refrigeration oil. In the extraneous-matter trapping means 13, extraneous matter precipitates at a liquid boundary plane between the refrigeration oil and the liquid refrigerant. A specific example of the extraneous-matter trapping means 13 will be described later. The thus-precipitated extraneous matter migrates toward the wall surface of the extraneous-matter trapping means 13 by means of turbulent diffusion and adheres to and is trapped by the filter. Similarly, extraneous matter, which is not dissolved in the refrigeration oil, is also trapped by the extraneous-matter trapping means 13.

The refrigerant, which has been condensed by the heat-source-unit-side heat exchanger 3*a*, flows into the first connecting pipe CC via the first control valve 4.

During the course of the liquid HFC refrigerant flowing through the first connecting pipe CC, a CFC, an HCFC, a mineral oil, or a deteriorated mineral oil (hereinafter referred to as a "residual extraneous matter") remaining in the first connecting pipe CC is cleaned little by little. The thus-cleared residual extraneous matter flows into the flow rate regulator 5 together with the liquid HFC refrigerant. In the flow rate regulator 5, the liquid HFC refrigerant is decompressed to a low pressure and into a low-pressure two-phase state. The thus-decompressed liquid HFC refrigerant flows into the user-side heat exchanger 6 together with the residual extraneous matter removed from the first connecting pipe CC. As in the case of the first connecting pipe CC, the extraneous matter remaining in the user-side heat exchanger 6 is cleaned little by little, and the refrigerant exchanges heat with a user medium, such as air, and is evaporated and gasified.

The thus-evaporated refrigerant flows into the second connecting pipe DD together with the residual extraneous matter exfoliated from the first connecting pipe CC and the indoor unit BB. Since the refrigerant flowing through the second connecting pipe DD is in a gaseous state, a portion of residual extraneous matter adhering to the interior surface of the second connecting pipe DD flows in the gaseous refrigerant in the form of a mist. The majority of the liquid residual extraneous matter flows at a speed slower than the flow rate of the gaseous refrigerant, thus inducing generation of a shearing force in the boundary plane between gas and liquid. By means of the shearing force, the liquid residual extraneous matter annularly flows along the interior surface of the second connecting pipe DD while being drawn by the gaseous refrigerant. Although cleaning of the second connecting pipe DD requires cleaning time longer than that required for cleaning the first connecting pipe CC, the second connecting pipe DD is cleaned thoroughly.

Subsequently, the gaseous refrigerant returns to the compressor 1 together with the residual extraneous matter removed from the first connecting pipe CC, that removed from the user-side heat exchanger 6, and that removed from the second connecting pipe DD, via the second control valve 7, the four-way valve 2, and the accumulator 8.

The refrigerant circuit used for a cooling operation; specifically, the refrigerant circuit which extends from and returns to the compressor 1 via the heat-source-unit-side heat exchanger 3, the flow rate regulator 5, the user-side heat exchanger 6, and the accumulator 8, in the sequence given, is herein taken as a first refrigerant circuit.

The HFC refrigeration oil, which has been completely separated from the gaseous refrigerant by the oil separator 9, flows to the pipe 29 via the refrigeration oil return pipe 23, the branch line 28, and the extraneous-matter trapping means 13. The principal stream of HFC refrigeration oil containing the residual extraneous matter removed from the first connecting pipe CC, that removed from the user-side heat exchanger 6, and that removed from the second connection pipe D merges with the flow of the HFC refrigeration oil at the junction 30 between the pipe 26 and the pipe 29. The thus-merged flow of HFC refrigeration oil returns to the compressor 1. The HFC refrigeration oil is mixed with the residual extraneous matter. However, deterioration in the HFC refrigeration oil is attributable to chemical reaction and does not proceed abruptly.

FIG. 2 shows an example of deterioration in the HFC refrigeration oil. A graph shown in FIG. 2 represents chronological deterioration of the HFC refrigeration oil (at a temperature of 175° C.) when chlorine is mixed in the HFC refrigeration oil. The horizontal axis of the graph represents time (hr), and the vertical axis of the same represents total acid number (mgKOH/g).

The gaseous extraneous matter which has not been trapped during the single passage of the gaseous refrigerant through the extraneous-matter trapping means 13 passes through the extraneous-matter trapping means 13 again and again, along with circulation of the HFC refrigerant. Hence, the only requirement is that the gaseous matter is trapped by the extraneous-matter trapping means 13 faster than the rate at which the HFC refrigeration oil deteriorates. The pressure exerted on the entrance portion of the extraneous-matter trapping means 13 and that exerted on the exit portion of the same is measured. If a difference between thus-measured pressure values is greater than a predetermined value, it is determined that a large amount of residual extraneous matter has been trapped; specifically, that the refrigeration oil of the heat source unit has deteriorated. Thus, the pressure differential between the entrance and exit portions of the extraneous-matter trapping means 13 serves as an index for replacing the refrigeration oil or the extraneous-matter trapping means 13.

Next will be described the flow of a refrigerant during a heating operation of the refrigeration system. A refrigerant is compressed by the compressor 1 so as to become a hot, high-pressure gas; is discharged from the compressor 1 together with an HFC refrigeration oil; and enters the oil separator 9, where the HFC refrigeration oil is completely separated from the gaseous refrigerant. Only the gaseous refrigerant flows into the four-way valve 2.

At this time, some of the gaseous refrigerant which has exited the oil separator 9 is diverted to the second heat-source-unit-side heat exchanger 3*b*, where the gaseous refrigerant exchanges heat with a heat source material, such as air or water, and is condensed.

The hot HFC refrigeration oil separated by the oil separator 9 flows from the bottom of the oil separator 9 to the refrigeration oil return pipe 23. The hot refrigeration oil, which has flowed from the oil separator 9, flows into the branch line 28 and merges with the refrigerant which has been condensed by the heat-source-unit-side heat exchanger 3*b*. The refrigerant and the refrigeration oil flow into the extraneous-matter trapping means 13.

As mentioned above, a predetermined amount of liquid refrigerant is poured from the heat-source-unit-side heat exchanger 3*b* into the refrigeration oil having residual extraneous matter dissolved therein, thereby increasing the temperature of the refrigerant in the refrigeration oil. In the extraneous-matter trapping means 13, extraneous matter precipitates at a liquid boundary plane between the refrigeration oil and the liquid refrigerant. A specific example of the extraneous-matter trapping means 13 will be described later. The thus-precipitated extraneous matter migrates toward the wall surface of the extraneous-matter trapping means 13 by means of turbulent diffusion and adheres to and is trapped by the filter. Similarly, extraneous matter, which is not dissolved in the refrigeration oil, is also trapped by the extraneous-matter trapping means 13.

The refrigerant, which has flowed into the four-way valve 2, flows into the second connecting pipe DD via the second control valve 7.

Since the refrigerant flowing through the second connecting pipe DD is in a gaseous state, some of the residual extraneous matter adhering to the interior surface of the second connecting pipe DD flows in the gaseous refrigerant in the form of a mist. The majority of the liquid residual extraneous matter flows at a speed slower than the flow rate of the gaseous refrigerant, thus inducing generation of a shearing force in the boundary plane between gas and liquid. By means of the shearing force, the liquid residual extraneous matter annularly flows along the interior surface of the second connecting pipe DD while being drawn by the gaseous refrigerant. Although cleaning of the second connecting pipe DD requires cleaning time longer than that required for cleaning the first connecting pipe CC or the user-side heat exchanger 6 during a cooling operation, the second connecting pipe DD is cleaned thoroughly.

Subsequently, the gaseous refrigerant flows, together with the residual extraneous matter removed from the second connecting pipe DD, into the user-side heat exchanger 6. As in the case of the second connecting pipe DD, the extraneous matter remaining in the user-side heat exchanger 6 is cleaned little by little, and the refrigerant exchanges heat with a user medium, such as air, and is condensed. The thus-condensed refrigerant flows to the flow rate regulator 5, where the refrigerant is decompressed to a low-pressure two-phase state. The gaseous refrigerant then flows into the first connecting pipe CC. Since the gaseous refrigerant is in a gas-liquid two-phase state and flows at high speed, the gaseous refrigerant cleans the extraneous matter remaining in the first connecting pipe CC together with the liquid refrigerant at a speed faster than that at which the first connecting pipe CC and the user-side heat exchanger 6 are cleaned during a cooling operation.

The refrigerant in the gas-liquid two-phase state flows, together with the residual extraneous matter removed from the second connecting pipe DD, that removed from the user-side heat exchanger 6, and that removed from the first connecting pipe CC, into the first heat-source-unit-side heat exchanger 3*a*, via the first control valve 4. In the first heat-source-unit-side heat exchanger 3*a*, the refrigerant exchanges heat with a heat source medium, such as water or air, and is evaporated. The thus-evaporated refrigerant returns to the compressor 1 via the four-way valve 2 and the accumulator 8.

The refrigerant circuit used for a heating operation; specifically, the refrigerant circuit which extends from and returns to the compressor 1 via the user-side heat exchanger 6, the flow rate regulator 5, the heat-source-unit-side heat exchanger 3*a*, and the accumulator 8, in the sequence given, is taken herein as a second refrigerant circuit.

The HFC refrigeration oil, which has been completely separated from the gaseous refrigerant by the oil separator 9, flows to the pipe 29 via the refrigeration oil return pipe 23, the branch line 28, and the extraneous-matter trapping means 13. The principal stream of HFC refrigeration oil containing the residual extraneous matter removed from the second connection pipe DD, that removed from the user-side heat exchanger 6, and that removed from the first connecting pipe CC merges with the flow of the HFC refrigeration oil at the junction 30 between the pipe 26 and the pipe 29. The thus-merged flow of HFC refrigeration oil returns to the compressor 1. The HFC refrigeration oil is mixed with the residual extraneous matter. However, deterioration in the HFC refrigeration oil is attributable to chemical reaction and does not proceed abruptly.

The residual extraneous matter, which has not been trapped during the single passage of the gaseous refrigerant through the extraneous-matter trapping means 13, passes through the extraneous-matter trapping means 13 again and again, along with circulation of the HFC refrigerant. Hence, the only requirement is that the residual extraneous matter be trapped by the extraneous-matter trapping means 13 faster than the rate at which the HFC refrigeration oil deteriorates. Further, the pressure exerted on the entrance portion of the extraneous-matter trapping means 13 and that exerted on the exit portion of the same is measured. If a difference between thus-measured pressure values is greater than a predetermined value, it is determined that a large amount of residual extraneous matter has been trapped; specifically, that the refrigeration oil of the heat source unit has deteriorated. Thus, the pressure differential between the entrance and exit portions of the extraneous-matter trapping means 13 serves as an index for replacing the refrigeration oil or the extraneous-matter trapping means 13.

Figure 9:
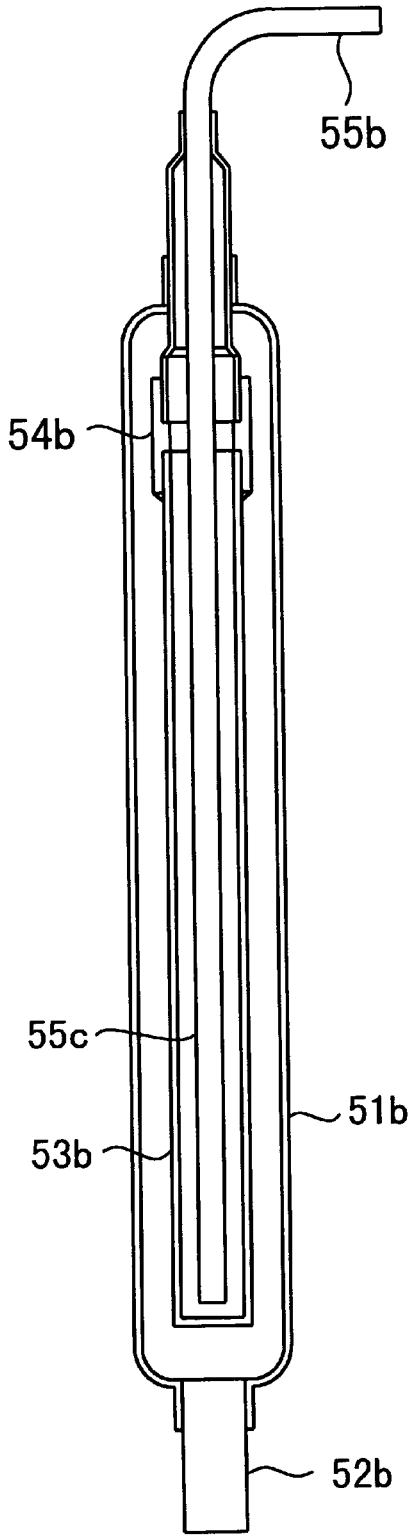
FIG. 9 is a cross-sectional view BB showing another example extraneous-matter trapping means of the present invention.

Next will be described an example of the extraneous-matter trapping means 13. FIG. 9 illustrates an example cross-sectional structure of the extraneous-matter trapping means 13. Reference numeral 51*b* designates a cylindrical container; 55*b* designates an inlet pipe which is provided in an upper portion of the container 51*b*, guides an inflow into a filter, and has minute holes formed in the side surface thereof; 55*c* designates a minute hole formed in the side surface of the inlet pipe 55*b*; 53*b* designates a cylindrically-formed filter provided inside the container 51*b*; 54*b* designates a joint for interconnecting the filter 53*b* and the inlet pipe 55*b*; and 52*b* designates an outlet pipe provided in a lower portion of the side surface of the container 51*b*.

The filter 53*b* corresponds to a net formed from fine line; specifically, the filter is formed from sintered metal so as to have a mesh measuring from several microns to tens of microns. Therefore, a piece of extraneous matter larger than the size of the mesh cannot pass through the filter 53*b*.

The inlet pipe 55*b* is connected to a downstream portion of the branch line 28 in FIG. 8 with respect to a junction between the branch line 28 and the pipe 32, and the outlet pipe 52*b* is connected to the pipe 29.

The gaseous refrigerant containing the residual extraneous matter dissolved in the refrigeration oil, which has flowed into the container 51*b* from the inlet pipe 55*b*, passes through the fine holes 55*c* formed in the inlet pipe 55*b*. The residual extraneous matter is brought into contact with the filter 53*b*, thereby accelerating adhesion of the extraneous matter to the filter 53*b*. Thus, the extraneous matter precipitates on and trapped by the side and lower surfaces of the filter 53*b*. The refrigerant flows out from the outlet pipe 52*b*. Since CFC or HCFC of the residual extraneous matter is also disolved in the mineral oil, CFC or HCFC can be trapped by the filter 53*b*.

FIGS. 4A and 4B show an example solution of extraneous matter in a mineral oil; specifically, wherein FIG. 4A is a solubility curve showing the solubility of HCFC in a mineral oil, and FIG. 4B is a solubility curve showing the solubility of CFC in a mineral oil. In the drawings, the horizontal axis represents temperature (° C.), and the vertical axis represents the pressure of CFC or HCFC (kg/cm$^2$). The solubility curve is depicted while the concentration of CFC or HCFC (wt. %) is taken as a parameter.

As mentioned above, the residual extraneous matter is completely separated from the refrigeration oil and trapped within the container 51*b*. Further, the majority of CFC or HCFC is dissolved into the mineral oil 54 while passing through the container 51*a* several times.

Chlorine components, contained in the residual extraneous matter other than CFC or HCFC, are combined with iron ions or copper ions in the refrigerant circuit. Therefore, these chlorine components are trapped when passing through the filter 53*b*.

The oil separator 9 has already been described by reference to FIGS. 5 and 6. The present embodiment employs an oil separator similar to the oil separator 9.

The inlet pipe 72 of the first oil separator of tandem-connected oil separators is connected to the outlet pipe 21 of the compressor 1 in FIG. 8, and the outlet pipe 74 of the final oil separator is connected to the inlet pipe 22 of the four-way valve 2.

As mentioned above, the oil separator 9 and the extraneous-matter trapping means 13 are incorporated into the heat source unit AA. Accordingly, a deteriorated refrigeration system using old refrigerant CFC or HCFC can be replaced with a refrigeration system using new refrigerant (HFC) without replacement of the indoor unit BB, the first connecting pipe CC, and the second connecting pipe DD, by means of replacing only the heat source unit AA with a new one. In contrast with the conventional first cleaning method, the existing pipe reuse method of the present invention eliminates a necessity of cleaning the refrigeration system with a specifically-designed cleaning solvent (HCFC 141b or HCFC 225) through use of cleaning equipment. Therefore, the method completely eliminates the possibility of depletion of the ozone layer, the use of a flammable and toxic substance, a fear of existence of residual cleaning solvent, and a necessity for recovery of a cleaning solvent.

In contrast with the conventional second cleaning method, the method of the present invention eliminates a necessity of operating the refrigeration system three times repeatedly for cleaning, as well as of replacing an HFC refrigerant and HFC refrigeration oil three times. The method of the present invention involves use of only the amount of HFC refrigerant and HFC refrigeration oil required for one refrigeration system, thus yielding an advantage in terms of cost and environmental cleanliness. Further, the method completely eliminates a necessity of managing refrigeration oil for replacement purpose and the chance of excess or insufficient refrigeration oil. Further, there is no chance of the HFC refrigeration oil being incompatible with the HFC refrigerant or being deteriorated.

The previous embodiment has described the method of replacing only the heat source unit AA with a new one. However, the present invention also enables replacement of the heat source unit AA and the indoor unit BB with new ones without involvement of replacement of the first connecting pipe CC and the second connecting pipe DD.

Further, the previous embodiment described an example in which one indoor unit BB is connected to the refrigeration system. Needless to say, the present invention yields the same advantage as that yielded in the embodiment even when applied to a refrigeration system comprising a plurality of indoor units BB connected in series or parallel.

As is obvious, the same advantage is yielded even when a thermal storage ice bath or a thermal storage water bath (including hot water) is connected in parallel or series with the heat-source-unit-side heat exchanger 3.

The same advantage as that yielded by the previous embodiment is not limited to the refrigeration unit; the same advantage as in the previously-described embodiment is yielded so long as a thermo-compression refrigeration application comprises a unit incorporating a heat-source-unit-side heat exchanger and another unit incorporating a user-side heat exchanger, the units being remotely spaced away from each other.

The configuration of the refrigeration system of the first embodiment may be summarized as follows:

The refrigeration system comprises the first refrigerant circuit for circulating a refrigerant from and to the compressor via the heat-source-unit-side heat exchanger, the flow rate controller, the user-side heat exchanger, and the accumulator, in the sequence given. Further, the refrigeration system comprises the second refrigerant circuit for circulating a refrigerant from and to the compressor via the user-side heat exchanger, the flow rate controller, the heat-source-unit-side heat exchanger, and the accumulator, in the sequence given. The refrigeration system of the present embodiment comprises extraneous-matter trapping means for separating and trapping the extraneous matter which has been separated by the oil separation means and is contained in the refrigeration oil.

A new heat source unit, which is equipped with an oil separator and extraneous trapping means and employs a new refrigerant, is provided to an existing refrigeration system. An existing heat source unit is replaced with the new heat source unit, and the existing refrigerant is also replaced with new refrigerant.

Next will be described methods of controlling the cleaning operation of the refrigeration system of the second embodiment after replacement of a refrigerant.

In controlling the cleaning operation of the refrigeration system, the heat source unit AA of the refrigerant circuit (i.e., the refrigeration system) which use a CFC or HCFC (i.e., an old refrigerant) are replaced with a new heat source unit AA which use an HFC (i.e., a new refrigerant). Depending on the situation, the indoor unit BB may also replaced.

After having been additionally recharged, the refrigeration system performs a cleaning operation as follows.

(1) First Control Method

The refrigeration system first performs a cooling operation in a manner as described above as a step A of a cleaning operation procedure.

(2) Second Control Method

The refrigeration system first performs a heating operation in a manner as described above as a step B of a cleaning operation procedure.

(3) Third Control Method

The refrigeration system performs a cleaning operation in the sequence given from the cooling operation as a step A to the heating operation as a step B of the cleaning operation procedure.

(4) Fourth Control Method

An operating capacity of the refrigeration system for a cleaning operation is controlled according to the inner diameters of the first and second connecting pipes CC and DD which are objects of cleaning. Further, the mass velocity of the refrigerant flowing through the first and second connecting pipes CC and DD currently being cleaned is set to be greater than a predetermined value or to fall within a certain range. This applies to step A and step B.

The features and effects of the above control methods are same or similar with those as described in the first embodiment, so that the duplicated descriptions are omitted here.

Third Embodiment

Figure 10:
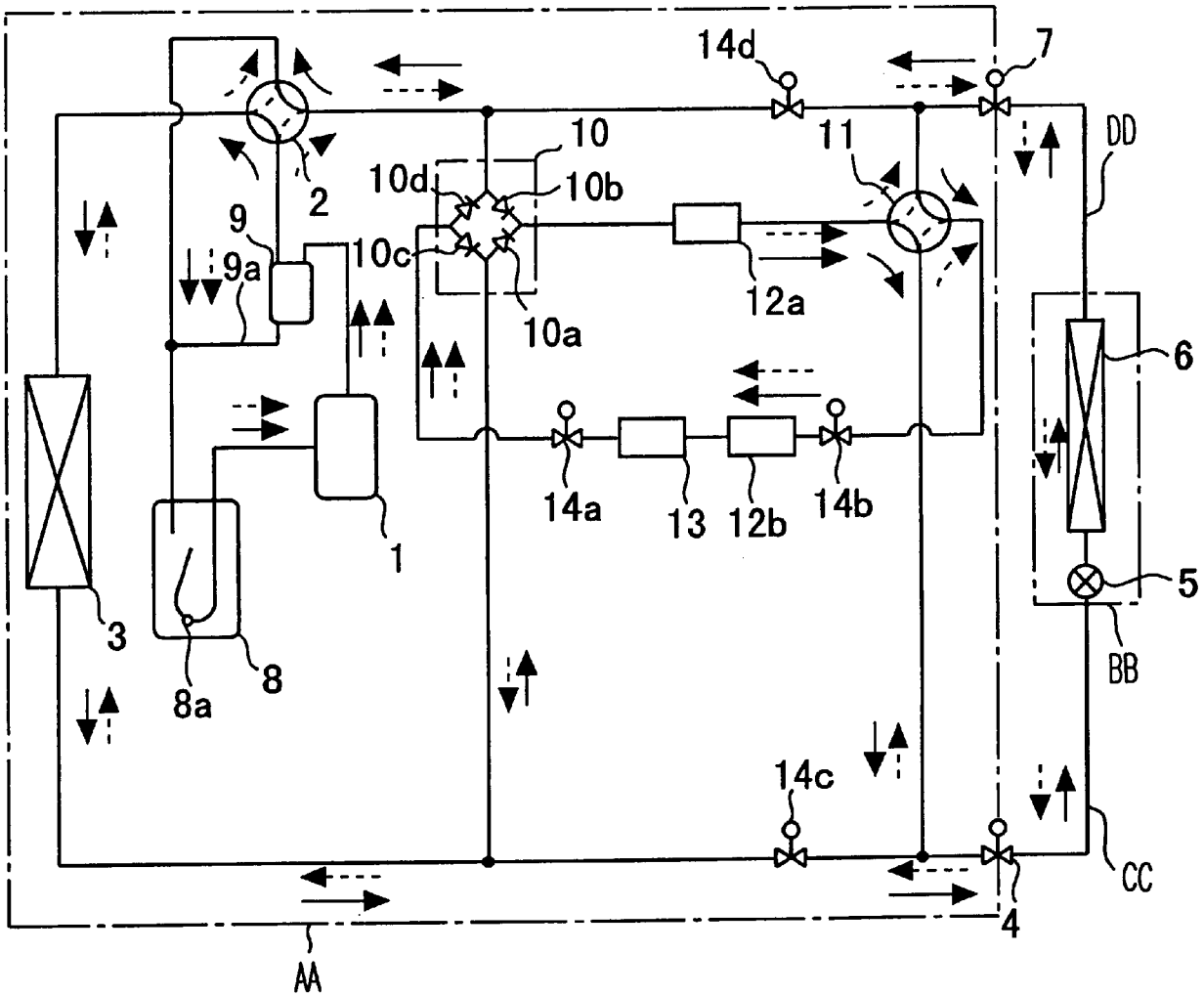
FIG. 10 is a schematic diagram showing a refrigerant circuit of a refrigeration system, as an example refrigeration system according to a third embodiment of the present invention.

FIG. 10 is a schematic diagram showing a refrigerant circuit of a refrigeration system, as an example refrigeration system according to a third embodiment of the present invention. In FIG. 10, reference symbols BB to DD, reference numerals 1 through 9, and reference numerals 8*a* and 9*a* are the same as those employed in the first embodiment, and hence repetition of their detailed explanations is omitted here.

Reference numeral 12*a* designates cooling means (a cooling device) for cooling and liquefying a hot, high-pressure gaseous refrigerant; 12*b* designates heating means (a heating device) for evaporating a low-pressure two-phase refrigerant; 13 designates extraneous-matter trapping means (an extraneous-matter trapping device) provided at the exit of the heating means 12*b*; 14*a* designates a first electromagnetic valve disposed at the exit of the extraneous-matter trapping means 13; and 14*b* designates a second electromagnetic valve disposed at the entrance of the heating means 12*b*.

Reference numeral 10 designates a first selector valve. According to an operation mode, the first selector valve 10 effects switching, in the following manner, between the four terminals; namely, the exit terminal of the heat-source-unit-side heat exchanger 3 used during the cooling operation of the refrigeration system, the exit terminal of the four-way valve 2 used during the heating operation of the refrigeration system, the entrance terminal of the cooling means 12*a*, and the exit terminal of the electromagnetic valve 14*a*. More specifically, during a cooling operation of the refrigeration system, the exit terminal of the heat-source-unit-side heat exchanger 3 used during the cooling operation is connected to the entrance terminal of the cooling means 12*a*, and the exit terminal of the electromagnetic valve 14*a* is connected to the entrance terminal of the four-way valve 2 used during the cooling operation (the exit terminal of the four-way valve 2 used during the cooling operation).

During the heating and cleaning operation of the refrigeration system, the exit terminal of the four-way valve 2 used during the heating operation is connected to the entrance terminal of the cooling means 12*a*, and the exit terminal of the electromagnetic valve 14*a* is connected to the entrance terminal of the heat-source-unit-side heat exchanger 3 used during the heating operation (the exit terminal of the heat-source-unit-side heat exchanger 3 during the cooling operation).

Reference numeral 11 designates a second selector valve. During the cooling and cleaning operation or the normal cooling operation of the refrigeration system, the second selector valve 11 connects the exit terminal of the cooling means 12*a* to the first control valve 4. During the heating and cleaning operation or normal heating operation of the refrigeration system, the second selector valve 11 connects the exit terminal of the cooling means 12*a* to the second control valve 7. During the cooling and cleaning operation of the refrigeration system, the second selector valve 11 connects the entrance terminal of the electromagnetic valve 14*b* to the second control valve 7. During the heating and cleaning operation of the refrigeration system, the second selector valve 11 connects the entrance terminal of the electromagnetic valve 14*b* to the first control valve 4.

Reference numeral 14*c* designates a third electromagnetic valve provided at any position in a pipe connecting a junction, which is between the first selector valve 10 and the heat-source-unit-side heat exchanger 3, to a junction which is between the second selector valve 11 and the first control valve 4. Reference numeral 14*d* designate a fourth electromagnetic valve provided at any position in a pipe connecting a junction, which is between the first selector valve 10 and the four-way valve 2, and a junction which is between the second selector valve 11 and the second control valve 7.

The first selector valve 10 consists of four check valves 10*a*to 10*d*. The check valve 10*a* is provided so as to enable flow of a refrigerant from the exit terminal of the heat-source-unit-side heat exchanger 3 used at the time of a cooling operation to the entrance terminal of the cooling means 12*a* and not to allow reverse flow of the refrigerant. The check valve 10*b* is provided so as to enable flow of a refrigerant from the exit terminal of the four-way valve 2 used at the time of a heating operation to the entrance terminal of the cooling means 12*a* and not to allow reverse flow of the refrigerant. The check valve 10*c* is provided so as to enable flow of a refrigerant from the exit terminal of the first electromagnetic valve 14*a* to the exit terminal of the heat-source-unit-side heat exchanger 3 used at the time of a cooling operation and not to allow reverse flow of the refrigerant. The check valve 10*d* is provided so as to allow flow of a refrigerant from the exit terminal of the first electromagnetic valve 14*a* to the exit terminal of the four-way valve 2 used at the time of a heating operation and not to allow reverse flow of the refrigerant. These check valves 10*a* to 10*d* can switch by themselves without use of an electrical signal, by means of the pressure applied to the respective connection terminals.

The cooling source of the cooling means 12*a* may be either water or air, and the heating source of the heating means 12*b* may be any one of air, water, and a heater. Alternatively, the cooling means 12*a* and the heating means 12*b* may be embodied in the form of a single unit by means of transferring heat between the heating means 12*a* and the cooling means 12*b*. For example, a hot, high-temperature pipe and a cold, low-pressure pipe which run between the first selector valve 10 and the second selector valve 12 may be brought into thermal contact with each other. Specifically, the single unit may be formed from a set of concentric pipes, wherein the outer tube is formed from a hot, high-temperature pipe and the inner tube is formed from a cold, low-temperature pipe.

By means of the foregoing configuration, the heat source unit AA incorporates the oil separator 9, a separated oil bypass channel 9*a*, the cooling means 12*a*, the heating means 12*b*, the extraneous-matter trapping means 13, the first selector valve 10, the second selector valve 11, the first electromagnetic valve 14*a*, the second electromagnetic valve 14*b*, the third electromagnetic valve 14*c*, and the fourth electromagnetic valve 14*d*.

A refrigerant circuit portion including both the heating means 12*b* and the extraneous-matter trapping means 13 is herein taken as a first bypass channel. Another refrigerant circuit portion including the cooling means 12*a* is herein taken as a second bypass channel.

The refrigeration system employs an HFC (a new refrigerant) as a refrigerant.

Next will be described procedures for replacing a deteriorated refrigeration system using a CFC or HCFC (an old refrigerant) with a refrigeration system using a new refrigerant.

CFC or HCFC is recovered from the existing refrigeration system, and the heat source unit AA and the indoor unit BB are replaced with a new heat source unit AA and a new indoor unit BB using HFC as shown in FIG. 10. The first connecting pipe CC and the second connecting pipe DD used for the HCFC-using refrigeration system are reused, thus constituting the refrigerant circuit as shown in FIG. 10.

Since the new heat source unit AA has been charged with HFC in advance, the refrigeration system is evacuated while the first control valve 4 and the second control valve 7 remain closed and while the new indoor unit BB, the first connecting pipe CC, and the second connecting pipe DD are connected to the refrigeration system. Subsequently, the first control valve 4 and the second control valve 7 are opened, and the refrigeration system is additionally charged with HFC. Thereafter, the refrigeration system performs a cleaning operation and then performs an ordinary air-conditioning operation.

Details of the cleaning operation will now be described by reference to FIG. 10. Solid arrows in the drawing depict the flow of a refrigerant during a cooling operation of the refrigeration system, and broken arrows depict the flow of a refrigerant during a heating operation.

First will be described the flow of a refrigerant during a cooling operation. A refrigerant is compressed by the compressor 1 so as to become a hot, high-pressure gas; is discharged from the compressor 1 together with the HFC refrigeration oil; and enters the oil separator 9, where the HFC refrigeration oil is completely separated from the gaseous refrigerant. Only the gaseous refrigerant flows, via the four-way valve 2, into the heat-source-unit-side heat exchanger 3, where the gaseous refrigerant exchanges heat with a heat source medium, such as water or air, and is condensed to a certain extent.

The refrigerant, which has been condensed to a certain extent, flows, via the first selector valve 10, into the cooling means 12*a*, where the refrigerant is completely condensed. The thus-condensed refrigerant flows into the first connecting pipe CC via the second selector valve 11 and the first control valve 4.

While the liquid HFC refrigerant flows through the first connecting pipe CC, CFC, HCFC, a mineral oil, or a deteriorated mineral oil (hereinafter referred to as "residual extraneous matter") remaining in the first connecting pipe CC is cleaned little by little. The thus-cleared residual extraneous matter flows into the flow rate regulator 5 together with the liquid HFC refrigerant. In the flow rate regulator 5, the liquid HFC refrigerant is decompressed to a low pressure and assumes a low-pressure, two-phase state. The refrigerant then exchanges heat with a user-side medium, such as air, in the user-side heat exchanger 6 and is evaporated to a certain extent.

The refrigerant, which has been evaporated to a certain extent, flows into the second connecting pipe DD together with the residual extraneous matter exfoliated from the first connecting pipe CC. Since the refrigerant flowing through the second connecting pipe DD is in a gas-liquid two-phase state, the liquid refrigerant flows at high speed and the extraneous matter remaining in the second connecting pipe DD is cleaned with the liquid refrigerant. The residual extraneous matter is cleaned at a speed higher than that at which the extraneous matter is cleaned from the first connecting pipe CC.

Subsequently, the refrigerant, which has been evaporated to a certain extent and is in a gas-liquid two-phase state, flows into the heating means 12*b* together with the residual extraneous matter removed from the first connecting pipe CC and that removed from the second connecting pipe DD, via the second control valve 7, the second selector valve 11, and the second electromagnetic valve 14*b*. In the heating means 12*b*, the refrigerant is completely evaporated, and the thus-evaporated refrigerant flows into the extraneous-matter trapping means 13. According to boiling point, the different types of residual extraneous matter differ in phase from each other and can be classified into three phases: i.e., solid extraneous matter, liquid extraneous matter, and gaseous extraneous matter. The extraneous-matter trapping means 13 completely separates solid extraneous matter and liquid extraneous matter from the gaseous refrigerant, thus trapping the thus-separated extraneous matter.

Some of gaseous extraneous matter is trapped by the extraneous-matter trapping means 13, but some of the same escapes. The gaseous refrigerant returns to the compressor 1 along with the gaseous extraneous matter which has escaped the extraneous-matter trapping means 13, via the first electromagnetic valve 14*a*, the first selector valve 10, the four-way valve 2, and the accumulator 8.

The HFC refrigeration oil, which has been completely separated from the gaseous refrigerant by the oil separator 9, merges with the principal stream of HFC refrigeration oil at a downstream position relative to the extraneous-matter trapping means 13, via the bypass channel 9*a*. The thus-merged flow of HFC refrigeration oil returns to the compressor 1. Thus, the HFC refrigeration oil is prevented from being mixed with the mineral oil remaining in the first and second connecting pipes CC and DD and is prevented from being incompatible with HFC. Further, there can be prevented deterioration of the HFC refrigeration oil, which would otherwise be caused by mixing with a mineral oil.

Further, the solid extraneous matter does not mix with the HFC refrigeration oil, thus preventing deterioration of the HFC refrigeration oil. During a single circulation of the HFC refrigerant through the refrigerant circuit and through the extraneous-matter trapping means 13, only some of the gaseous extraneous matter is trapped. The gaseous extraneous matter is mixed with the HFC refrigeration oil. However, deterioration in the HFC refrigeration oil is attributable to chemical reaction and does not proceed abruptly.

FIG. 2 shows an example of deterioration of the HFC refrigeration oil. The gaseous extraneous matter which has not been trapped during the single flow of the gaseous refrigerant through the extraneous-matter trapping means 13 passes through the extraneous-matter trapping means 13 again and again, along with circulation of the HFC refrigerant. Hence, the only requirement is that the gaseous matter be trapped by the extraneous-matter trapping means 13 faster than the rate at which the HFC refrigeration oil is deteriorated.

Next will be described the flow of a refrigerant during a heating operation of the refrigeration system. A gaseous refrigerant is compressed by the compressor 1 so as to become a hot, high-pressure gas; is discharged from the compressor 1 together with an HFC refrigeration oil; and enters the oil separator 9, where the HFC refrigeration oil is completely separated from the gaseous refrigerant. Only the gaseous refrigerant flows into the cooling means 12*a*, via the four-way valve 2 and the first selector valve 10.

The gaseous refrigerant is cooled and is condensed to a certain extent. The refrigerant, which has been evaporated to a certain extent, flows into the second connecting pipe DD via the second selector valve 11 and the second control valve 7. Since the refrigerant flowing through the second connecting pipe DD is in a gas-liquid two-phase state, the liquid refrigerant flows at high speed and the extraneous matter remaining in the second connecting pipe DD is cleaned with the liquid refrigerant. The residual extraneous matter is cleaned from the second connecting pipe DD at a speed higher than that at which the extraneous matter is cleaned from the first connecting pipe CC.

Subsequently, the gaseous refrigerant, which has been condensed to a certain extent, flows, together with the residual extraneous matter removed from the second connecting pipe DD, into the user-side heat exchanger 6, where the gaseous refrigerant exchanges heat with a heat source medium, such as air, and is completely condensed.

The thus-condensed refrigerant flows to the flow rate regulator 5, where the refrigerant is decompressed to assume a low-pressure, two-phase state. The gaseous refrigerant then flows into the first connecting pipe CC. Since the gaseous refrigerant is in a gas-liquid two-phase state and flows at high speed, the gaseous refrigerant cleans the extraneous matter remaining in the first connecting pipe CC together with the liquid refrigerant at a speed faster than that achieved during a cooling operation. The refrigerant in the gas-liquid two-phase state flows, together with the residual extraneous matter removed from the second connecting pipe DD and the first connecting pipe CC, into the heating means 12*b*, via the first control valve 4, the second selector valve 11, and the second electromagnetic valve 14*b*. In the heating means 12*b*, the refrigerant is heated to evaporate, and the thus-evaporated refrigerant flows into the extraneous-matter trapping means 13.

According to boiling point, the different types of residual extraneous matter differ in phase from each other and can be classified into three phases: i.e., solid extraneous matter, liquid extraneous matter, and gaseous extraneous matter. The extraneous-matter trapping means 13 completely separates solid extraneous matter and liquid extraneous matter from the gaseous refrigerant, thus trapping the thus-separated extraneous matter. Some of the gaseous extraneous matter is trapped by the extraneous-matter trapping means 13, but some of the same escapes.

The gaseous refrigerant returns to the compressor 1 via the accumulator 8 along with the gaseous extraneous matter which has escaped the extraneous-matter trapping means 13. The gaseous refrigerant flows into the heat-source-unit-side heat exchanger 3 together with the gaseous extraneous matter which has not been trapped by the extraneous-matter trapping means 13, via the four-way valve 2 and the first selector valve 10. In the heat-source-unit-side heat exchanger 3, a blower is stopped so as to cause the gaseous refrigerant to pass through without involvement of heat exchange, whereby the gaseous refrigerant returns to the compressor 1 via the accumulator 8.

The HFC refrigeration oil, which has been completely separated from the gaseous refrigerant by the oil separator 9, merges with the principal stream of HFC refrigeration oil at a downstream position relative to the extraneous-matter trapping means 13, via the bypass channel 9*a*. The thus-merged flow of HFC refrigeration oil returns to the compressor 1. Thus, the HFC refrigeration oil is prevented from being mixed with the mineral oil remaining on the first and second connecting pipes CC and DD and is prevented from being incompatible with HFC. Further, there can be prevented deterioration of the HFC refrigeration oil, which would otherwise be caused by mixing with a mineral oil.

Further, the solid extraneous matter does not mix with the HFC refrigeration oil, thus preventing deterioration of the HFC refrigeration oil.

During a single circulation of the HFC refrigerant through the refrigerant circuit and through the extraneous-matter trapping means 13, only some of the gaseous extraneous matter is trapped. The gaseous extraneous matter is mixed with the HFC refrigeration oil. However, deterioration in the HFC refrigeration oil is attributable to chemical reaction and does not proceed abruptly. FIG. 2 shows an example of deterioration of the HFC refrigeration oil.

The gaseous extraneous matter, which has not been trapped during the single passage of the gaseous refrigerant through the extraneous-matter trapping means 13, passes through the extraneous-matter trapping means 13 again and again, along with circulation of the HFC refrigerant. Hence, the only requirement is that the gaseous matter be trapped by the extraneous-matter trapping means 13 faster than the rate at which the HFC refrigeration oil is deteriorated.

Since the extraneous-matter trapping means 13 and the oil separator 9 are completely the same as those employed in the first embodiment, their explanations are omitted here for brevity.

Figure 11:
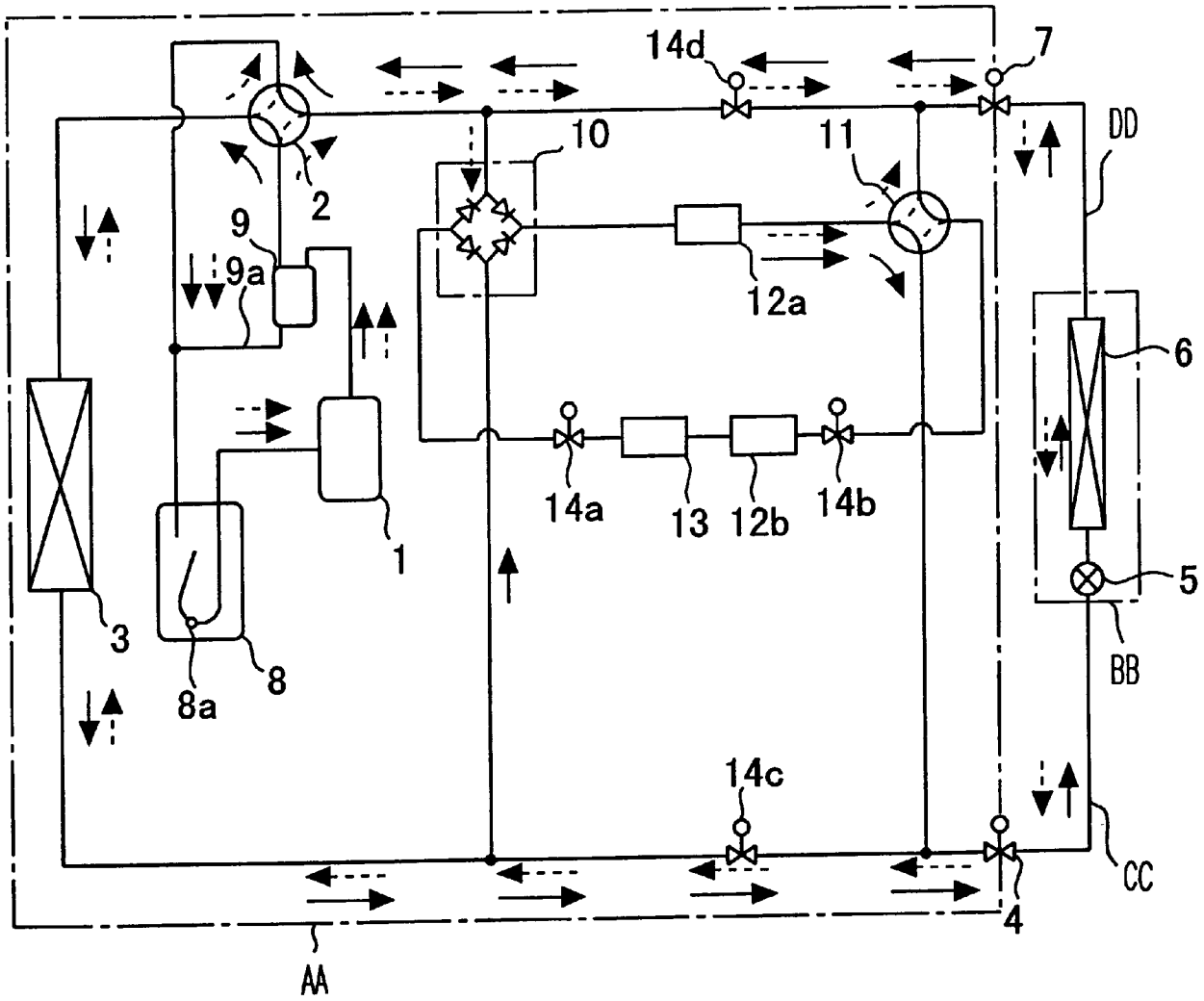
FIG. 11 is a schematic diagram showing an ordinary cooling operation of the refrigeration system of the third embodiment.

The ordinary air-conditioning and cleaning operation will now be described by reference to FIG. 11. Solid arrows in the drawing depict the flow of a refrigerant during a cooling operation of the refrigeration system, and broken arrows depict the flow of a refrigerant during a heating operation.

First will be described the flow of a refrigerant during a normal cooling operation. A refrigerant is compressed by the compressor 1 so as to become a hot, high-pressure gas; is discharged from the compressor 1 together with an HFC refrigeration oil; and enters the oil separator 9, where the HFC refrigeration oil is completely separated from the gaseous refrigerant. Only the gaseous refrigerant flows, via the four-way valve 2, into the heat-source-unit-side heat exchanger 3, where the gaseous refrigerant exchanges heat with a heat source medium, such as water or air, and is condensed to a certain extent.

The majority of the thus-condensed refrigerant flows to the third electromagnetic valve 14*c*, and some of the refrigerant flows in the sequence given from the first selector valve 10, the cooling means 12*a*, and the second selector valve 11. These two streams of the refrigerant merge into a single stream, and the single stream of the refrigerant flows into the first control valve 4. The refrigerant further flows, via the first connecting pipe CC, into the flow rate control valve 5, where the refrigerant is decompressed to assume a low-pressure, two-phase state. In the user-side heat exchanger 6, the refrigerant exchanges heat with a user-side medium, such as air, and is evaporated. The thus-evaporated refrigerant returns to the compressor 1, via the second connecting pipe DD, the second control valve 7, the fourth electromagnetic valve 14*d*, the four-way valve 2, and the accumulator 8.

The HFC refrigeration oil, which has been completely separated from the gaseous refrigerant by the oil separator 9, merges with the principal stream of HFC refrigerant at a downstream position relative to the extraneous-matter trapping means 13, via the bypass channel 9*a*. The thus-merged flow of the HFC refrigerant and the HFC refrigeration oil returns to the compressor 1.

Since the first electromagnetic valve 14*a* and the second electromagnetic valve 14*b* are closed, the extraneous-matter trapping means 13 is isolated and is brought into a closed state. Therefore, the extraneous matter trapped during the cleaning operation of the refrigeration system cannot again return to the circuit in operation. In contrast with the case of the first embodiment, the refrigerant does not pass through the extraneous-matter trapping means 13, and hence the inlet pressure of the compressor 1 is susceptible to only a small loss, which in turn induces little deterioration in the capability of the compressor 1.

Next will be described the flow of a refrigerant during a normal heating operation. A refrigerant is compressed by the compressor 1 so as to become a hot, high-pressure gas; is discharged from the compressor 1 together with an HFC refrigeration oil; and enters the oil separator 9, where the HFC refrigeration oil is completely separated from the gaseous refrigerant. The majority of refrigerant flows to the fourth electromagnetic valve 14*d*, via the four-way valve 2. Some of the refrigerant flows in the sequence given from the first selector valve 10, the cooling means 12*a*, and the second selector valve 11. These two streams of the refrigerant merge into a single stream, and the single stream of refrigerant flows into the second control valve 7. The refrigerant flows further, via the second connecting pipe DD, into the user-side heat exchanger 6, where the refrigerant exchanges heat with a user-side medium, such as air, and is completely condensed.

The thus-condensed refrigerant flows into the flow rate controller 5, where the refrigerant is decompressed to assume a low-pressure, two-phase state. The thus-decompressed refrigerant flows into the heat-source-unit-side heat exchanger 3, via the first connecting pipe CC, the first control valve 4, and the third electromagnetic valve 14*c*. In heat-source-unit-side heat exchanger 3, the refrigerant exchanges heat with a heat-source-unit-side medium, such as air or water, and is evaporated. The thus-evaporated refrigerant returns to the compressor 1 via the accumulator 8.

The HFC refrigeration oil, which has been completely separated from the gaseous refrigerant by the oil separator 9, returns to the compressor 1, via the bypass channel 9*a*.

Since the first electromagnetic valve 14*a* and the second electromagnetic valve 14*b* are closed, the extraneous-matter trapping means 13 is isolated and is brought into a closed state. Therefore, the extraneous matters trapped during the cleaning operation of the refrigeration system cannot again return to the circuit in operation. In contrast with the case of the first embodiment, the refrigerant does not pass through the extraneous-matter trapping means 13, and hence the inlet pressure of the compressor 1 is susceptible to only a small loss, which in turn induces little deterioration in the capability of the compressor 1.

As mentioned above, the oil separator 9 and the extraneous-matter trapping means 13 are incorporated into the heat source unit AA. Accordingly, a deteriorated CFC/HCFC-using refrigeration system can be replaced with a new HFC-using refrigeration system without replacement of the first connecting pipe CC and the second connecting pipe DD, by means of replacing only the heat source unit AA and the indoor unit BB with new ones. In contrast with the conventional first cleaning method, the existing pipe reuse method of the present invention eliminates a necessity of cleaning the refrigeration system with a specifically-designed cleaning solvent (HCFC 141b or HCFC 225) through use of cleaning equipment. Therefore, the method completely eliminates the possibility of depletion of the ozone layer, the use of a flammable and toxic substance, a fear of a residual cleaning solvent, and a necessity for recovery of a cleaning solvent.

In contrast with the conventional second cleaning method, the method of the present invention eliminates a necessity of operating the refrigeration system three times repeatedly for cleaning, as well as a necessity of replacing an HFC refrigerant and HFC refrigerator oil with new refrigerant and oil three times. The method of the present invention involves use of only the amount of HFC refrigerant and HFC refrigerator oil required for one refrigeration system, thus yielding an advantage in terms of cost and environmental cleanliness. Further, the method completely eliminates a necessity of managing refrigeration oil for replacement purpose and the chance of excess or shortage of the refrigeration oil. Further, there is no chance of the HFC refrigerator oil being incompatible with the HFC refrigerant or being deteriorated.

Since the refrigeration system is provided with the first electromagnetic valve 14*a*, the second electromagnetic valve 14*b*, the third electromagnetic valve 14*c*, and the fourth electromagnetic valve 14*d*, a cleaning effect such as that described above is achieved at the time of a cleaning operation, by causing the refrigerant to flow through the extraneous-matter trapping means 13. At the time of an ordinary operation subsequent to the cleaning operation, the first and second electromagnetic valves 14*a* and 14*b* are closed, so that the extraneous-matter trapping means 13 is isolated and is brought into a closed state. Therefore, the extraneous matter trapped during the cleaning operation of the refrigeration system cannot again return to the circuit in operation. In contrast with the case of the first embodiment, the refrigerant does not pass through the extraneous-matter trapping means 13, and hence the inlet pressure of the compressor 1 is susceptible to only a small loss, which in turn induces little deterioration in the capability of the compressor 1.

Since the refrigeration system is provided with the cooling means 12*a*, the heating means 12*b*, the first selector valve 10, and the second selector valve 11, a liquid refrigerant or a refrigerant of gas-liquid two-phase flows into the first and second connecting pipes CC and DD during a cleaning operation, regardless of whether the refrigeration system performs a cooling operation or a heating operation. A strong cleaning effect is achieved during the cleaning of residual extraneous matter, and cleaning time can be shortened.

Further, the cooling means 12*a* and the heating means 12*b* can control the amount of heat to be exchanged, and hence, regardless of the ambient temperature and the refrigeration load, the refrigeration system can perform substantially the same cleaning operation under arbitrary conditions, thereby rendering a resultant effect and required efforts stable.

The previous embodiment has described the method of replacing the heat source unit AA and the indoor unit BB with new ones. However, the present invention also enables replacement of only the heat source unit AA with a new one without involvement of replacement of the first connecting pipe CC, the indoor unit BB, and the second connecting pipe DD.

Further, the previous embodiment described an example in which one indoor unit BB is connected to the refrigeration system. Needless to say, the present invention yields the same advantage as that yielded in the embodiment even when applied to a refrigeration system comprising a plurality of indoor units BB connected in series or parallel.

As is obvious, the same advantage is yielded even when a thermal storage ice bath or a thermal storage water bath (including hot water) is connected in parallel or series with the heat-source-unit-side heat exchanger 3.

The same advantage as that yielded by the previous embodiment is not limited to the refrigeration unit; the same advantage as in the previously-described embodiment is yielded so long as a thermo-compression refrigeration application comprises a unit incorporating a heat-source-unit-side heat exchanger and another unit incorporating a user-side heat exchanger, the units being remotely spaced away from each other.

The configuration of the refrigeration system of the third embodiment can be summarized as follows:

The refrigeration system comprises the first refrigerant circuit for circulating a refrigerant from and to the compressor via the heat-source-unit-side heat exchanger, the flow rate controller, the user-side heat exchanger, and the accumulator, in the sequence given. Further, the refrigeration system comprises the second refrigerant circuit for circulating a refrigerant from and to the compressor via the user-side heat exchanger, the flow rate controller, the heat-source-unit-side heat exchanger, and the accumulator, in the sequence given.

The refrigeration system of the present embodiment comprises a first bypass channel for interconnecting the user-side heat exchanger and the accumulator of the first refrigerant circuit and for interconnecting the flow rate controller and the heat-source-unit-side heat exchanger of the second refrigerant circuit; and extraneous-matter trapping means for trapping extraneous matter contained in the refrigerant.

The refrigeration system of the present embodiment comprises a second bypass channel for interconnecting the heat-source-unit-side heat exchanger and the flow rate controller of the first refrigerant circuit and interconnecting the compressor and the user-side heat exchanger of the second refrigerant circuit; and refrigerant cooling means for cooling the refrigerant.

The refrigeration system further comprises the refrigerant cooling means disposed upstream of the extraneous-matter trapping means of the first bypass channel.

Oil separation means for separating an oil component from the refrigerant is interposed between the compressor and the heat-source-unit-side heat exchanger of the first refrigerant circuit and between the compressor and the user-side heat exchanger of the second refrigerant circuit.

A new heat-source unit, which is equipped with an oil separator and extraneous trapping means and employs a new refrigerant, is provided to an existing refrigeration system. An existing heat-source unit is replaced with a new heat-source unit, and an existing refrigerant is also replaced with a new refrigerant.

Next will be described methods of controlling the cleaning operation of the refrigeration system of the second embodiment after replacement of a refrigerant.

In controlling the cleaning operation of the refrigeration system, the heat source unit AA of the refrigerant circuit (i.e., the refrigeration system) which use a CFC or HCFC (i.e., an old refrigerant) is replaced with a new heat source unit AA which use an HFC (i.e., a new refrigerant). The indoor unit BB may also be replaced simultaneously. After having been additionally recharged, the refrigeration system performs a cleaning operation as follows.

(1) First Control Method

The refrigeration system first performs a cooling operation in a manner as described above as a step A of a cleaning operation procedure.

(2) Second Control Method

The refrigeration system first performs a heating operation in a manner as described above as a step B of a cleaning operation procedure.

(3) Third Control Method

The refrigeration system performs a cleaning operation in the sequence given from the cooling operation as a step A to the heating operation as a step B of the cleaning operation procedure.

(4) Fourth Control Method

An operating capacity of the refrigeration system for a cleaning operation is controlled according to the inner diameters of the first and second connecting pipes CC and DD which are objects of cleaning. Further, the mass velocity of the refrigerant flowing through the first and second connecting pipes CC and DD currently being cleaned is set to be greater than a predetermined value or to fall within a certain range. This applies to step A and step B.

The features and effects of the above control methods are same or similar with those as described in the first embodiment, so that the duplicated descriptions are omitted here.

Fourth Embodiment

Figure 12:
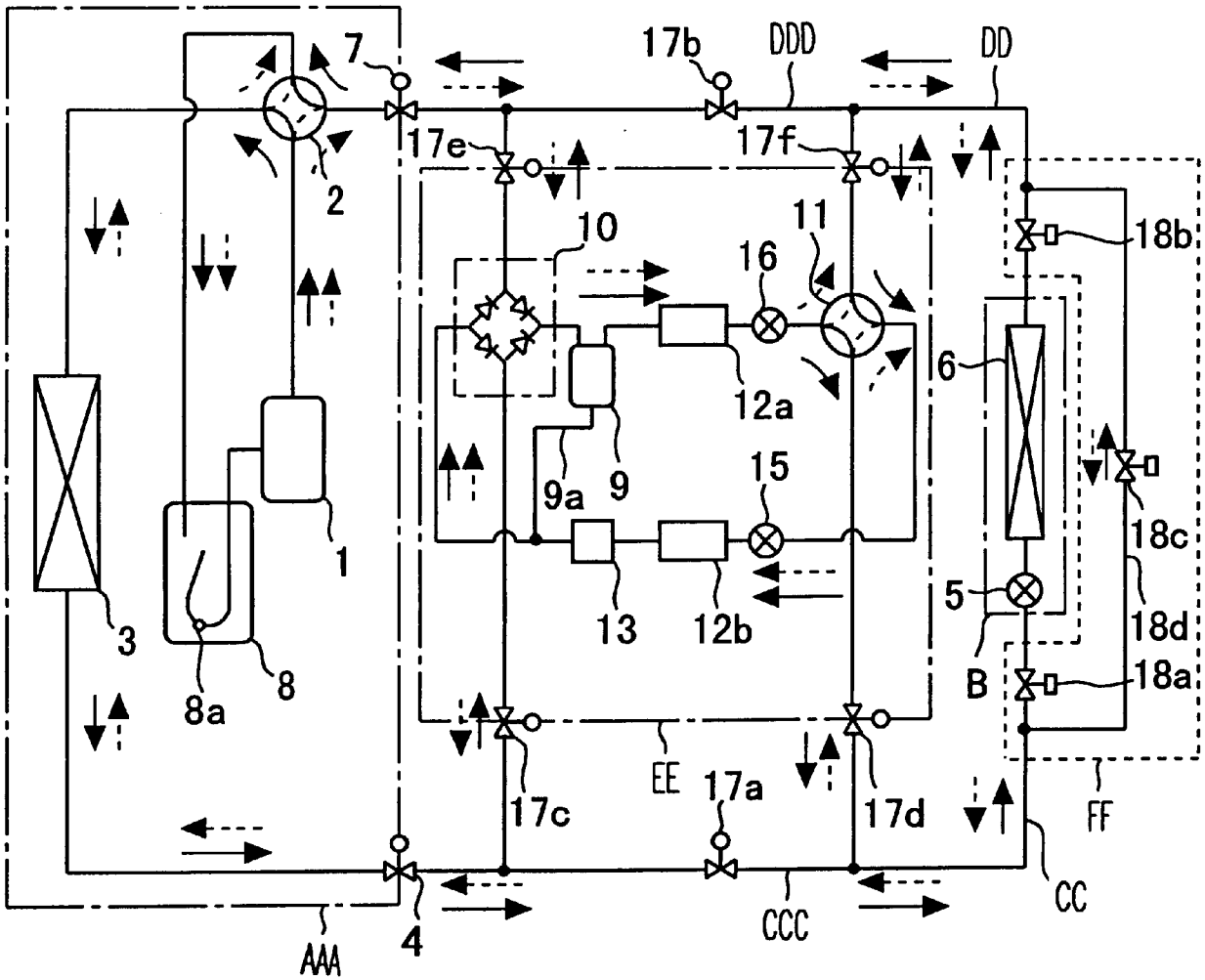
FIG. 12 is a schematic diagram showing a refrigerant circuit of a refrigeration system, as an example refrigeration system according to a fourth embodiment of the present invention.

FIG. 12 is a schematic diagram showing a refrigerant circuit of a refrigeration system, as an example refrigeration system according to a fourth embodiment of the present invention. In FIG. 12, reference symbols BB to DD, reference numerals 1 through 8, and reference numeral 8*a* are the same as those employed in the first and second embodiments, and hence repetition of their detailed explanations is omitted here. The elements designated by reference numerals 10, 11, 12*a*, 12*b*, and 13 are the same as those described in the third embodiment, and hence repetition of their detailed explanations is omitted here.

In FIG. 12, reference numeral 9 designates an oil separator which is the same as those described in the first and third embodiments. In contrast with the oil separators of the first and third embodiments, the oil separator 9 of the present embodiment is disposed between the first selector valve 10 and the cooling means 12*a*.

Reference numeral 9*a* designates a bypass channel which extends from the bottom of the oil separator 9 to a downstream position relative to the extraneous-matter trapping means 13 and is the same as those described in the first and third embodiments. In contrast with the bypass channels of the first and third embodiments, the bypass channel 9*a* of the present embodiment extends from the bottom of the oil separator 9 to a position between the extraneous-matter trapping means 13 and the first selector valve 10.

Reference numeral 15 designates first flow rate control means provided between the second selector valve 11 and the heating means 12*b*, and 16 designates second flow rate control provided between the cooling means 12*a* and the second selector valve 11.

Reference symbol CCC designates a third connecting pipe provided between the first connecting pipe CC and the first control valve 4, and DDD designates a fourth connecting pipe provided between the second connecting pipe DD and the second control valve 7.

Reference numeral 17*a* designates a third control valve provided in the third connecting pipe CCC; 17*b* designates a fourth control valve provided in the fourth connecting pipe DDD; 17*c* designates a fifth control valve provided between the first selector valve 10 and a pipe connecting the first control valve 4 located in the third connecting pipe CCC and the third control valve 17*a*; 17*d* designates a sixth control valve disposed across the terminal of the third control valve 17*a* connected to the third connecting pipe CCC and the second selector valve 11; 17*e* designates a seventh control valve disposed across the first selector valve 10 and a position in the fourth connecting pipe DDD which interconnects the second control valve 7 and the fourth control valve 17*b*; and 17*f* designates an eighth control valve disposed across the terminal of the fourth control valve 17*b* connected to the fourth connecting pipe DDD and the second selector valve 11.

Reference symbol EE designates a cleaning unit (washer) having the foregoing configuration and accommodates the oil separator 9, the bypass channel 9*a*, the cooling means 12*a*, the heating means 12*b*, extraneous-matter trapping means 13, the first selector valve 10, the second selector valve 11, the first flow rate control means 15, and the second flow rate control means 16. The cleaning unit EE is removably connected to an area defined by the fifth control valve 17*c* to the eighth control valve 17*f* of the refrigeration system.

The refrigerant circuit portion comprising the heating means 12*b*and the extraneous-matter trapping means 13 is taken as a first bypass channel, as described in connection with the third embodiment. The refrigerant circuit portion including the cooling means 12*a* is taken as a second bypass channel, regardless of presence or absence of the oil separator 9. On the assumption that the refrigeration system does not include the cooling means 12*a* and includes only the oil separator 9, the refrigerant circuit portion including only the oil separator 9 is taken as a third bypass channel.

Reference numeral 18*a* designates a fifth electromagnetic valve disposed between the first connecting pipe CC and the flow rate regulator 5; 18*b* designates a sixth electromagnetic valve disposed between the second connecting pipe DD and the user-side heat exchanger 6; and 18*c* designates a seventh electromagnetic valve across the terminal of the fifth electromagnetic valve 18*a* connected to the first connecting pipe CC and the terminal of the electromagnetic valve 18*b* connected to the second connecting pipe DD. Reference symbol FF designates an indoor bypass unit incorporating the fifth electromagnetic valve 18*a* through the seventh electromagnetic valve 18*c*. The refrigeration system employs an HFC (a new refrigerant) as a refrigerant.

Next will be described procedures for replacing a deteriorated refrigeration system using a CFC or HCFC (old refrigerant) with a new refrigeration system using an HFC. The CFC or HCFC is recovered from the existing refrigeration system, and the heat source unit AA and the indoor unit BB are replaced with a new heat source unit AA and a new indoor unit BB using HFC as shown in FIG. 12. The first connecting pipe CC and the second connecting pipe DD used for the HCFC-using refrigeration system are reused. The third connecting pipe CCC and the fourth connecting pipe DDD are newly laid, and the cleaning unit EE (washer) is connected to the third connecting pipe CCC via the fifth control valve 17*c* and the sixth control valve 17*d*. Further, the cleaning unit EE is connected to the fourth connecting pipe DDD by way of the seventh control valve 17*e* and the eighth control valve 17*f*. The first connecting pipe CC and the second connecting pipe DD are connected to the indoor unit BB by way of the indoor bypass unit FF, thereby constituting the refrigerant circuit shown in FIG. 12.

Since the heat source unit AA has been charged with an HFC in advance, the refrigeration system is evacuated while the first control valve 4 and the second control valve 7 remain closed and while the indoor unit BB, the first connecting pipe CC, the second connecting pipe DD, the third connecting pipe CC, the fourth connecting pipe DD, the cleaning unit EE, and the indoor bypass unit FF are connected to the refrigeration system. Subsequently, the first control valve 4 and the second control valve 7 are opened, and the refrigeration system is additionally charged with an HFC.

Subsequently, the third and fourth control valves 17*a* and 17*b* are closed, and the fourth through eighth control valves 17*c* to 17*f* are opened. The fifth and sixth electromagnetic valves 18*a* and 18*b* are closed, and the seventh electromagnetic valve 18*c* is opened, whereby the refrigeration system performs a cleaning operation. Subsequently, the third and fourth control valves 17*a* and 17*b* are opened, and the fourth through eighth control valves 17*c* to 17*f* are closed. The fifth and sixth electromagnetic valves 18*a* and 18*b* are opened, and the seventh electromagnetic valve 18*c* is closed, whereby the refrigeration system performs an ordinary air-conditioning operation.

The cleaning operation will now be described by reference to FIG. 12. In the drawing, solid arrows depict the flow of a refrigerant during a cooling operation of the refrigeration system, and broken arrows depict the flow of a refrigerant during a heating operation.

First will be described the flow of a refrigerant during a cooling operation. The refrigerant is compressed by the compressor 1 to become a hot, high-temperature gas; is discharged from the compressor 1 together with an HFC refrigeration oil; and enters the heat-source-unit-side heat exchanger 3. The gaseous refrigerant passes through the heat-source-unit-side heat exchanger 3 without exchanging heat with a heat source medium, such as air or water; and enters the oil separator 9 via the first control valve 4, the fifth control valve 17*c*, and the first selector valve 10.

In the oil separator 9, the HFC refrigeration oil is completely separated from the gaseous refrigerant, and only the gaseous refrigerant flows into the cooling means 12*a*, where the gaseous refrigerant is condensed. The thus-condensed refrigerant flows to the second flow rate control means 16, where the gaseous refrigerant is slightly decompressed to assume a low-pressure two-phase state. The refrigerant of gas-liquid two-phase state flows into the first connecting pipe CC via the second selector valve 11 and the sixth control valve 17*d*.

While the HFC refrigerant of gas-liquid two-phase state flows through the first connecting pipe CC, a CFC, an HCFC, a mineral oil, or a deteriorated mineral oil (hereinafter referred to as "residual extraneous matter") remaining in the first connecting pipe CC is cleaned comparatively fast, since the HFC refrigerant is in a gas-liquid two-phase state. The thus-cleared residual extraneous matter removed from the first connecting pipe CC flows into the second connecting pipe DD together with the HFC refrigerant of gas-liquid two-phase state, via the seventh electromagnetic valve 18*c*.

During the course of the HFC refrigerant of gas-liquid two-phase state flowing through the first connecting pipe CC, a CFC, an HCFC, a mineral oil, or a deteriorated mineral oil (hereinafter referred to as "residual extraneous matter") remaining in the first connecting pipe CC is cleaned comparatively fast, since the HFC refrigerant is in a gas-liquid two-phase state. The thus-cleared residual extraneous matter removed from the first connecting pipe CC flows into the second connecting pipe DD together with the HFC refrigerant of gas-liquid two-phase state, via the seventh electromagnetic valve 18*c*.

Since the refrigerant flowing through the second connecting pipe DD is in a gas-liquid two-phase state and flows fast, the residual extraneous matter remaining in the second connecting pipe DD is cleaned at comparatively fast speed together with the liquid refrigerant. Subsequently, the refrigerant of gas-liquid two-phase state flows to the first flow rate control means 15 together with the residual extraneous matter removed from the first and second connecting pipes CC and DD, via the eighth control valve 17*f* and the second selector valve 11. The refrigerant is decompressed in the first flow rate control means 15, and the thus-decompressed refrigerant flows into the heating means 12*b*, where the refrigerant is evaporated. The thus-evaporated refrigerant flows into the extraneous-matter trapping means 13.

According to boiling point, the components of the residual extraneous matter differ in phase from each other and can be classified into three phases; i.e., solid extraneous matter, liquid extraneous matter, and gaseous extraneous matter. The extraneous-matter trapping means 13 completely separates solid extraneous matter and liquid extraneous matter from the gaseous refrigerant, thus trapping the thus-separated extraneous matter. Some of the gaseous extraneous matter is trapped by the extraneous-matter trapping means 13, but some of the same escapes.

The gaseous refrigerant returns to the compressor 1 along with the gaseous extraneous matter, which has escaped the extraneous-matter trapping means 13, via the first selector valve 10, the seventh control valve 17*e*, the second control valve 7, the four-way valve 2, and the accumulator 8.

The HFC refrigeration oil, which has been completely separated from the gaseous refrigerant by the oil separator 9, merges with the principal stream of HFC refrigerant at a downstream position relative to the extraneous-matter trapping means 13, via the bypass channel 9*a*. The thus-merged flow of HFC refrigerant and the HFC refrigeration oil returns to the compressor 1. Thus, the HFC refrigeration oil is prevented from being mixed with the mineral oil remaining in the first and second connecting pipes CC and DD and is prevented from being incompatible with an HFC. Further, there can be prevented deterioration of the HFC refrigeration oil, which would otherwise be caused by mixing with a mineral oil.

Further, the HFC refrigeration oil does not mix with solid extraneous matter, thus preventing deterioration of the HFC refrigeration oil.

During a single circulation of the HFC refrigerant through the refrigerant circuit and through the extraneous-matter trapping means 13, only some of the gaseous extraneous matter is trapped. The gaseous extraneous matter is mixed with the HFC refrigeration oil. However, deterioration in the HFC refrigeration oil is attributable to chemical reaction and does not proceed abruptly. FIG. 2 shows an example of deterioration of the HFC refrigeration oil. The gaseous extraneous matter, which has not been trapped during the single passage of the gaseous refrigerant through the extraneous-matter trapping means 13, passes through the extraneous-matter trapping means 13 again and again, along with circulation of the HFC refrigerant. Hence, the only requirement is that the gaseous matter be trapped by the extraneous-matter trapping means 13 faster than the rate at which the HFC refrigeration oil deteriorates.

Next will be described the flow of a refrigerant during a heating operation. The refrigerant is compressed by the compressor 1 to become a hot, high-temperature gas; is discharged from the compressor 1 together with an HFC refrigeration oil; and enters the oil separator 9 via the four-way valve 2, the second control valve 7, the seventh control valve 17*e*, and the first selector valve 10. In the oil separator 9, the HFC refrigeration oil is completely separated from the gaseous refrigerant, and only the gaseous refrigerant flows into the cooling means 12*a*, where the gaseous refrigerant is condensed.

The thus-condensed refrigerant flows to the second flow rate control means 16, where the gaseous refrigerant is slightly decompressed to assume a low-pressure two-phase state. The refrigerant of gas-liquid two-phase state flows into the second connecting pipe DD via the second selector valve 11 and the eighth control valve 17*f*. Since the refrigerant flowing through the second connecting pipe DD is in a gas-liquid two-phase state and flows fast, the residual extraneous matter remaining in the second connecting pipe DD is cleaned at comparatively fast speed with the liquid refrigerant.

Subsequently, the refrigerant of gas-liquid two-phase state flows into the first connecting pipe CC together with the residual extraneous matter removed from the second connecting pipe DD, via the seventh electromagnetic valve 18*c*. Since the refrigerant flowing through the first connecting pipe CC is in a gas-liquid two-phase state and flows fast, the residual extraneous matter remaining in the first connecting pipe CC is cleaned at comparatively fast speed together with the liquid refrigerant.

The refrigerant of gas-liquid two-phase state flows to the first flow rate control means 15 together with the residual extraneous matter cleared from the first and second connecting pipes CC and DD, via the sixth control valve 17*d* and the second selector valve 11. The refrigerant is decompressed in the first flow rate control means 15, and the thus-decompressed refrigerant flows into the heating means 12*b*, where the refrigerant is evaporated. The thus-evaporated refrigerant flows into the extraneous-matter trapping means 13. According to boiling point, the components of the residual extraneous matter differ in phase from each other and can be classified into three phases; i.e., solid extraneous matter, liquid extraneous matter, and gaseous extraneous matter.

The extraneous-matter trapping means 13 completely separates solid extraneous matter and liquid extraneous matter from the gaseous refrigerant, thus trapping the thus-separated extraneous matter. Some of the gaseous extraneous matter is trapped by the extraneous-matter trapping means 13, but some of the same escapes. Subsequently, the gaseous refrigerant flows into the heat-source-unit-side heat exchanger 3 together with the gaseous extraneous matter which has not been trapped by the extraneous-matter trapping means 13, via the first selector valve 10 and the fifth control valve 17*c*. The gaseous refrigerant is caused to pass through the heat-source-unit-side heat exchanger 3 without involvement of heat exchange while a blower is stopped, and returns to the compressor 1 via the accumulator 8.

The HFC refrigeration oil, which has been completely separated from the gaseous refrigerant by the oil separator 9, merges with the principal stream of HFC refrigerant at a downstream position relative to the extraneous-matter trapping means 13, via the bypass channel 9*a*. The thus-merged flow of the HFC refrigerant and the HFC refrigeration oil returns to the compressor 1. Thus, the HFC refrigeration oil is prevented from being mixed with the mineral oil remaining in the first and second connecting pipes CC and DD and is prevented from being incompatible with an HFC. Further, there can be prevented deterioration of the HFC refrigeration oil, which would otherwise be caused by mixing with a mineral oil.

Further, the HFC refrigeration oil does not mix with solid extraneous matter, thus preventing deterioration of the HFC refrigeration oil.

During a single circulation of the HFC refrigerant through the refrigerant circuit and through the extraneous-matter trapping means 13, only some of the gaseous extraneous matter is trapped. The gaseous extraneous matter is mixed with the HFC refrigeration oil. However, deterioration in the HFC refrigeration oil is attributable to chemical reaction and does not proceed abruptly. FIG. 2 shows an example of deterioration of the HFC refrigeration oil. The gaseous extraneous matter, which has not been trapped during the single passage of the gaseous refrigerant through the extraneous-matter trapping means 13, passes through the extraneous-matter trapping means 13 again and again, along with circulation of the HFC refrigerant. Hence, the only requirement is that the gaseous matter be trapped by the extraneous-matter trapping means 13 faster than the rate at which the HFC refrigeration oil deteriorates.

Since the extraneous-matter trapping means 13 and the oil separator 9 are completely the same as those employed in the first embodiment, repetition of their explanations is omitted here.

Figure 13:
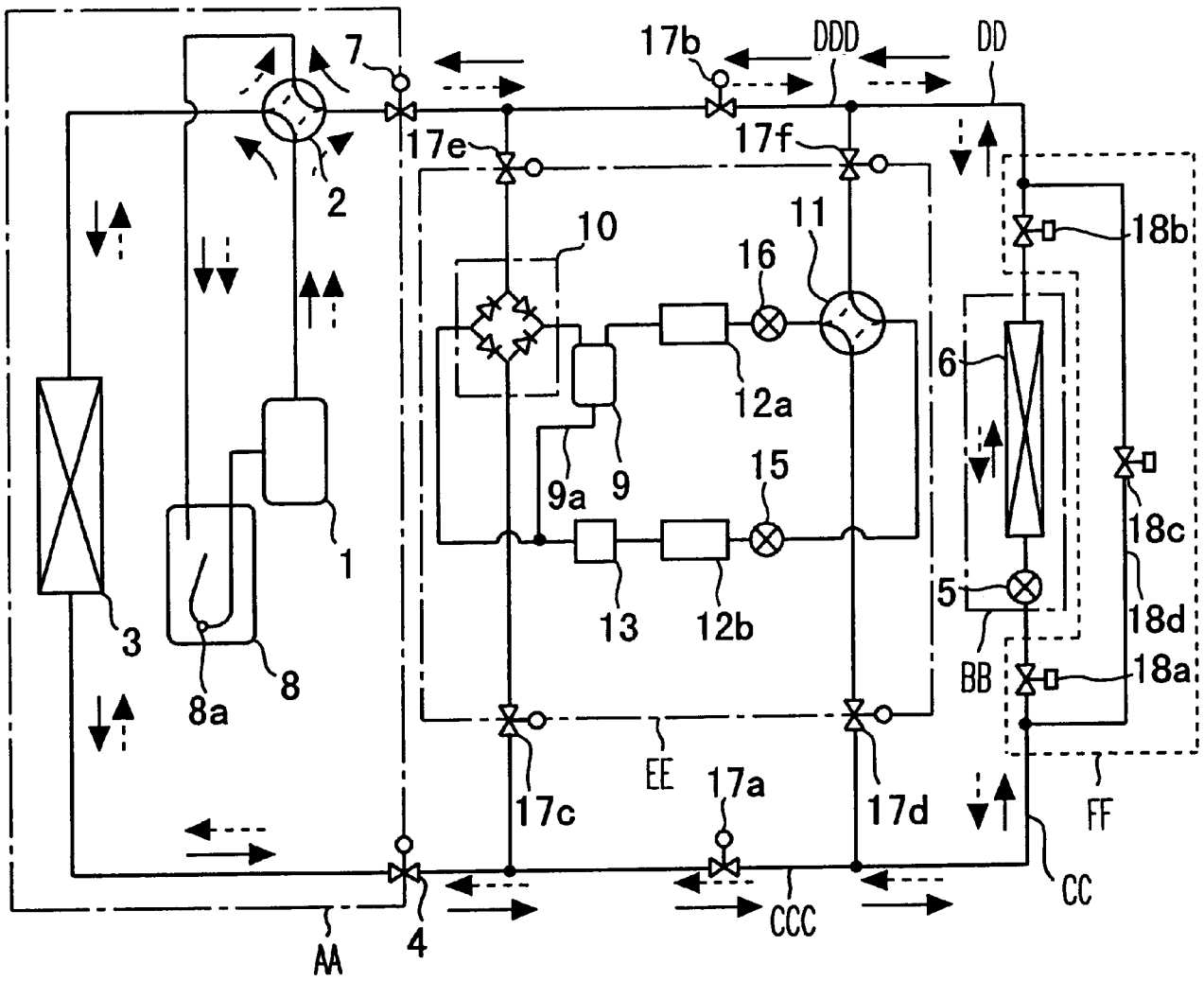
FIG. 13 is a schematic diagram showing an ordinary cooling operation of the refrigeration system of the fourth embodiment.

The ordinary air-conditioning operation of the refrigeration system will now be described by reference to FIG. 13. In the drawing, solid arrows depict the circulation of the refrigerant during a cooling operation, and dotted arrows depict the circulation of the refrigerant during a heating operation.

First will be explained the circulation of a refrigerant during a cooling operation. The refrigerant is compressed by the compressor 1 to assume the form of a hot, high-pressure gas; flows via the four-way valve 2 into the heat-source-unit-side heat exchanger 3, where the gaseous refrigerant exchanges heat with a heat source medium, such as water or air; and is condensed. The thus-condensed refrigerant flows to the flow rate regulator 5, via the first control valve 4, the third control valve 17*a*, the first connecting pipe CC, and the fifth electromagnetic valve 18*a*. In the flow rate regulator 5, the refrigerant is decompressed to a low-pressure, two-phase state. By way of the user-side heat exchanger 6, the refrigerant exchanges heat with a user-side medium, such as air, and evaporates.

The thus-evaporated refrigerant returns to the compressor 1 via the sixth electromagnetic valve 18*b*, the second connecting pipe DD, the fourth control valve 17*b*, the second control valve 7, the four-way valve 2, and the accumulator 8.

Since the fifth control valve 17*c* through the eighth control valve 17*f* are closed, the extraneous-matter trapping means 13 is isolated and is brought into a closed state. Therefore, the extraneous matter trapped during the cleaning operation of the refrigeration system cannot again return to the circuit in operation. In contrast with the case of the first embodiment, the refrigerant does not pass through the extraneous-matter trapping means 13, and hence the inlet pressure of the compressor 1 is susceptible to only a small loss, which in turn induces little deterioration in the capability of the compressor Next will be explained the circulation of a refrigerant during a heating operation. The refrigerant is compressed by the compressor 1 to assume the form of a hot, high-pressure gas; and flows via the four-way valve 2 into the second control valve 7. The gaseous refrigerant flows via the fourth control valve 17*b*, the second connecting pipe DD, and the sixth electromagnetic valve 18*b* into the user-side heat exchanger 6, where the gaseous refrigerant exchanges heat with a heat source medium, such as water or air, and is condensed.

The thus-condensed refrigerant flows to the flow rate regulator 5, where the refrigerant is decompressed to assume a low-pressure two-phase state. The refrigerant flows to the fifth electromagnetic valve 18*a*, the first connecting pipe CC, the third control valve 17*a*, the first control valve 4, and the heat-source-unit-side heat exchanger 3, where the gaseous refrigerant exchanges heat with a heat source medium, such as water or air, and evaporates. The thus-evaporated refrigerant returns to the compressor 1 via the four-way valve 2 and the accumulator 8.

Since the fifth control valve 17*c* through the eighth control valve 17*f* are closed, the extraneous-matter trapping means 13 is isolated and is brought into a closed state. Therefore, the extraneous matter trapped during the cleaning operation of the refrigeration system cannot again return to the circuit in operation. In contrast with the case of the first embodiment, the refrigerant does not pass through the extraneous-matter trapping means 13, and hence the inlet pressure of the compressor 1 is susceptible to only a small loss, which in turn induces little deterioration in the capability of the compressor 1. In contrast with the case of the third embodiment, the refrigerant does not flow into the cooling means 12*a*, and hence no loss arises in the heating capability of the refrigeration system.

As mentioned above, the oil separator 9 and the extraneous-matter trapping means 13 are incorporated into the heat source unit AA. Accordingly, a deteriorated CFC/HCFC-using refrigeration system can be replaced with a new HFC-using refrigeration system without replacement of the first connecting pipe CC and the second connecting pipe DD, by means of replacing only the heat source unit AA and the indoor unit BB with new ones. In contrast with the conventional first cleaning method, the existing pipe reuse method of the present invention eliminates a necessity of cleaning the refrigeration system with a specifically-designed cleaning solvent (HCFC 141b or HCFC 225) through use of cleaning equipment. Therefore, the method completely eliminates the possibility of depletion of the ozone layer, the use of a flammable and toxic substance, a fear of existence of a residual cleaning solvent, and a necessity for recovery of a cleaning solvent.

In contrast with the conventional second cleaning method, the method of the present invention eliminates a necessity of operating the refrigeration system three times repeatedly for cleaning, as well as a necessity of replacing an HFC refrigerant and HFC refrigerator oil with new refrigerant and oil three times. The method of the present invention involves use of only the amount of HFC refrigerant and HFC refrigerator oil required for one refrigeration system, thus yielding an advantage in terms of cost and environmental cleanliness. Further, the method completely eliminates a necessity of managing refrigeration oil for replacement purpose and the chance of excessive or insufficient refrigeration oil. Further, there is no chance of the HFC refrigerator oil being incompatible with the HFC refrigerant or being deteriorated.

Since the refrigeration system is equipped with the fifth control valve 17*c* through the eighth control valve 17*f*, the refrigerant passes through the extraneous-matter trapping means 13 during a cleaning operation, and hence a cleaning effect as described above is achieved. During the normal operation subsequent to the cleaning operation, the fifth control valve 17*c* through the eighth control valve 17*f* are closed, and the extraneous-matter trapping means 13 is isolated and is brought into a closed state. Therefore, the extraneous matter trapped during the cleaning operation of the refrigeration system cannot again return to the circuit in operation. In contrast with the case of the first embodiment, the refrigerant does not pass through the extraneous-matter trapping means 13, and hence the inlet pressure of the compressor 1 is susceptible to only a small loss, which in turn induces little deterioration in the capability of the compressor 1.

Since the refrigeration system is provided with the cooling means 12*a*, the heating means 12*b*, the first selector valve 10, and the second selector valve 11, a liquid refrigerant or a refrigerant of gas-liquid two-phase flows into the first and second connecting pipes CC and DD during a cleaning operation, regardless of whether or not the refrigeration system performs a cooling operation or a heating operation. Hence, a high cleaning effect is achieved during the cleaning of a residual extraneous matter, and cleaning time can be shortened.

Further, the cooling means 12*a* and the heating means 12*b* can control the amount of heat to be exchanged, and hence, regardless of the ambient temperature and the refrigeration load, the refrigeration system can perform substantially the same cleaning operation under arbitrary conditions, thereby rendering a resultant effect and required efforts stable.

Since the refrigeration system is provided with the first flow rate control means 15 and the second flow rate control means 16, the refrigerant circulating through the first and second connecting pipes CC and DD can inevitably be brought into a gas-liquid two-phase state. Hence, a strong cleaning effect can be achieved during the cleaning of residual extraneous matter, and cleaning time can be shortened. Further, the pressure and dryness of the refrigerant of gas-liquid two-phase state flowing through the first and second connecting pipes CC and DD can be controlled, and hence the refrigeration system can be made to perform substantially the same cleaning operation under arbitrary conditions, thus rendering a resultant effect and required efforts stable.

Since the refrigeration system is equipped with the indoor bypass unit FF, the state of the refrigerant flowing through the first connecting pipe CC can be made substantially equal to the state of the refrigerant flowing through the second connecting pipe DD, thus rendering a resultant effect and required efforts stable.

Since the cleaning unit EE incorporates the oil separator 9, the bypass channel 9*a*, the cooling means 12*a*, the heating means 12*b*, the extraneous-matter trapping means 13, the first selector valve 10, the second selector valve 11, the first flow rate control means 15, and the second flow rate control means 16, the heat source unit AA can be made compact and less costly. Further, even when the first and second connecting pipes CC and DD are newly laid, the heat source unit AA can be used as a common heat source unit.

The cleaning unit EE is removably connected to an area defined by the fifth control valve 17*c* through the eighth control valve 17*f* of the refrigeration system. After the cleaning operation, these control valves 17*c* to 17*f* are closed, thereby recovering refrigerant from the inside of the cleaning unit EE. The cleaning unit EE is then detached from the refrigeration system and is attached to another, similar refrigeration system, thus enabling cleaning of the other refrigeration system.

The previous embodiment has described the method of replacing the heat source unit AA and the indoor unit BB with new ones. However, the present invention also enables replacement of only the heat source unit AA with a new one without involvement of replacement of the first connecting pipe CC, the indoor unit BB, and the second connecting pipe DD.

Although the fourth embodiment has described an example in which a single indoor unit BB is connected to the refrigeration system, it goes without saying that even a refrigeration system including a plurality of indoor units BB connected in parallel or series with each other yields the same advantage as that yielded by the refrigeration system of the present embodiment. As is obvious, the same advantage is yielded even when a thermal storage ice bath or a thermal storage water bath (including hot water) is connected in parallel or series with the heat-source-unit-side heat exchanger 3.

It is evident that the same advantage as yielded by the refrigeration system of the present embodiment is also yielded by a refrigeration system comprising a plurality of heat source units AA connected in parallel. obviously, the same advantage as that yielded by the previous embodiment is not limited to the refrigeration unit; the same advantage as in the previously-described embodiment is yielded so long as a thermo-compression refrigeration application comprises a unit incorporating a heat-source-unit-side heat exchanger and another unit incorporating a user-side heat exchanger, the units being remotely spaced away from each other.

Although, in the fourth embodiment, the refrigeration system is provided with only a single cleaning unit EE, the same advantage as that yielded by the refrigeration system of the present embodiment can be obviously yielded by even a refrigeration system equipped with a plurality of cleaning units EE.

The configuration of the refrigeration system of the fourth embodiment may be summarized in a way as follows:

The refrigeration system comprises the first refrigerant circuit for circulating a refrigerant from and to the compressor via the heat-source-unit-side heat exchanger, the flow rate regulator, the user-side heat exchanger, and the accumulator, in the sequence given. Further, the refrigeration system comprises the second refrigerant circuit for circulating a refrigerant from and to the compressor via the user-side heat exchanger, the flow rate regulator, the heat-source-unit-side heat exchanger, and the accumulator, in the sequence given.

The refrigeration system of the present embodiment comprises a first bypass channel for interconnecting the user-side heat exchanger and the accumulator of the first refrigerant circuit and for interconnecting the flow rate controller and the heat-source-unit-side heat exchanger of the second refrigerant circuit; and extraneous-matter trapping means for trapping extraneous matter in the refrigerant.

The refrigeration system of the present embodiment comprises a second bypass channel for interconnecting the heat-source-unit-side heat exchanger and the flow rate controller of the first refrigerant circuit and for interconnecting the compressor and the user-side heat exchanger of the second refrigerant circuit; and refrigerant cooling means for cooling the refrigerant.

The refrigeration system further comprises the refrigerant cooling means disposed upstream of the extraneous-matter trapping means of the first bypass channel.

The refrigeration system further comprises a third bypass channel for interconnecting the heat-source-unit-side heat exchanger and the flow rate controller of the first refrigerant circuit and for interconnecting the compressor and the user-side heat exchanger of the second refrigerant circuit; and oil separation means for separating an oil component of the refrigerant.

Next will be described methods of controlling the cleaning operation of the refrigeration system of the second embodiment after replacement of a refrigerant.

In controlling the cleaning operation of the refrigeration system, the heat source unit AA of the refrigerant circuit (i.e., the refrigeration system) which use a CFC or HCFC (i.e., an old refrigerant) is replaced with a new heat source unit AA which use an HFC (i.e., a new refrigerant). The indoor unit BB may also be replaced simultaneously. After having been additionally recharged, the refrigeration system performs a cleaning operation as follows.

(1) First Control Method

The refrigeration system first performs a cooling operation in a manner as described above as a step A of a cleaning operation procedure.

(2) Second Control Method

The refrigeration system first performs a heating operation in a manner as described above as a step B of a cleaning operation procedure.

(3) Third Control Method

The refrigeration system performs a cleaning operation in the sequence given from the cooling operation as a step A to the heating operation as a step B of the cleaning operation procedure.

(4) Fourth Control Method

An operating capacity of the refrigeration system for a cleaning operation is controlled according to the inner diameters of the first and second connecting pipes CC and DD which are objects of cleaning. Further, the mass velocity of the refrigerant flowing through the first and second connecting pipes CC and DD currently being cleaned is set to be greater than a predetermined value or to fall within a certain range. This applies to step A and step B.

The features and effects of the above control methods are same or similar with those as described in the first embodiment, so that the duplicated descriptions are omitted here.

Fifth Embodiment

FIGS. 14, 15, 16, and 17 are schematic diagrams showing respectively a refrigerant circuit of a refrigeration system, as an example refrigeration system according to a fifth embodiment of the present invention.

Each of these drawings illustrates a case where a plurality of user-side refrigerant circuit corresponding to the user-side refrigerant circuit shown in FIGS. 1, 8, 10, and 12 are arranged in parallel, wherein the user-side refrigerant circuit each comprises the first connecting pipe CC, the indoor unit BB (i.e., the flow rate regulator 5 and the user-side heat exchanger 6), and the second connecting pipe DD.

A refrigerant circuit shown in FIG. 14 and control of a cleaning operation of the refrigerant circuit will first be described.

Figure 14:
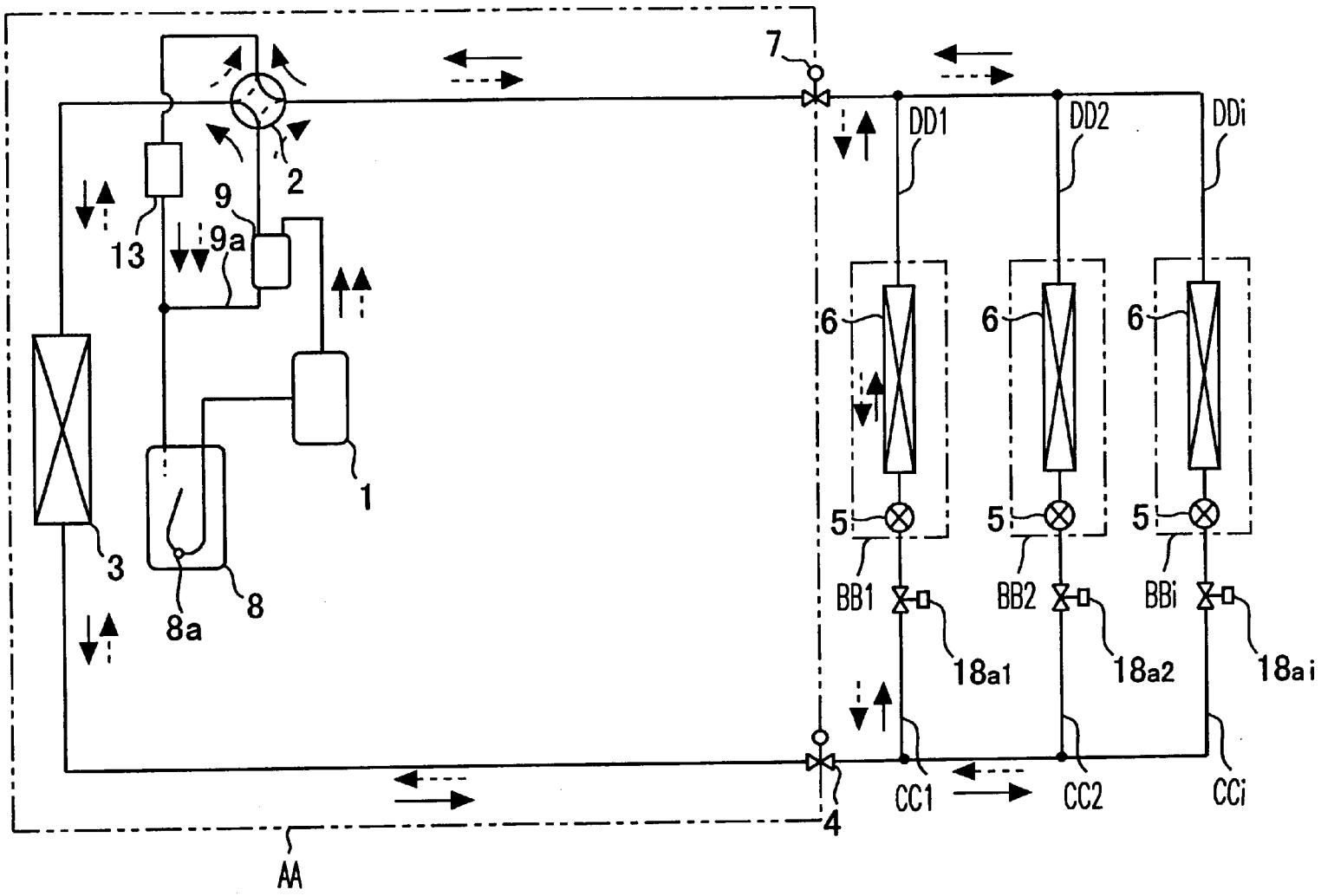
FIG. 14 is a schematic diagram showing an example refrigerant circuit of a refrigeration system according to a fifth embodiment of the present invention.

In FIG. 14, CCi (where i=1 through n) denotes a first connecting pipe of the $i^{th}$ user-side coolant circuit; BBi (where i=1 through n) denotes an indoor unit of the $i^{th}$ user-side coolant circuit; and DDi (where i=1 through n) denotes a second connecting pipe of the $i^{th}$ user-side coolant circuit. Further, reference numeral 18*ai* (where i=1 through n) denotes a fifth electromagnetic valve interposed between the $i^{th}$ first connecting pipe CCi and the $i^{th}$ indoor unit BBi.

In the case of a multi-indoor-unit air conditioner in which a plurality of indoor units BBi are arranged in parallel and where refrigerant to be supplied to the first and second connecting pipes CCi and DDi is in a gas-liquid two-phase state, the gas-liquid refrigerant is usually distributed unequally at the respective junction where the connecting pipe is branched to the indoor unit BBi. Although a special structure is required for distributing gas-liquid refrigerant equally, since the junctions are embedded in a pipe shaft or a ceiling, replacement of the junctions is impossible. For this reason, there may arise a case where refrigerant of mass velocity sufficient for cleaning may be ensured for a certain indoor unit BB but may not be ensured for another indoor unit.

If only the fifth electromagnetic valve 18*ai* of a specific indoor unit BBi is opened and the fifth electromagnetic valves 18*ai* of the other indoor units BBi are closed, all of the refrigerant flows into the pipe connected to the indoor unit BBi whose fifth electronic valve 18*ai* is opened, thereby ensuring refrigerant of mass velocity sufficient for cleaning that indoor unit BBi. The fifth electromagnetic valves 18*ai* of the respective indoor units BBi are opened in turn, thus ensuring refrigerant of sufficient mass velocity for cleaning each of the indoor units BB in turn. Eventually, the mineral oil of the refrigeration system is sufficiently cleaned.

Figure 15:
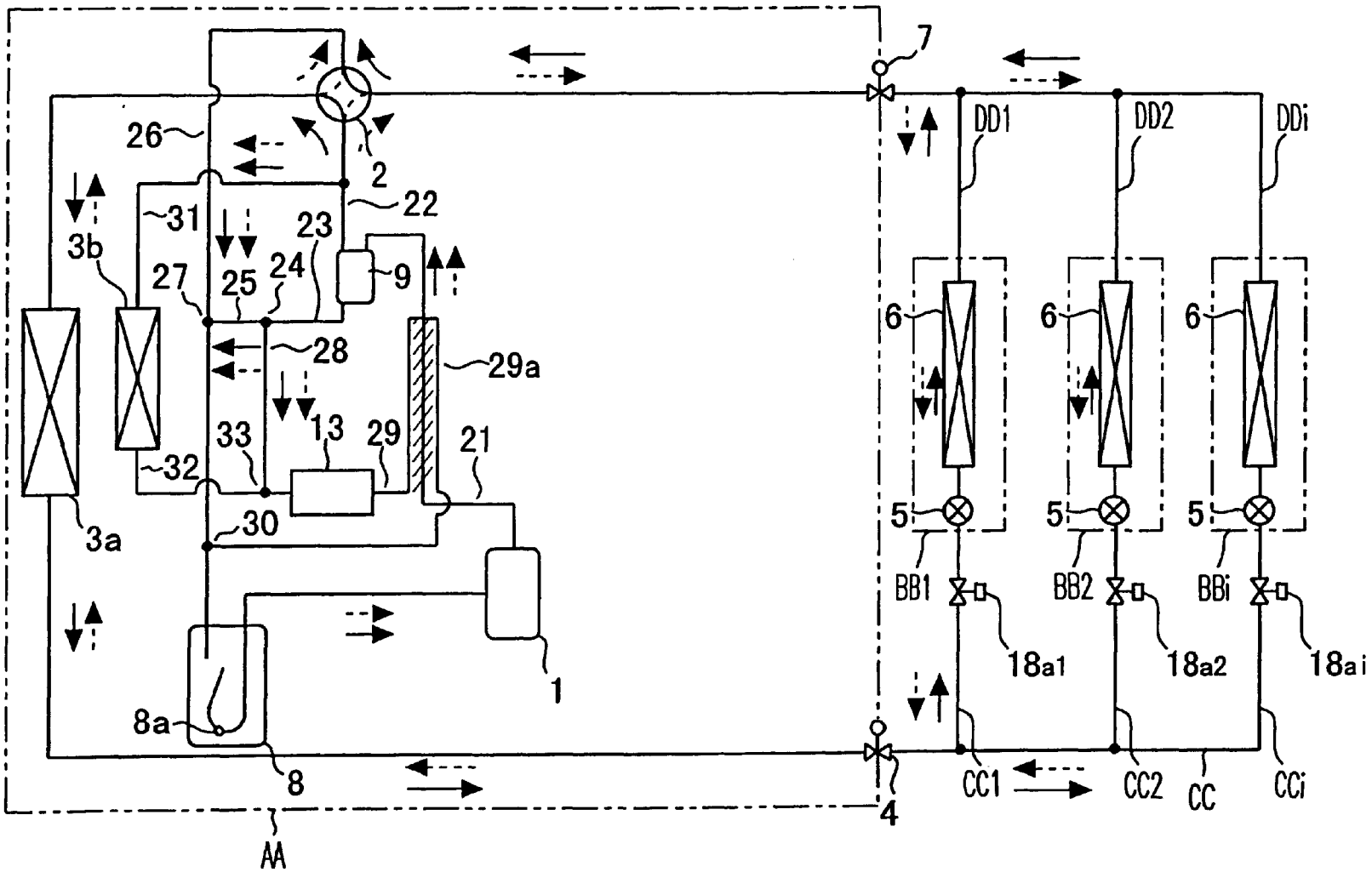
FIG. 15 is a schematic diagram showing another example of the refrigerant circuit of the refrigeration system according to the fifth embodiment.

A refrigerant circuit shown in FIG. 15 and control of a cleaning operation of the refrigerant are now described.

In FIG. 15, CCi (where i=1 through n) denotes a first connecting pipe of the $i^{th}$ user-side coolant circuit; BBi (where i=1 through n) denotes an indoor unit of the $i^{th}$ user-side coolant circuit; and DDi (where i=1 through n) denotes a second connecting pipe of the $i^{th}$ user-side coolant circuit. Further, reference numeral 18*ai* (where i=1 through n) denotes a fifth electromagnetic valve interposed between the $i^{th}$ connecting pipe CCi and the $i^{th}$ indoor unit BBi.

In the case of a multi-indoor-unit air conditioner in which a plurality of indoor units BBi are arranged in parallel and where refrigerant to be supplied to the first and second connecting pipes CCi and DDi is in a gas-liquid two-phase state, the gas-liquid refrigerant is usually distributed unequally at the respective junction where the connecting pipe is branched to the indoor unit BBi. Although a special structure is required for distributing gas-liquid refrigerant equally, since the junctions are embedded in a pipe shaft or a ceiling, replacement of the junctions is impossible. For this reason, there may arise a case where refrigerant of mass velocity sufficient for cleaning may be ensured for a certain indoor unit BB but may not be ensured for another indoor unit.

If only the fifth electromagnetic valve 18*ai* of a specific indoor unit BBi is opened and the fifth electromagnetic valves 18*ai* of the other indoor units BBi are closed, all of the refrigerant flows into the pipe connected to the indoor unit BBi whose fifth electronic valve 18*ai* is opened, thereby ensuring refrigerant of mass velocity sufficient for cleaning that indoor unit BBi. The fifth electromagnetic valves 18*ai* of the respective indoor units Bi are opened in turn, thus ensuring refrigerant of sufficient mass velocity for cleaning each of the indoor units BB in turn. Eventually, the mineral oil of the refrigeration system is sufficiently cleaned.

Figure 16:
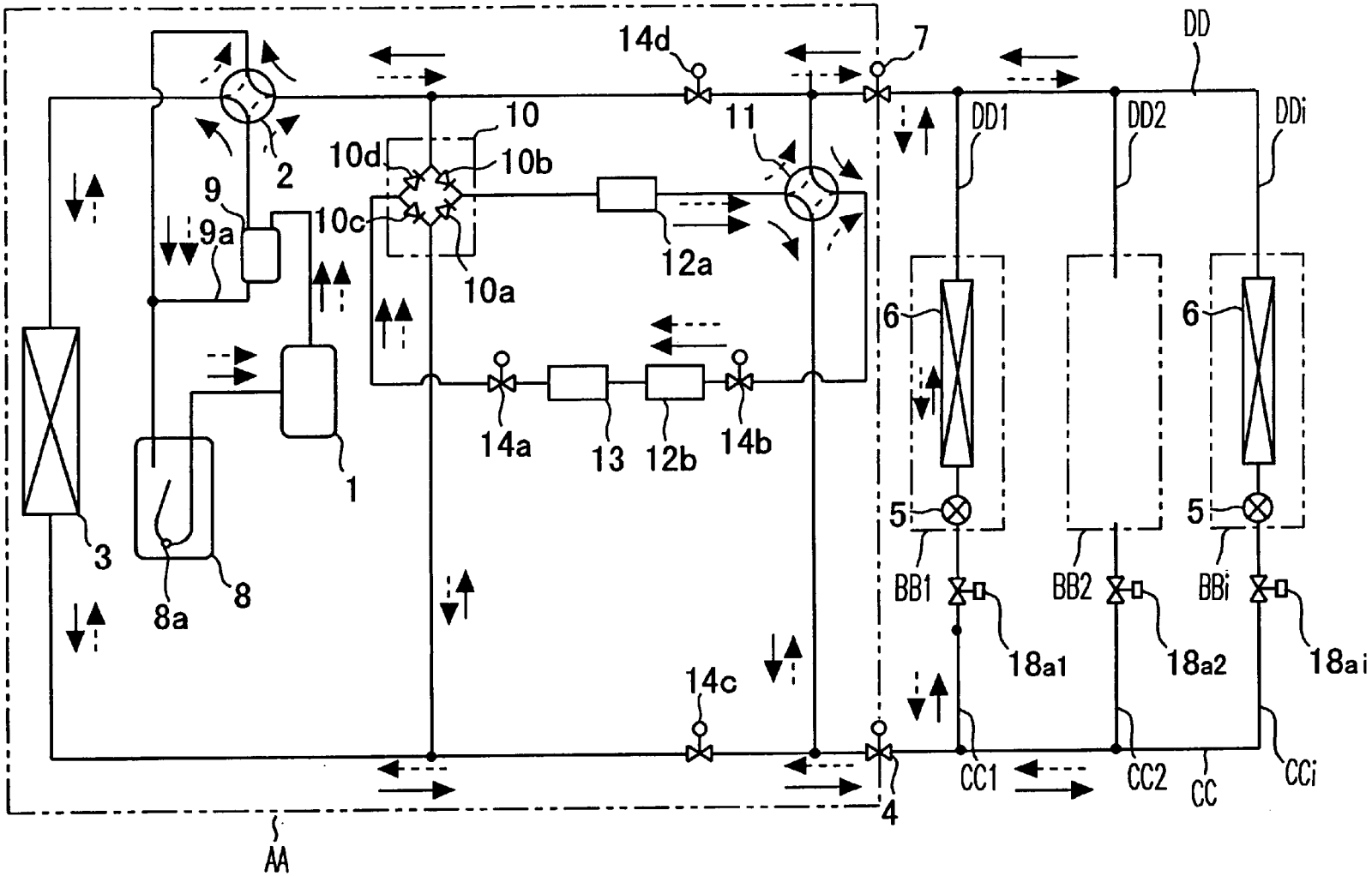
FIG. 16 is a schematic diagram showing still another example of the refrigerant circuit of the refrigeration system according to the fifth embodiment.

A refrigerant circuit shown in FIG. 16 and control of a cleaning operation of the refrigerant are now described.

In FIG. 16, CCi (where i=1 through n) denotes a first connecting pipe of the $i^{th}$ user-side coolant circuit; BBi (where i=1 through n) denotes an indoor unit of the $i^{th}$ user-side coolant circuit; and DDi (where i=1 through n) denotes a second connecting pipe of the $i^{th}$ user-side coolant circuit. Further, reference numeral 18*ai* (where i=1 through n) denotes a fifth electromagnetic valve interposed between the $i^{th}$ first connecting pipe CCi and the $i^{th}$ indoor unit BBi.

In the case of a multi-indoor-unit air conditioner in which a plurality of indoor units BBi are arranged in parallel, as has been described in connection with FIG. 14, the refrigeration system is cleaned while only the fifth electromagnetic valve 18*ai* of the indoor unit BBi is opened and the fifth electromagnetic valves 18*ai* of the other indoor units Bi are closed. The fifth electromagnetic valves 18*ai* of the respective indoor units BBi are opened in turn, thus ensuring refrigerant of sufficient mass velocity for cleaning each of the indoor units BB in turn. Eventually, the mineral oil of the refrigeration system is sufficiently cleaned.

Figure 17:
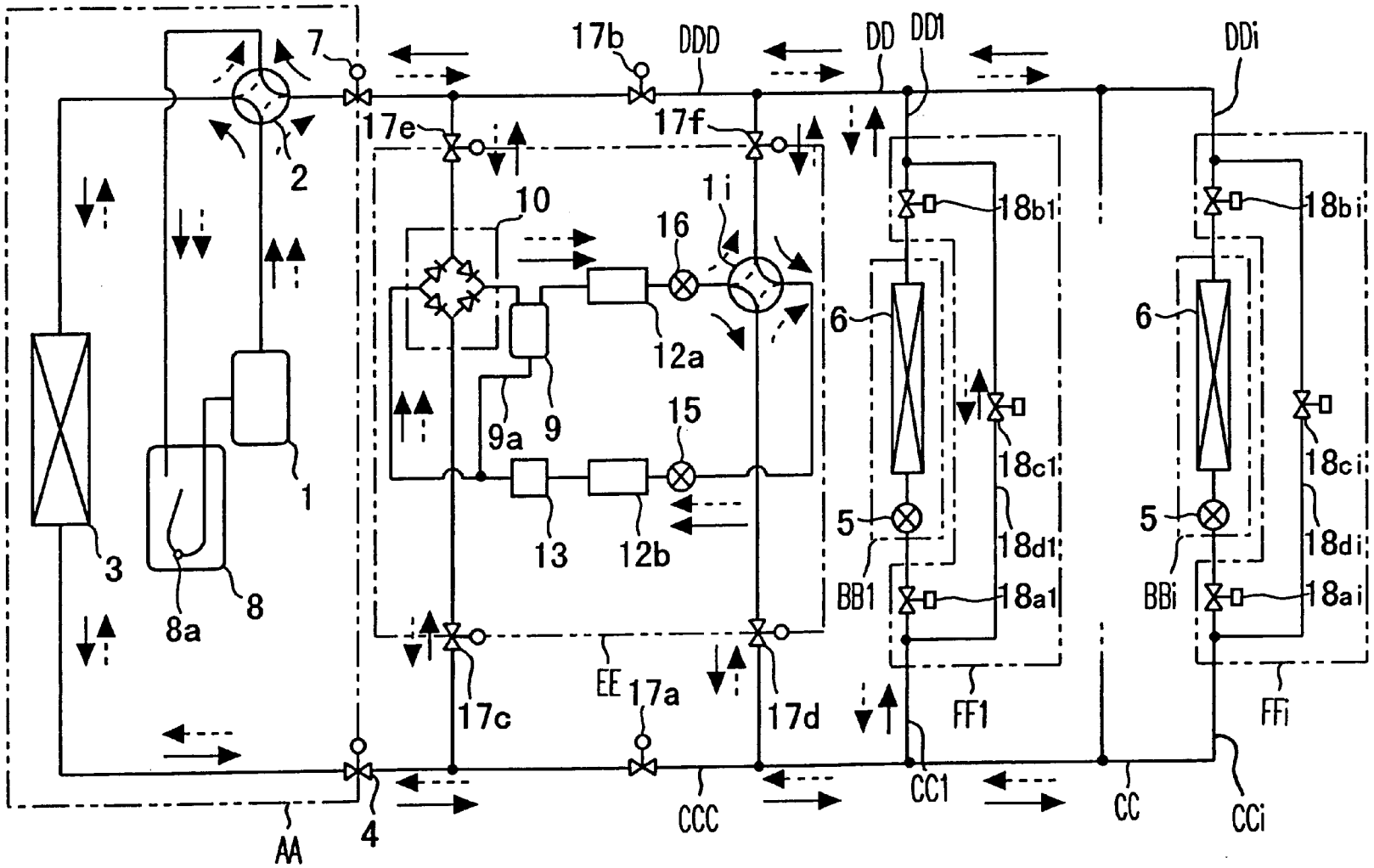
FIG. 17 is a schematic diagram showing yet another example of the refrigerant circuit of the refrigeration system according to the fifth embodiment.

A refrigerant circuit shown in FIG. 17 and control of a cleaning operation of the refrigerant are now described.

In FIG. 17, CCi (where i=1 through n) denotes a first connecting pipe of the $i^{th}$ user-side coolant circuit; BBi (where i=1 through n) denotes an indoor unit of the $i^{th}$ user-side coolant circuit; and DDi (where i=1 through n) denotes a second connecting pipe of the $i^{th}$ user-side coolant circuit. Further, reference numeral 18*ci* (where i=1 through n) denotes a seventh electromagnetic valve provided at a position in a bypass pipe 18*di* interconnecting the $i^{th}$ first connecting pipe CCi and the $i^{th}$ second connecting pipe DDi.

In the case of a multi-indoor-unit air conditioner in which a plurality of indoor units BBi are arranged in parallel, as has been described in connection with FIG. 14, the refrigeration system is cleaned while only the seventh electromagnetic valve 18*ci* of a specific indoor unit BBi is opened and the seventh electromagnetic valves 18*ci* of the other indoor units Bi are closed. The seventh electromagnetic valves 18*ci* of the respective indoor units BBi are opened in turn, thus ensuring refrigerant of sufficient mass velocity for cleaning each of the indoor units BB in turn. Eventually, the mineral oil of the refrigeration system is sufficiently cleaned.

Sixth Embodiment

Figure 18:
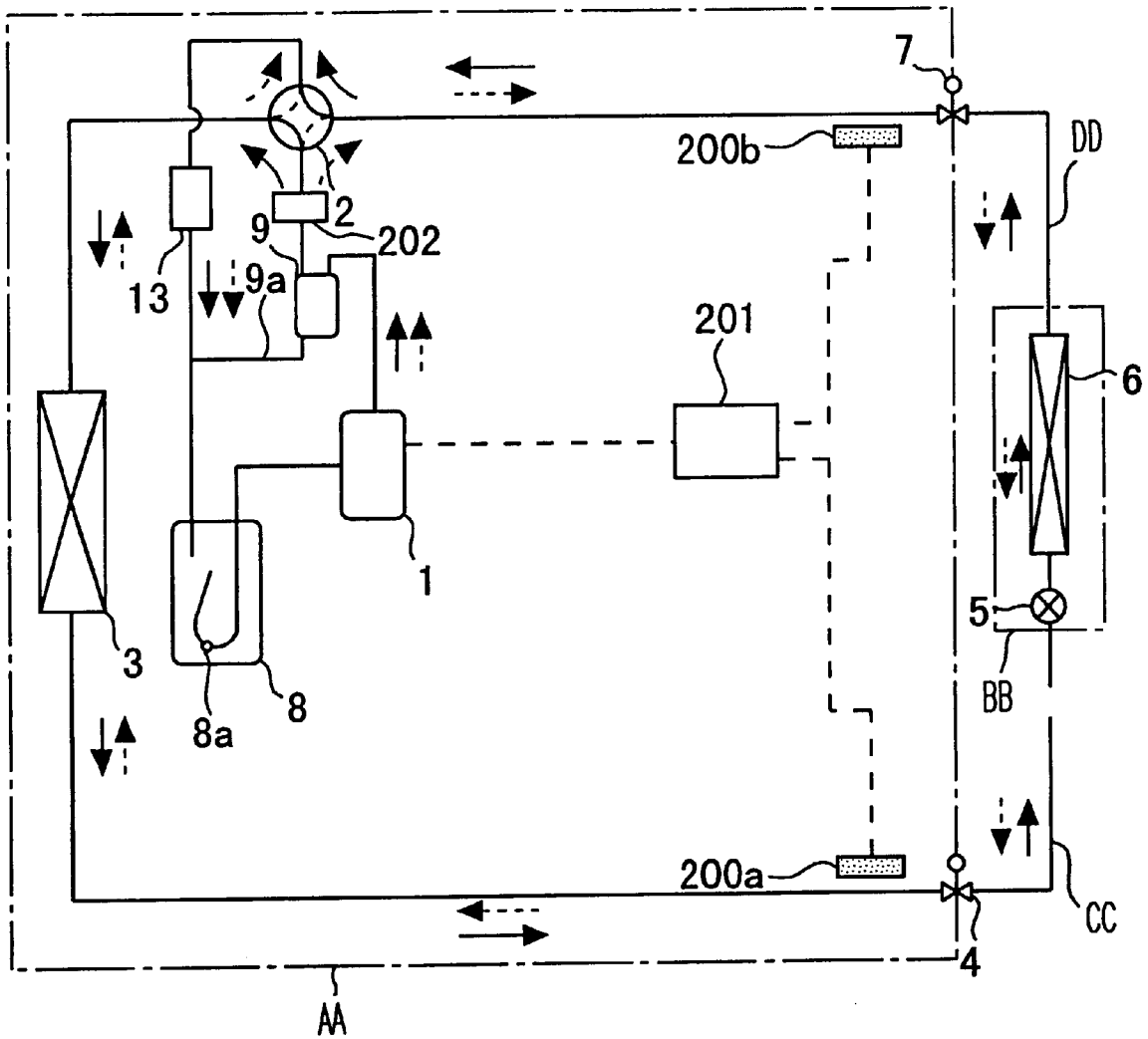
FIG. 18 is a schematic diagram showing an example refrigerant circuit of a refrigeration system according to a sixth embodiment of the present invention.

FIG. 18 is a schematic diagram showing an example refrigerant circuit of a refrigeration system according to a sixth embodiment of the present invention. In FIG. 18, reference numeral 200*a* designates temperature detection means for detecting the temperature of refrigerant during a cooling operation. The temperature detection means 200*a* is provided at a position in a pipe interconnecting the heat-source-unit-side heat exchanger 3 and the first control valve 4. Specifically, the temperature detection means 200*a* detects the temperature of the refrigerant to be supplied to the first and second connecting pipes CC and DD during a cooling operation. Reference numeral 200*b* designates another temperature detection means for detecting the temperature of refrigerant during a heating operation. The temperature detection means 200*b* is provided at a position in a pipe interconnecting the four-way valve 2 and the second control valve 7. Specifically, the temperature detection means 200*b* detects the temperature of the refrigerant to be supplied to the first and second connecting pipes CC and DD during a heating operation.

Reference numeral 201 designates refrigerant temperature control means which, upon receipt of a signal from the temperature detection means 200*a* or 200*b*, controls the operation capacity of the compressor 1 and the temperature of the refrigerant discharged from the compressor 1.

Reference numeral 202 designates an additive injection device for injecting an additive for enhancing the effect of cleaning degradation-inducing residuals (e.g., hydrate of iron chloride or copper chloride) for a mineral oil and refrigeration-oil in the course of a cleaning operation. The additive injection device 202 is interposed between the oil separator 9 and the four-way valve 2.

In other respects, the refrigeration system of the present embodiment is identical in configuration with that of the first embodiment shown in FIG. 1, and hence repetition of its detailed explanation is omitted here.

The refrigerant temperature control means 201 compares the temperature detected by either the temperature detection means 200*a* or 200*b* during a cleaning operation with a first predetermined cleaning refrigerant temperature TC1. If the detected temperature is lower than the first cleaning refrigerant temperature TC1 (T200<TC1), the operation capacity of the compressor 1 is increased so as to increase pressure, thereby increasing the detected temperature T200.

If the detected temperature T200 is higher than the first predetermined cleaning refrigerant temperature TC1 (T200>TC2), the operation capacity of the compressor 1 is reduced so as to reduce the drive energy of the compressor 1, thus decreasing the temperature of discharged refrigerant.

By means of control of the refrigerant temperature, the temperature of refrigerant to be supplied to the first and second connecting pipes CC and DD during a cleaning operation can be controlled to be higher than the first predetermined cleaning refrigerant temperature TC1. As a result, the solubility in refrigerant of the mineral oil remaining in the first and second connecting pipes cc and DD is increased, and the viscosity of the mineral oil is decreased, thus ensuring a strong cleaning effect. In a case where the temperature of new refrigerant after replacement of refrigerant is increased to a predetermined temperature or higher, the predetermined temperature is preferably set to be the temperature of extraneous matter included in the refrigerant, a temperature at which extraneous matter included in refrigerant begins to be dissolved into new refrigerant, a temperature at which the viscosity of residual refrigeration oil becomes roughly the same as the viscosity of new refrigeration oil, or a temperature higher than these temperatures.

The hydrate of iron chloride or copper chloride remaining in the first and second connecting pipes CC and DD significantly induces degradation of new refrigeration oil. So long as the first predetermined cleaning refrigerant temperature TC1 is set to be equal to the fusing point of such a hydrate or higher than a temperature at which the hydrate is dissolved in the refrigerant, the temperature of the refrigerant to be supplied to the first and second connecting pipes CC and DD in the course of a cleaning operation can be set equal to the fusing point of such a hydrate or higher than a temperature at which the hydrate is dissolved into refrigerant, through a refrigerant temperature control operation. Consequently, the hydrate of iron chloride or copper chloride can be cleaned, thus enabling an improvement in the reliability of the compressor 1.

The additive injection device 202 injects, into the refrigerant, an additive for enhancing the effect of cleaning degradation-inducing residuals (e.g., hydrate of iron chloride or copper chloride) for a mineral oil and refrigeration-oil in the course of a cleaning operation.

Figure 19:
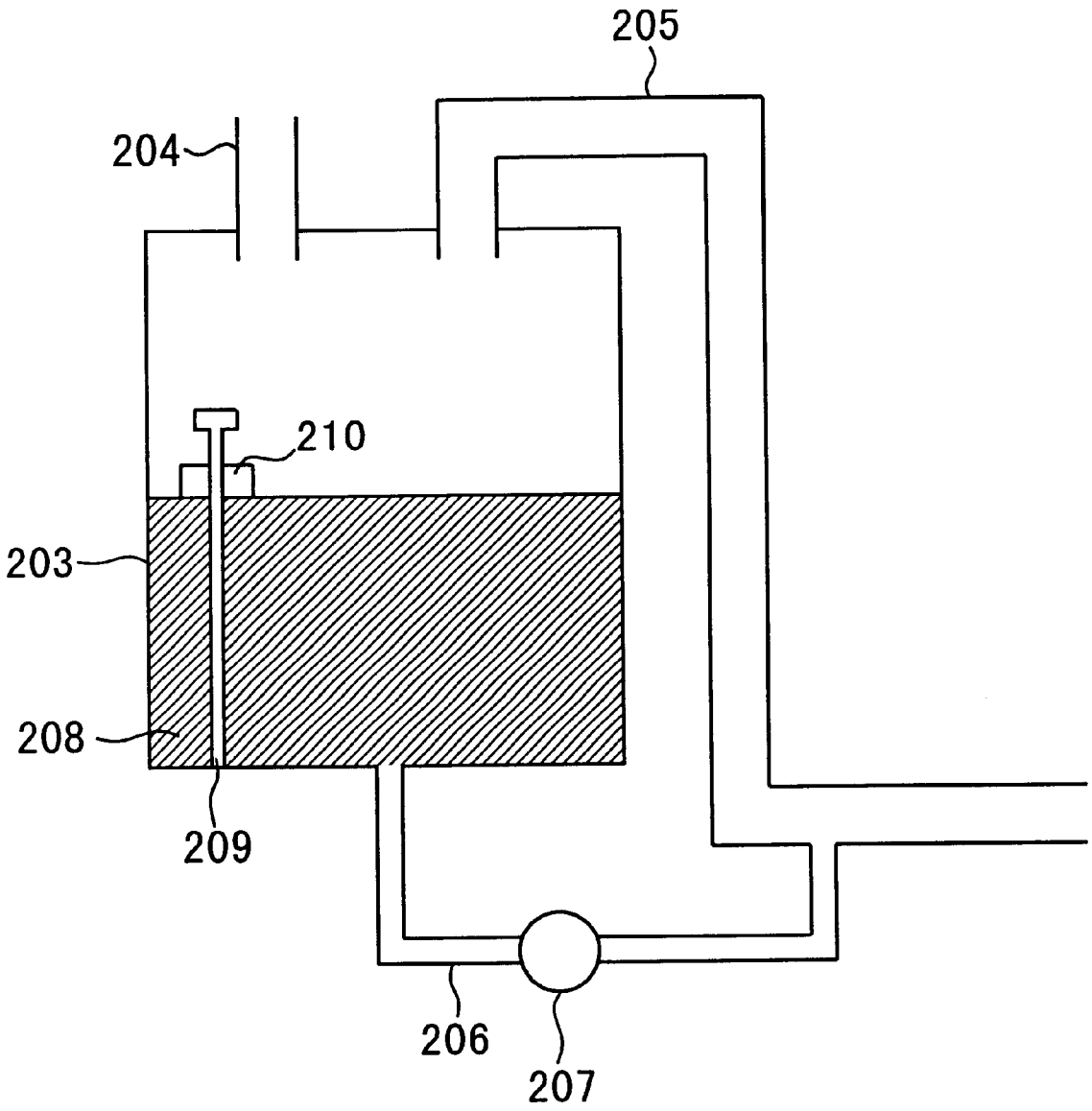
FIG. 19 is a cross-sectional view showing an example additive injection device of the present invention.

FIG. 19 is a cross-sectional view showing an example of the additive injection device 202. The structure and operation of the additive injection device 202 will be described with reference to FIG. 19. In FIG. 19, reference numeral 203 designates a container for storing an additive in a sealed manner; 204 designates a refrigerant inlet pipe provided in the top of the container 203; 205 designates a refrigerant outlet pipe formed in the top of the container 203; 206 designates an additive supply bypass channel interconnecting the bottom of the container 203 and the outlet pipe 205; 207 designates additive supply control means provided at a position in the additive supply bypass channel; 208 designates an additive sealed in the container 203 before a cleaning operation; and 209 designates additive depletion detection means for detecting depletion of the additive. A built-in lead switch is provided in a lower portion of the additive depletion detection means 209. A magnet insert-molded in a float 210 generates a magnetic field. When the float 210 is located at the bottom of the container 203, the magnetic field induces a short circuit in a signal line, thus detecting depletion of an additive.

During a cleaning operation, gaseous refrigerant enters the container 203 from the inlet pipe 204 and exits through the outlet pipe 205. Substantially zero dynamic pressure arises in the container 203, and the dynamic pressure becomes great in the outlet pipe 205. Therefore, a pressure difference arises across the entrance and exit of the additive supply control means 207. By means of this pressure differential, an additive 208 is supplied to the outlet pipe 205 from the inside of the container 203. The additive supply control means 207 is made of, for example, an orifice, a capillary, or an electric expansion valve and is configured so as to supply the additive 208 little by little. The additive charged into the refrigerant is supplied to the first and second connecting pipes CC and DD together with the refrigerant, thus cleaning degradation-inducing residuals (e.g., hydrate of iron chloride or copper chloride) for residual mineral oil and refrigeration-oil. The additive again returns to the heat source unit AA (or the cleaning unit EE), where the additive is trapped by the extraneous-matter trapping means 13. Therefore, a very small amount of additive returns to the compressor 1.

The only requirements imposed on an additive are that the additive dissolves a mineral oil, has a viscosity lower than that of a mineral oil or is likely to dissolve in HFC refrigerant (a first additive requirement), has a boiling point higher than that of the refrigerant, and becomes liquid even when refrigerant exists in a gaseous form in a refrigeration cycle (a second additive requirement).

More preferably, the additive also easily dissolves refrigeration-oil degradation-inducing residuals (e.g., hydrate of iron chloride or copper chloride) (a third additive requirement). So long as an additive is formed from a substance which does not pose any problem in reliability even when the substance enters the compressor 1 (a fourth additive requirement), the additive presents no problem, even if the additive is insufficiently trapped by the extraneous-matter trapping mechanism 13.

Ester oil, ether oil, or alkylbenzene oil can be taken as such a substance. Ester oil and ether oil easily dissolve mineral oil and are likely to be dissolved in HFC refrigerant. Alkylbenzene oil easily dissolves mineral oil and is dissolved more easily in HFC refrigerant than in mineral oil. So long as there is used ester oil, ether oil, or alkylbenzene oil, which is of a lower viscosity grade than is common refrigeration oil, the additive becomes lower in viscosity than mineral oil. As mentioned above, ester oil, ether oil, and alkylbenzene oil satisfy the first additive requirement.

Ester oil, ether oil, and alkylbenzene oil have boiling points higher than that of refrigerant. Even when refrigerant is present in a gaseous form in a refrigeration cycle, these oils assume a liquid form. Therefore, these oils satisfy the second additive requirement.

Ester oil, ether oil, and alkylbenzene oil are likely to dissolve refrigeration-oil degradation-inducing residuals (e.g., hydrate of iron chloride or copper chloride), thus satisfying the third additive requirement.

In a case where ester oil is used as refrigeration oil, no particular problem arises in terms of reliability even if an additive enters the compressor 1, so long as ester oil is used as an additive. Similarly, in a case where ether oil is used as refrigeration oil, no particular problem arises in terms of reliability even if an additive enters the compressor 1, so long as ether oil is used as an additive. Thus, in a case where a single substance is used as the refrigeration oil and the additive, no particular problem arises in the reliability of the compressor, regardless of the amount of additive entering the compressor 1.

In a case where ester oil is used as refrigeration oil and ether oil is used as an additive or where ether oil is used as refrigeration oil and ester oil is used as an additive, no particular problem arises in the reliability of the compressor if a small amount of additive enters the compressor 1.

In a case where ester or ether oil is used as refrigeration oil and alkylbenzene oil is used as an additive, no particular problem arises in the reliability of the compressor if a small amount of additive enters the compressor 1.

In these cases, these oils satisfy the fourth additive requirement.

Seventh Embodiment

Figure 20:
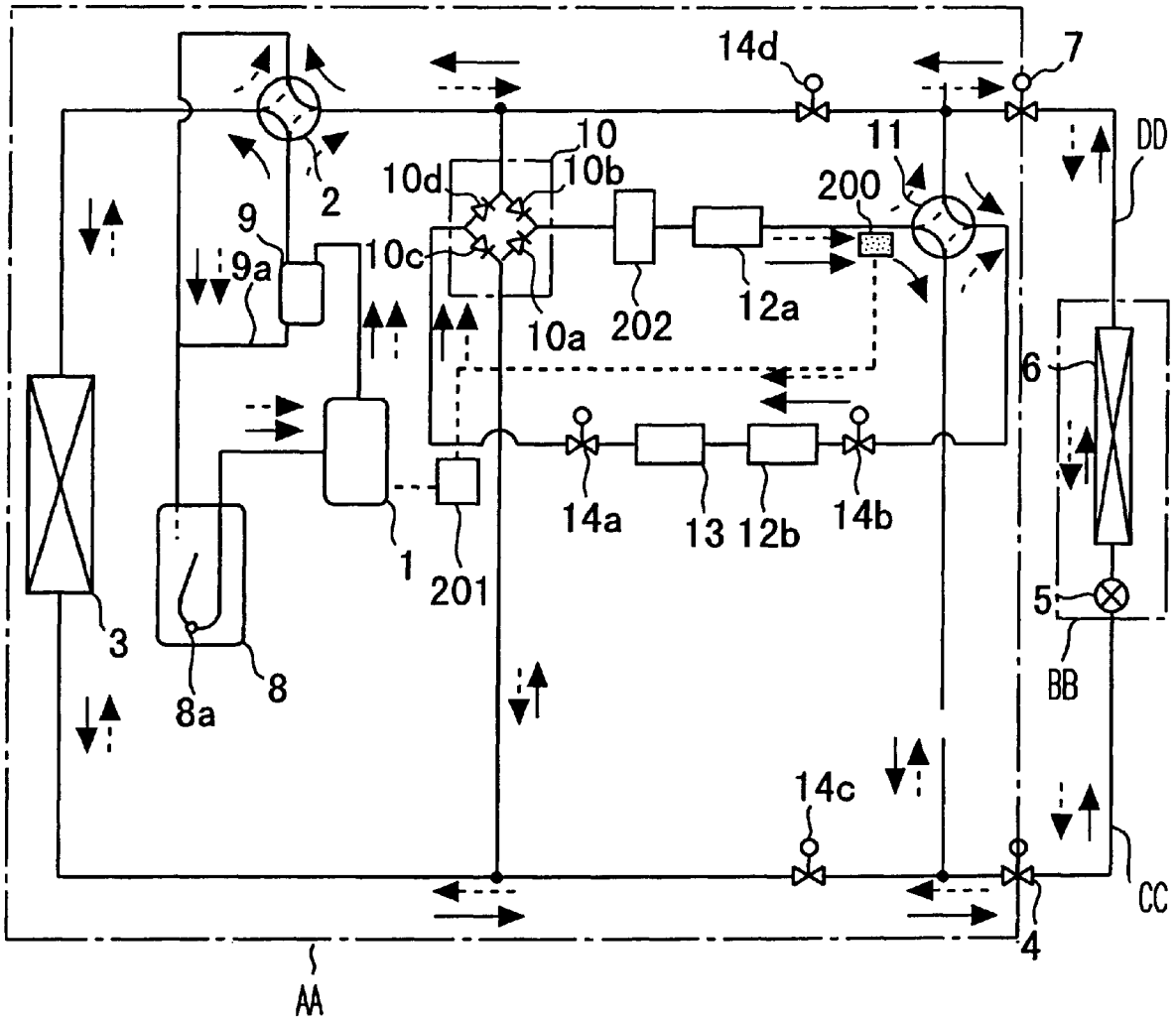
FIG. 20 is a schematic diagram showing a refrigerant circuit of a refrigeration system according to a seventh embodiment of the present invention.

FIG. 20 is a schematic diagram showing a refrigerant circuit of a refrigeration system according to a seventh embodiment of the present invention.

In FIG. 20, reference numeral 200 designates refrigerant temperature detection means disposed at a position in the pipe interconnecting the cooling means 12*a* and the second selector valve 11. The refrigerant temperature detection means 200 detects the temperature of refrigerant to be supplied to the first and second connecting pipes CC and DD during a cooling/cleaning operation and a heating/cleaning operation.

Reference numeral 201 designates refrigerant temperature control means which, upon receipt of a signal from the temperature detection means 200, controls the operation capacity of the compressor 1 and the temperature of the refrigerant discharged from the compressor 1.

Reference numeral 202 designates an additive injection device for injecting an additive for enhancing the effect of cleaning degradation-inducing residuals (e.g., hydrate of iron chloride or copper chloride) for a mineral oil and refrigeration-oil in the course of a cleaning operation. The additive injection device 202 is interposed between the first selector valve 10 and the cooling means 12*a*.

In other respects, the refrigeration system of the present embodiment is identical in configuration with that of the first embodiment shown in FIG. 10, and hence repetition of its detailed explanation is omitted here.

The refrigerant temperature control means 201 operates in the same manner as described in connection with FIG. 18, thus changing the operation capacity of the compressor 1 and controlling the temperature of the refrigerant discharged from the compressor 1.

Through a refrigerant temperature control operation, the temperature of the refrigerant to be supplied to the first and second connecting pipes CC and DD during a cleaning operation can be set to be higher than the predetermined first cleaning refrigerant temperature TC1. Consequently, the solubility in the refrigerant of the mineral oil remaining in the first and second connecting pipes CC and DD is increased, and the viscosity of the mineral oil is decreased, thus ensuring a strong cleaning effect. Repetition of detailed explanation is omitted here.

The structure and operation of the additive injection device 202 are the same as those of the additive injection device 202 of the sixth embodiment described by reference to FIGS. 18 and 19. Further, the additive is identical in function with that employed in the sixth embodiment. Hence, repetition of their explanations is omitted here for brevity.

Eighth Embodiment

Figure 21:
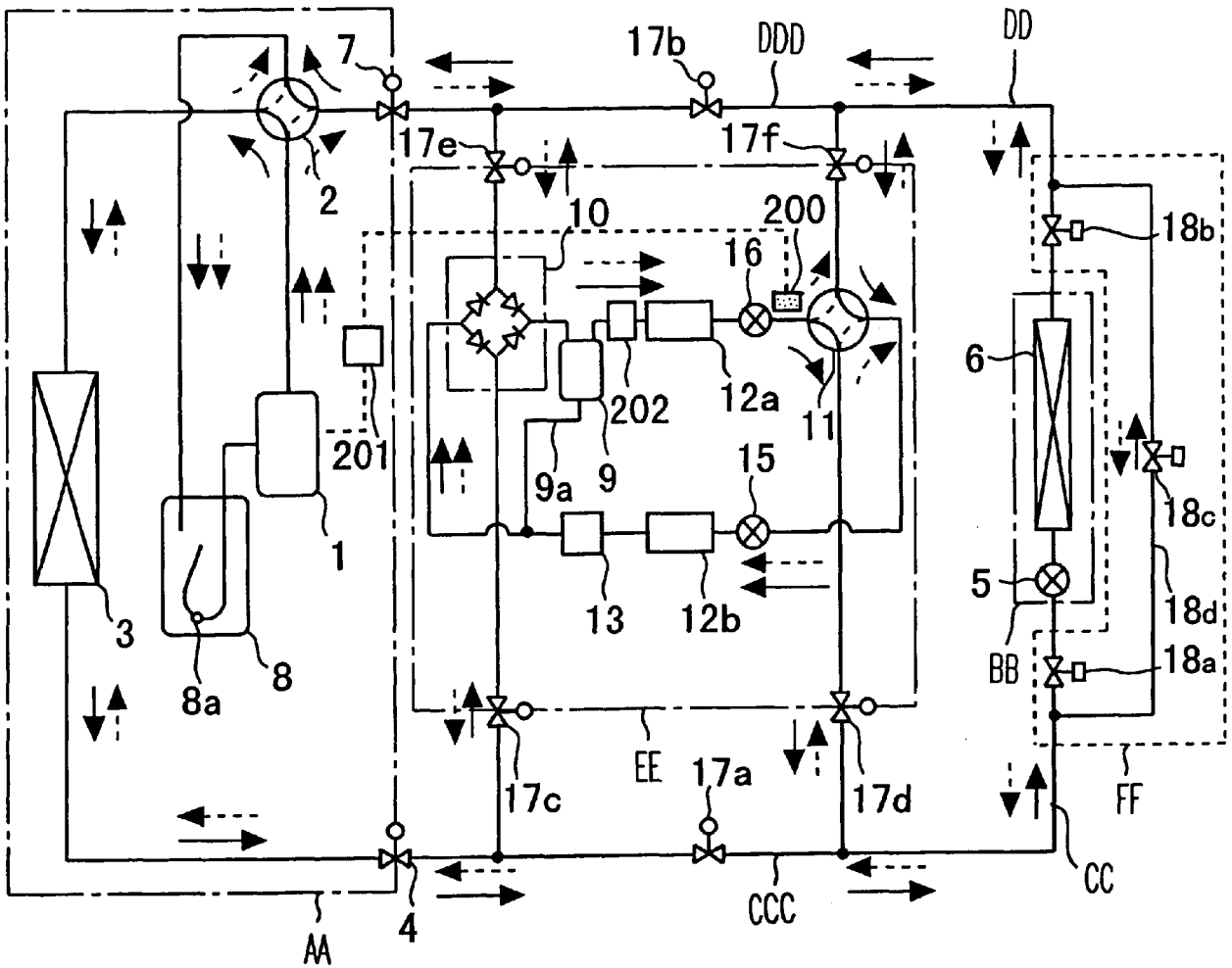
FIG. 21 is a schematic diagram showing a refrigerant circuit of a refrigeration system according to an eighth embodiment of the present invention.

FIG. 21 is a schematic diagram showing a refrigerant circuit of a refrigeration system according to an eighth embodiment of the present invention.

In FIG. 21, reference numeral 200 designates refrigerant temperature detection means disposed at a position in the pipe interconnecting the second flow rate control means 16 and the second selector valve 11. The refrigerant temperature detection means 200 detects the temperature of refrigerant to be supplied to the first and second connecting CC and DD during a cooling/cleaning operation and a heating/cleaning operation.

Reference numeral 201 designates refrigerant temperature control means which, upon receipt of a signal from the temperature detection means 200, controls the operation capacity of the compressor 1 and the temperature of the refrigerant discharged from the compressor 1.

Reference numeral 202 designates an additive injection device for injecting an additive for enhancing the effect of cleaning a mineral oil and refrigeration-oil degradation-inducing residuals (e.g., hydrate of iron chloride or copper chloride) in the course of a cleaning operation. The additive injection device 202 is interposed between the first selector valve 10 and the cooling means 12*a*.

In other respects, the refrigeration system of the present embodiment is identical in configuration with that of the fourth embodiment shown in FIG. 12, and hence repetition of its detailed explanation is omitted here.

The refrigerant temperature control means 201 operates in the same manner as described in connection with FIG. 18, thus changing the operation capacity of the compressor 1 and controlling the temperature of the refrigerant discharged from the compressor 1.

Through a refrigerant temperature control operation, the temperature of the refrigerant to be supplied to the first and second connecting pipes CC and DD during a cleaning operation can be set to be higher than the predetermined first cleaning refrigerant temperature TC1. Consequently, the solubility in the refrigerant of the mineral oil remaining in the first and second connecting pipes CC and DD is increased and the viscosity of the mineral oil is decreased, thus ensuring a strong cleaning effect. Repetition of detailed explanation is omitted here.

The structure and operation of the additive injection device 202 are the same as those of the additive injection device 202 of the fifth embodiment described by reference to FIGS. 14 through 17. Further, the additive is identical in function with that employed in the fifth embodiment. Hence, repetition of their explanations is omitted here for brevity.

Other Modifications

Various modifications of or addition of elements to the present invention are conceivable. Modifications of the present invention other than those mentioned previously will now be described.

In connection with a refrigeration system of another embodiment, there is provided a method of replacing CFC or HCFC with HFC in a refrigerant circuit comprising a compressor, a heat-source-unit-side heat exchanger, a user-side heat exchanger, a first connecting pipe interconnecting one end of the heat-source-unit-side heat exchanger and one end of the user-side heat exchanger, and a second connecting pipe interconnecting the other end of the user-side heat exchanger and the compressor, in which the pipe having the higher temperature from among the first and second connecting pipes after the final operation prior to replacement of refrigerant is taken as an upstream pipe and the other pipe having a lower temperature is taken as a downstream pipe, and new (i.e., post-replacement) HFC refrigerant is caused to flow from the upstream pipe to the downstream pipe after replacement of refrigerant while the compressor is used as a drive source, thereby improving a cleaning effect.

Preferably, new HFC refrigerant is caused to flow into the first and second connecting pipes without involvement of addition of the additive after replacement of refrigerant while the compressor is taken as a drive source. Next, the additive is injected to upstream portions of the first and second connecting pipes, and the additive is caused to flow through the first and second connecting pipes together with new HFC refrigerant while the compressor is taken as a drive source, thereby enhancing a cleaning effect to a much greater extent.

Preferably, new HFC refrigerant—which is caused to flow to the first and second connecting pipes after the additive has been injected to the first and second connecting pipes after replacement of refrigerant while the compressor is taken as a drive source—is brought into a gaseous single phase state, thereby improving a cleaning effect to a much greater extent.

Preferably, an additive recovery device is provided at a position, which is downstream of the first and second connecting pipes and is upstream of the compressor, thereby recovering the additive. Thereby, the cleaning effect of the refrigeration system can be improved to a much greater extent.

Preferably, a recovery device is provided at a position, which is downstream of the first and second connecting pipes and is upstream of the compressor, thereby recovering refrigeration oil before replacement of refrigerant as well as the additive. Thereby, the cleaning effect of the refrigeration system can be improved to a much greater extent.

Preferably, the refrigeration oil recovery device and the additive recovery device are arranged in parallel at a position which is downstream of the first and second connecting pipes and upstream of the compressor. A recovery device selector valve is provided at the entrance of the refrigeration oil recovery device and the entrance of the additive recovery device, so as to enable switchable connection of the first and second connecting pipes to the refrigeration oil recovery device or the additive recovery device. Before injection of an additive, the recovery device selector valve is switched to the refrigeration oil recovery switch. After injection of an additive, the recovery device selector switch is switched to the additive recovery device. As a result, the old (i.e., pre-replacement) refrigeration oil can be recovered by the refrigeration oil recovery device, and the additive can be recovered by the additive recovery device. Thus, the old refrigeration oil and the additive can be recovered separately from each other, thus improving a cleaning effect to a much greater extent.

Preferably, the additive injection device is placed at a position, which is upstream of the first and second connecting pipes and downstream of the compressor, and there is also provided additive migration means for causing the additive to migrate from the additive recovery device to the additive injection device. As a result, an additive is continuously injected into the first and second connecting pipes, thereby improving a cleaning effect to a much greater extent.

Preferably, the additive migration means is comprised by a pipe, which interconnects the additive injection device and the additive recovery device, and a pump provided at a position in the pipe, thereby improving a cleaning effect to a much greater extent.

Preferably, there is provided a pipe, which interconnects the additive injection device and the additive recovery device, and a check valve is provided at a position in the pipe for allowing flow of an additive from the additive recovery device to the additive injection device but inhibits reverse flow of the additive. The additive recovery device is located at a position higher than that of the additive injection device. Further, there is provided additive migration means. When depletion of the additive stored in the additive injection device is detected or a predetermined period of time has elapsed, the additive migration means brings the compressor into a resting state, thereby balancing the pressure of the additive injection device with the pressure of the additive recovery device; and causing the thus-recovered additive to migrate from the additive recovery device to the additive injection device under the force of gravity.

Preferably, a first additive injection/recovery device and a second additive injection/recovery device are disposed such that the first and second connecting pipes are interposed therebetween. There is provided an additive flow direction selector valve. During a period in which an additive is stored in the first additive injection/recovery device, the additive flow direction selector valve causes the new HFC refrigerant and the additive to flow in the sequence given from the compressor, the first additive injection/recovery device, the first and second connecting pipes, the second additive injection/recovery device, and the compressor while the compressor is used as a drive source. When the additive stored in the first additive injection/recovery device becomes depleted and the additive is accumulated in the second additive injection/recovery device, the additive flow direction selector causes the new HFC refrigerant and the additive to flow, in the sequence given from the compressor, through the second additive injection/recovery device, the first and second connecting pipes, the first additive/recovery device, and the compressor, while the compressor is taken as a drive source. Consequently, the cleaning effect of the refrigeration system can be improved to a much greater extent.

The present invention has been embodied as described above. The features and the advantages of the present invention as exemplified in the first through eighth embodiments may be summarized as follows.

According to one aspect, the present invention provides a method of replacing a refrigeration system using old refrigerant with another refrigeration system using new refrigerant, wherein the refrigeration system is caused to perform a cleaning operation by causing new refrigerant to flow into a first connecting pipe interconnecting a heat-source-unit-side heat exchanger and a user-side heat exchanger, and a second connecting pipe interconnecting the user-side heat exchanger and the compressor, in the sequence given, while the compressor is used as a drive source. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, the present invention provides a method of replacing a refrigeration system using old refrigerant with another refrigeration system using new refrigerant, wherein the refrigeration system is caused to perform a cleaning operation by causing new refrigerant to flow into a second connecting pipe interconnecting a user-side heat exchanger and a compressor, and a first connecting pipe interconnecting a heat-source-unit-side heat exchanger and the user-side heat exchanger, in the sequence given, while the compressor is used as a drive source. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, the present invention provides a method of replacing a refrigeration system using old refrigerant with another refrigeration system using new refrigerant, wherein the refrigeration system is made to perform a cleaning operation after replacement of refrigerant by causing new refrigerant to flow into a first connecting pipe interconnecting a heat-source-unit-side heat exchanger and a user-side heat exchanger, or into a second connecting pipe interconnecting a user-side heat exchanger and a compressor, such that the refrigerant flows from an upstream, larger-diameter pipe to a downstream, smaller-diameter pipe, while the compressor is used as a drive source. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, the present invention provides a method of replacing a refrigeration system using old refrigerant with another refrigeration system using new refrigerant, wherein the refrigeration system is caused to perform a cleaning operation after replacement of refrigerant, by causing new refrigerant to flow into a first connecting pipe interconnecting a heat-source-unit-side heat exchanger and a user-side heat exchanger, and a second connecting pipe interconnecting the user-side heat exchanger and the compressor, in the sequence given, or to flow in the reverse sequence, while the compressor is used as a drive source. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, the present invention provides a method of replacing a refrigeration system using old refrigerant with another refrigeration system using new refrigerant, wherein the refrigeration system is caused to perform a cleaning operation after replacement of refrigerant by causing new refrigerant to flow at a mass velocity greater than a predetermined value (preferably, 150 kg/s·cm$^2$) into a first connecting pipe interconnecting a heat-source-unit-side heat exchanger and a user-side heat exchanger, and a second connecting pipe interconnecting the user-side heat exchanger and the compressor, in the sequence given, while the compressor is used as a drive source. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, the present invention provides a method of replacing a refrigeration system using old refrigerant to another refrigeration system which uses new refrigerant and is provided with a plurality of user-side refrigerant circuits arranged in parallel, each refrigerant circuit comprising an indoor unit and a connecting pipe thereof, wherein the refrigeration system is cleaned by causing to flow new refrigerant by sequentially selecting a plurality of user-side refrigerant circuits, while the compressor is used as a drive source. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, the present invention provides a method of replacing a refrigeration system using old refrigerant with another refrigeration system using new refrigerant, wherein the refrigeration system is made to perform a cleaning operation after replacement of refrigerant, by causing new (i.e., post-replacement) refrigerant, which has been heated to a predetermined temperature or higher, to flow into a first connecting pipe interconnecting a heat-source-unit-side heat exchanger and a user-side heat exchanger, and a second connecting pipe interconnecting the user-side heat exchanger and the compressor, in the sequence given, while the compressor is used as a drive source. The predetermined temperature is preferably set to be the temperature of extraneous matter included in the refrigerant, a temperature at which extraneous matter included in refrigerant begins to dissolve into new refrigerant, a temperature at which the viscosity of residual refrigeration oil becomes roughly the same as that of new refrigeration oil, or a temperature higher than these temperatures. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, the present invention provides a method of replacing a refrigeration system using old refrigerant with another refrigeration system using new refrigerant, wherein the refrigeration system is caused to perform a cleaning operation after replacement of refrigerant, by means of injecting an additive-which is likely to dissolve old (i.e., pre-replacement) refrigeration oil and has a viscosity equal to or lower than that of the refrigeration oil—to an upstream position relative to a first connecting pipe interconnecting a heat-source-unit-side heat exchanger and a user-side heat exchanger and a second connecting pipe interconnecting the user-side heat exchanger and the compressor, and by means of causing new refrigerant to flow through the first and second connecting pipes together with the additive, while the compressor is used as a drive source. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, the present invention provides a method of replacing a refrigeration system using old refrigerant with another refrigeration system using new refrigerant, wherein the refrigeration system is made to perform a cleaning operation after replacement of refrigerant, by means of injecting an additive—which is likely to dissolve old refrigeration oil and is likely to be dissolved in new refrigerant—to an upstream position relative to a first connecting pipe interconnecting a heat-source-unit-side heat exchanger and a user-side heat exchanger and a second connecting pipe interconnecting the user-side heat exchanger and the compressor, and by means of causing new refrigerant to flow through the first and second connecting pipes together with the additive, while the compressor is used as a drive source. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, the present invention provides a method of replacing a refrigeration system using old refrigerant with another refrigeration system using new refrigerant, wherein the refrigeration system is caused to perform a cleaning operation after replacement of refrigerant, by means of injecting new refrigeration oil, as an additive, to an upstream position relative to a first connecting pipe interconnecting a heat-source-unit-side heat exchanger and a user-side heat exchanger and a second connecting pipe interconnecting the user-side heat exchanger and the compressor, and by means of causing the new refrigeration oil (hereinafter often referred to as a post-replacement refrigeration oil) to flow into the first and second connecting pipes together with the new refrigerant, while the compressor is used as a drive source. As a result, extraneous matter remaining in the connecting pipes, such as the old refrigerant, a mineral oil, and a deteriorated mineral oil, is separated and trapped, thereby enabling replacement of old refrigerant with new, environmentally-friendly refrigerant.

According to another aspect, in the method of replacing a refrigeration system of the present invention, an existing heat source unit of an existing refrigeration system is replaced with a new heat source unit comprising an oil separator and extraneous-matter trapping means, and existing refrigerant can be replaced with new refrigerant.

Thus, the existing refrigeration system using old refrigerant can be updated to a new refrigeration system using new refrigerant.

According to another aspect, in the method of replacing a refrigeration system of the present invention, the refrigeration oil separated by the oil separator and the refrigerant diverted from the refrigerant circuit are merged into a single stream, and the thus-merged stream is caused to flow into the extraneous-matter trapping means, where extraneous matter included in refrigerant is trapped. As a result, residual extraneous matter included in refrigerant can be more efficiently separated and trapped.

According to another aspect, in the method of replacing a refrigeration system of the present invention, an existing heat source unit of an existing refrigeration system is replaced with a new heat source unit comprising an oil separator and extraneous-matter trapping means, and existing refrigerant can be replaced with new refrigerant. After replacement of refrigerant, the refrigeration system performs a cleaning operation through use of the new refrigerant.

As a result, the refrigeration system can be effectively cleaned through use of new refrigerant.

According to another aspect, in the method of replacing a refrigeration system of the present invention, an existing heat source unit of an existing refrigeration system is replaced with a new heat source unit comprising an oil separator and extraneous-matter trapping means, and existing refrigerant can be replaced with new refrigerant through reuse of an existing indoor unit and existing refrigerant pipes.

As a result, the existing refrigeration system using old refrigerant can be updated to a new refrigeration system using new refrigerant by utilization of an existing indoor unit and existing refrigerant pipes, through replacement of only the heat source unit.

Ninth Embodiment

Figure 22:
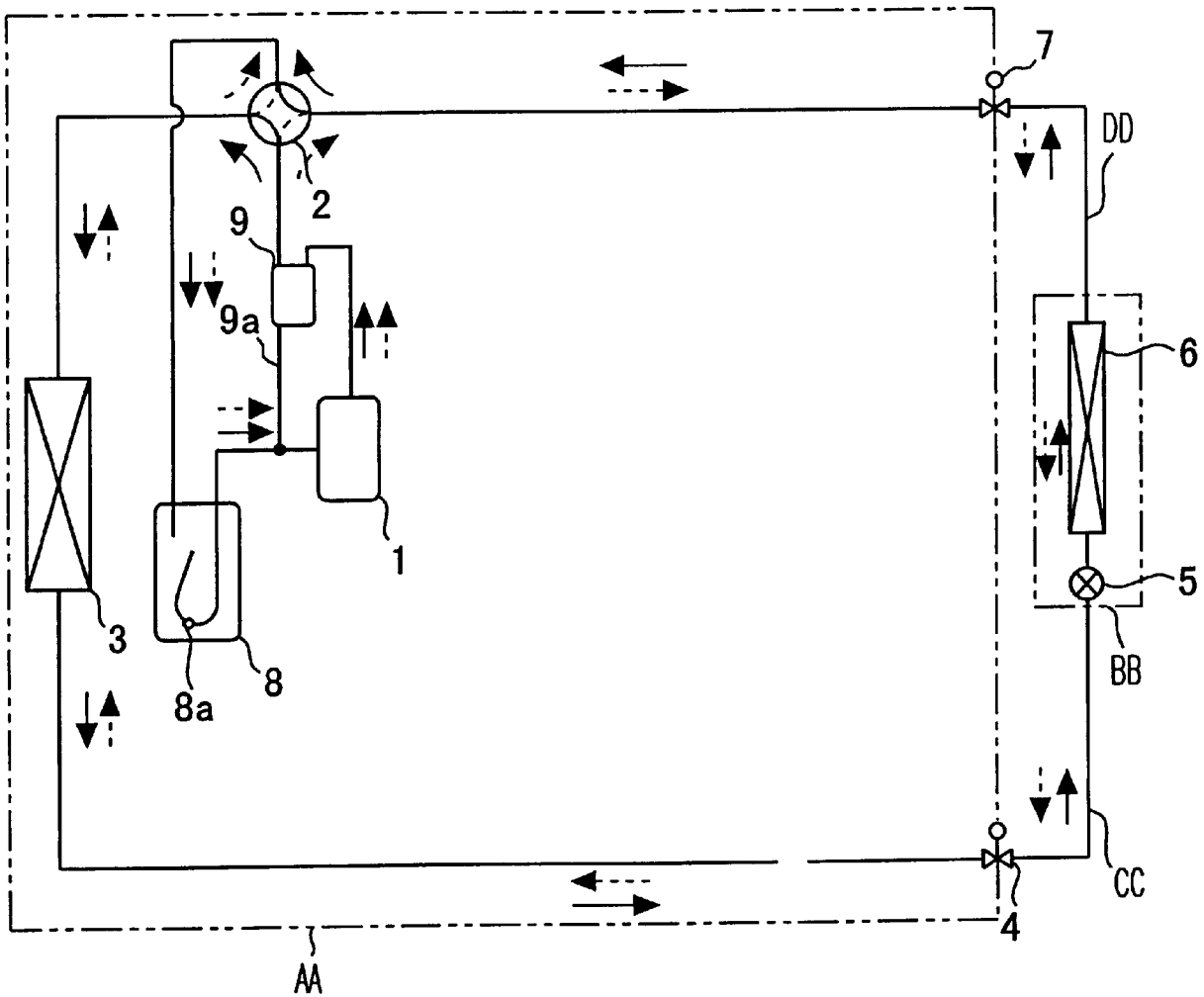
FIG. 22 is a schematic diagram showing a refrigerant circuit of an air conditioner, as an example refrigeration system according to a ninth embodiment of the present invention.

FIG. 22 is a schematic diagram showing a refrigerant circuit of an air conditioner as an example refrigeration system (or a refrigeration air conditioner) according to a ninth embodiment of the present invention.

In FIG. 22, reference symbol AA designates a heat source unit accommodating a compressor 1, a four-way valve 2, a heat exchanger 3 on a heat-source-unit-side, a first control valve 4, a second control valve 7, an accumulator 8, and an oil separator 9.

The oil separator 9 is provided in an outlet pipe of the compressor 1, and separates a refrigeration oil from a refrigerant which is discharged from the compressor 1. Reference numeral 9*a* designates a bypass channel extending from the bottom of the oil separator 9 to an inlet pipe of the compressor 1. An oil return hole 8*a* is formed in a lower portion of a U-shaped outlet pipe of the accumulator 8.

Reference symbol BB designates an indoor unit equipped with a first flow rate regulator 5*a* (corresponding to a user-side restrictor) and a user-side heat exchanger 6.

Reference symbol CC designates a first connecting pipe whose one end is connected to the heat-source-unit-side heat exchanger 3 via the first control valve 4 and whose other end is connected to a second flow rate regulator 5.

Reference symbol DD designates a second connecting pipe whose one end is connected to the four-way valve 2 via the second control valve 7 and whose other end is connected to the user-side heat exchanger 6.

The heat source unit AA and the indoor unit BB are remotely separated from each other and interconnected via the first connecting pipe CC and the second connecting pipe DD, thus constituting a refrigeration cycle.

The refrigeration system uses, as refrigerant (hereinafter also called a "new refrigerant," as required), R407C, which is an HFC (hydrofluorocarbon), and corresponds to non-azeotropic mixture refrigerant. Further, the refrigeration system uses, as refrigeration oil, alkylbenzene oil—which has very low mutual solubility with respect to R407C and has a density lower than that of liquid refrigerant.

Next will be described procedures for replacing a deteriorated refrigeration system using a CFC (chlorofluorocarbon) or HCFC (hydrofluorocarbon) (which are hereinafter called "old refrigerant," as required) with a refrigeration system using an HFC (new refrigerant). Old refrigerant CFC or HCFC is recovered from the existing refrigeration system, and the heat source unit AA is replaced with a new heat source unit AA as shown in FIG. 22. The first connecting pipe CC, the second connecting pipe DD, and the indoor unit BB used for the refrigeration system using the old HCFC refrigerant are reused. Since the new heat source unit AA has been charged with new refrigerant HFC in advance, the refrigeration system is evacuated while the first control valve 4 and the second control valve 7 remain closed and the indoor unit BB, the first connecting pipe CC, and the second connecting pipe DD are connected to the refrigeration system. Subsequently, the first control valve 4 and the second control valve 7 are opened, and the refrigeration system is additionally charged with an HFC. The refrigeration system performs an ordinary cooling operation without involvement of carrying out a cleaning operation.

An ordinary air-conditioning operation will now be described by reference to FIG. 22. Solid arrows in the drawing depict the flow of a refrigerant during a cooling operation of the refrigeration system, and broken arrows depict the flow of a refrigerant during a heating operation.

First will be described the flow of a refrigerant during a cooling operation. The refrigerant is compressed by the compressor 1 to become a hot, high-temperature gas; is discharged from the compressor 1 together with a refrigeration oil, i.e., alkylbenzene oil; and enters the oil separator 9. In the oil separator 9, the alkylbenzene oil is separated from the gaseous refrigerant, and a trace amount of alkylbenzene oil and the gaseous refrigerant flow, via the four-way valve 2, into the heat-source-unit-side heat exchanger 3, where the gaseous refrigerant exchanges heat with a heat source medium, such as water or air, and is condensed. The thus-condensed refrigerant flows into the first connecting pipe CC via the first control valve 4. The liquid refrigerant flows into the first flow rate regulator 5, where the liquid refrigerant is decompressed to a low pressure so as to assume a low-pressure, two-phase state. The refrigerant then exchanges heat with a user-side medium, such as air, in the user-side heat exchanger 6 and evaporates. The thus-evaporated refrigerant flows into the second connecting pipe DD and then returns to the compressor 1 via the second control valve 7, the four-way valve 2, and the accumulator 8.

Meanwhile, the alkylbenzene oil which has been separated from the gaseous refrigerant by the oil separator 9 returns to the compressor 1 via the bypass channel 9*a*.

Next will be described the flow of a refrigerant during a heating operation of the refrigeration system. The refrigerant is compressed by the compressor 1 to become a hot, high-pressure gas; is discharged from the compressor 1 together with alkylbenzene oil; and enters the oil separator 9, where the alkylbenzene oil is separated from the gaseous refrigerant. A trace amount of alkylbenzene oil and the gaseous refrigerant flow into the second connecting pipe DD via the four-way valve 2 and the second control valve 7. The gaseous refrigerant flows into the user-side heat exchanger 6, where the liquid refrigerant exchanges heat with a user-side medium, such as air, in the user-side heat exchanger 6 and evaporates. The thus-evaporated refrigerant flows into flows into the first flow rate regulator 5, where the refrigerant is decompressed so as to assume a low-pressure, two-phase state. The thus-decompressed refrigerant flows into the first connecting pipe CC. Subsequently, the refrigerant flows via the first control valve 4 into the heat-source-unit-side heat exchanger 3, where the refrigerant exchanges heat with heat source medium, such as air or water, and evaporates. The thus-evaporated refrigerant returns to the compressor 1 via the four-way valve 2 and the accumulator 8.

Meanwhile, the alkylbenzene oil which has been separated from the gaseous refrigerant by the oil separator 9 returns to the compressor 1 via the bypass channel 9*a*.

The behavior of alkylbenzene oil in the refrigeration cycle will next be described.

Figure 23:
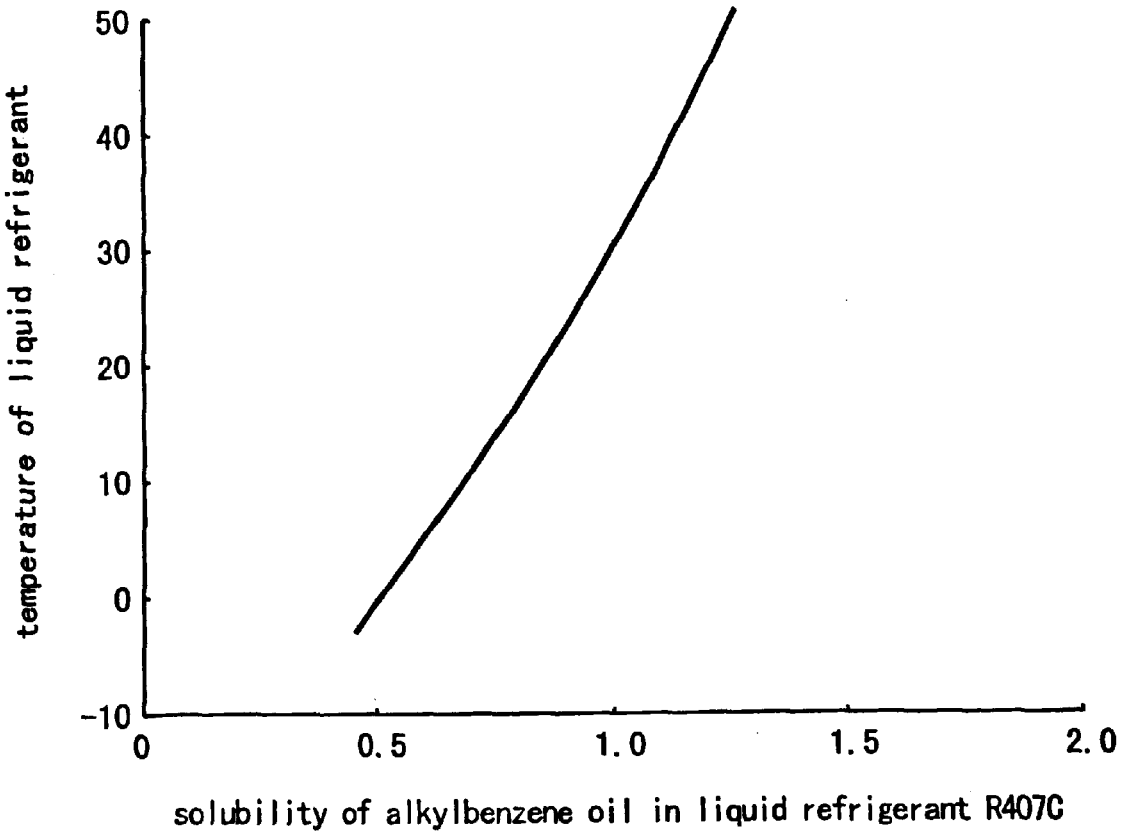
FIG. 23 is a graph showing the solubility of an alkylbenzene oil in R407C liquid refrigerant.

FIG. 23 shows the measurement result of a solubility of alkylbenzene oil in new liquid refrigerant R407C at a mass ratio, i.e. a mass of alkylbenzene oil/(mass of alkylbenzene oil+the amount of refrigerant), at which alkylbenzene oil added to the refrigerant is separated from the refrigerant and starts changing to a whitish liquid. The vertical axis represents the temperature of liquid refrigerant, and the horizontal axis represents the solubility of alkylbenzene oil in R407C refrigerant. As can be seen from the drawing, alkylbenzene oil is slightly soluble in R407C liquid refrigerant, and the solubility of alkylbenzene oil lowers with a decrease in the temperature of the liquid refrigerant. In a case where the amount of alkylbenzene oil, which has not been separated by the oil separator 9 and is discharged from the compressor 1 to flow into the four-way valve 2, is lower than its solubility, then all of the alkylbenzene oil dissolves into the liquid refrigerant of a single liquid phase.

Given that the flow ratio of a trace amount of alkylbenzene oil which has been discharged from the compressor 1, not being separated by the oil separator 9, and flows to the four-way valve 2 is taken as $\alpha$, the solubility of alkylbenzene oil in the liquid refrigerant in the accumulator 8 is taken as $\beta$, an inflow/outflow dryness of the accumulator 8 is taken as Xr, and the mass ratio of alkylbenzene oil in the liquid refrigerant in the accumulator 8 is taken as $\gamma$, there is derived $\gamma=\alpha/\{\alpha+(1-Xr)\}$. If the value of $\gamma$ is smaller than $\beta$; that is, $\alpha<\beta\cdot((1-Xr)/(1-\beta)$, alkylbenzene oil dissolves in the liquid refrigerant in the accumulator 8 and does not remain in the accumulator 8.

Figure 24:
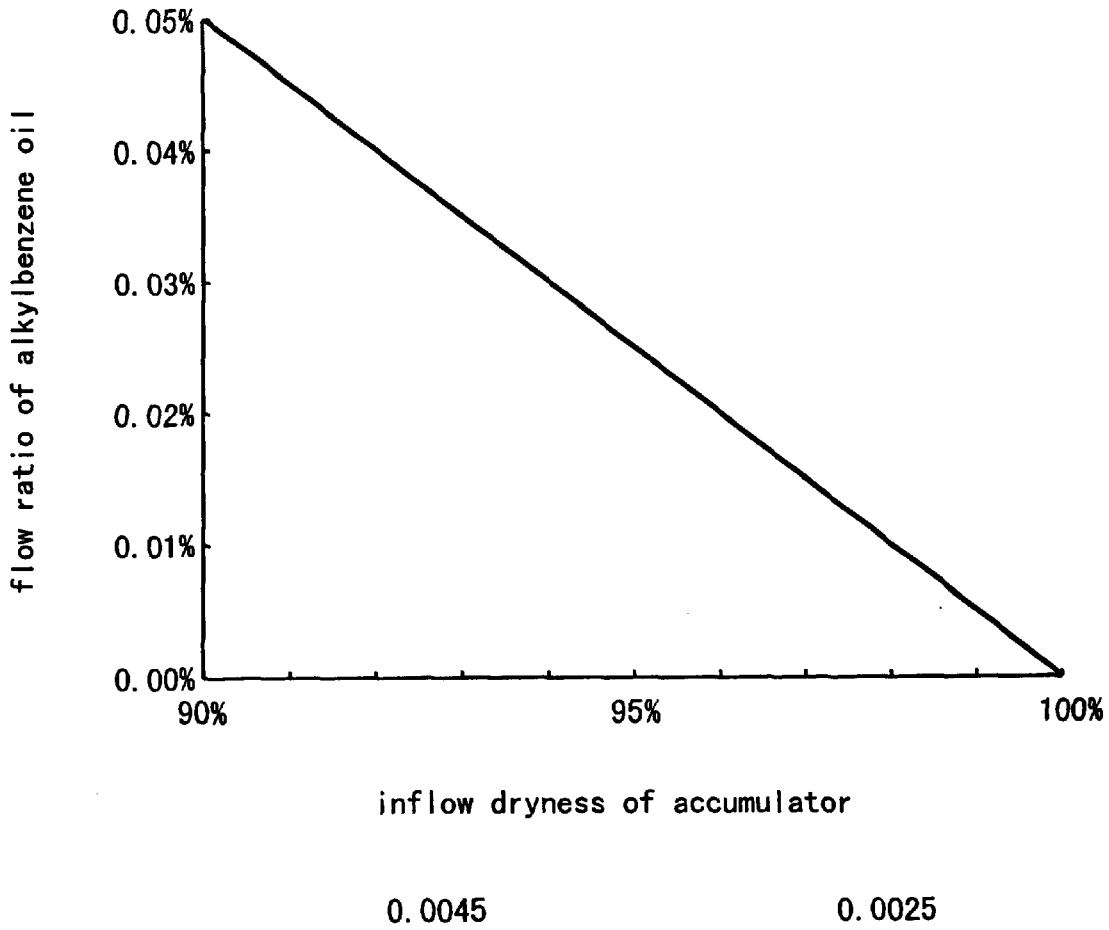
FIG. 24 is a graph showing the dryness of an accumulator and the critical flux ratio of the alkylbenzene oil.

FIG. 24 is a graph for describing the reason for this. The vertical axis represents the flow ratio a of a trace amount of alkylbenzene oil which has not been separated by the oil separator 9 and flows to the four-way valve 2, and the horizontal axis represents the inflow dryness Xr of the accumulator 8. A solid line in the graph represents the limit line at which alkylbenzene oil dissolves in the liquid refrigerant of the accumulator 8. If the separation performance of the oil separator 9 is improved such that the mass ratio $\alpha$ of alkylbenzene oil falls within a range below the solid line, alkylbenzene oil does not remain in the accumulator 8. As can be seen from the drawing, as the dryness Xr approaches one, the mass ratio a must be made as small as possible. However, the liquid return hole 8*a* is formed in the accumulator 8. So long as a liquid level is formed in the accumulator 8, the value of Xr assumes a value of 98% or less. In this case, so long as the oil separator 9 achieves $\alpha<0.01\%$, alkylbenzene oil does not remain in the accumulator 8.

The oil separator 9 has already been described by reference to FIGS. 5 and 6. In the regions of the refrigeration cycle where gas and a liquid coexist (hereinafter referred to as "gas-liquid coexisting regions"), the accumulator 8 has the lowest temperature and the highest dryness, and hence alkylbenzene oil does not remain in any other gas-liquid coexisting regions.

As mentioned above, even when alkylbenzene oil is used, the refrigeration oil stored in the compressor 1 is not depleted, thus ensuring satisfactory lubrication of the compressor 1.

In the first and second connecting pipes CC and DD used with the air conditioner using old refrigerant CFC or HCFC and in the indoor unit BB, a mineral oil serving as refrigeration oil of the air conditioner using CFC or HCFC, or CFC/HCFC, or a deteriorated refrigeration oil remains as sludge (all of these substances will be hereinafter generically referred to as "residual extraneous matter").

In the present invention, after replacement of the heat source unit AA and additional charging of new HFC refrigerant into the air conditioner, the air conditioner starts a normal air-conditioning operation. Accordingly, the residual extraneous matter enters the heat source unit AA. In the case of ester oil or ether oil, if residual extraneous matter enters the heat source unit AA, the mutual solubility with HFC refrigerant is lost or deteriorated. Alkylbenzene oil originally has very low mutual solubility with respect to HFC, and the density of alkylbenzene oil is lower than that of liquid refrigerant. Even when the residual extraneous matter, particularly a residual mineral oil, is mixed into alkylbenzene oil, no substantial change arises in the properties of alkylbenzene oil. The refrigeration oil stored in the compressor 1 is not depleted, thus ensuring satisfactory lubrication.

Further, an alkylbenzene oil is more stable than a mineral oil even with respect to the residual extraneous matter, particularly chlorine compounds. Therefore, there is no generation of sludge, which would otherwise be caused by deterioration of alkylbenzene oil, and there is little chance of sludge clogging a refrigerant circuit component. Particularly, in the case of reuse of the indoor unit BB, complete removal of the residual extraneous matter cannot be achieved by means of cleaning. Therefore, use of refrigeration oil which does not have mutual solubility to HFC refrigerant or has very low mutual solubility is effective for reuse of the indoor unit BB.

A value resulting from division of the maximum amount of fluid retained by the accumulator 8 by the amount of fluid returned from the accumulator 8 is set to exceed a value resulting from division of the amount of refrigeration oil retained by the compressor 1 by the rate at which the compressor 1 discharges refrigeration oil. If the refrigeration oil floats on the liquid refrigerant stored in the accumulator 8, no fluid flows into the accumulator 8 (i.e., the accumulator 8 is in an overheating state) after the fluid stored in the accumulator 8 has attained the maximum level. When the liquid refrigerant has been removed by means of the fluid return function of the accumulator 8, the refrigeration oil stored in the compressor 1 becomes depleted.

However, in the present invention, the refrigeration oil is dissolved in the liquid refrigerant stored in the accumulator 8 without floating, and hence the refrigeration oil returns to the compressor 1 together with the liquid refrigerant, thereby preventing depletion of the refrigeration oil in the compressor 1. Even when residual extraneous matter, particularly a residual mineral oil, is mixed into the refrigeration oil, no substantial change arises in the properties of the refrigeration oil, and hence the refrigeration oil stored in the compressor 1 is not depleted, thus ensuring satisfactory lubrication of the compressor 1.

An alkylbenzene oil is more stable than a mineral oil even with respect to the residual extraneous matter, particularly chlorine compounds. Therefore, there is no generation of sludge, which would otherwise be caused by deterioration of alkylbenzene oil, and there is little chance of sludge clogging a refrigerant circuit component. Consequently, reuse of the first and second connecting pipes CC and DD and reuse of the indoor unit BB are possible without involvement of a cleaning operation.

The amount of refrigeration oil circulating through the air conditioner is set to be equal to or smaller than the amount corresponding to the solubility of liquid refrigerant at the minimum temperature of the air conditioner, and the mass ratio of refrigeration oil to a liquid refrigerant in the gas-liquid coexisting areas of the refrigeration cycle is set to be equal to or lower than the solubility of liquid refrigerant. As a result, even in the case of use of refrigeration oil which has no mutual solubility with respect to HFC or has very low mutual solubility, the refrigeration oil does not remain in the refrigeration cycle. Even when residual extraneous matter, particularly a residual mineral oil, is mixed into the refrigeration oil, no substantial change arises in the properties of the refrigeration oil. Further, use of the oil separator enables control of the amount of refrigeration oil stored in the liquid refrigerant so as to become equal to or lower than the amount corresponding to the solubility of refrigeration oil to the liquid refrigerant in individual sections of the refrigeration cycle.

As mentioned above, use of refrigeration oil which has no mutual solubility with respect to HFC or has very low mutual solubility enables replacement of a deteriorated air conditioner using old refrigerant CFC or HCFC with another air conditioner using new refrigerant HFC, with involvement of replacement of the heat source unit AA with a new one and without involvement of replacement of the first and second connecting pipes CC and DD and the indoor unit BB. In contrast with the conventional first cleaning method, the method of reusing existing pipes and reusing the indoor unit according to the present invention eliminates a necessity of cleaning the air conditioner with a specifically-designed cleaning solvent (HCFC 141b or HCFC 225) through use of cleaning equipment. Therefore, the method completely eliminates the possibility of depletion of the ozone layer, the use of a flammable and toxic substance, a fear of existence of residual cleaning solvent, and a necessity for recovery of a cleaning solvent.

In contrast with the conventional second cleaning method, the method of the present invention eliminates a necessity of operating the air conditioner three times repeatedly for cleaning, as well as a necessity of replacing an HFC refrigerant and HFC refrigeration oil with new refrigerant and oil three times. The method of the present invention involves use of only the amount of HFC refrigerant and HFC refrigeration oil required for one air conditioner, thus yielding an advantage in terms of cost and environmental cleanliness. Further, the method completely eliminates a necessity of managing refrigeration oil for replacement purpose and the chance of excess or insufficient refrigeration oil. Further, there is no chance of the HFC refrigeration oil being incompatible with the HFC refrigerant or being deteriorated.

The ninth embodiment has described a case where alkylbenzene oil is used as a refrigeration oil. However, in the case of use of new HFC refrigerant, there may be used a refrigeration oil whose principal constituent includes at least one substance selected from the group consisting of alkylbenzene, a polyalphaolefine, paraffin-based oil, a naphthene-based oil, a polyphenylether oil, polyphenythioether, and chlorinated paraffin. Even in such a case, there can be yielded the same advantage as that yielded when alkylbenzene oil is used as a refrigeration oil. The only essential requirement is selective use of a refrigeration oil which has no mutual solubility with respect to new refrigerant or has low small mutual solubility.

Further, the present embodiment has described an example in which one indoor unit BB is connected to the air conditioner. Needless to say, the present invention yields the same advantage as that yielded in the present embodiment even when applied to an air conditioner comprising a plurality of indoor units BB connected in series or parallel.

As is obvious, the same advantage is yielded even when a thermal storage ice bath or a thermal storage water bath (including hot water) is connected in parallel or series with the heat-source-unit-side heat exchanger 3.

The same advantage as that yielded by the present embodiment is not limited to the air conditioner; the same advantage as in the previously-described embodiment is yielded so long as a thermo-compression refrigeration application system comprises a unit incorporating a heat-source-unit-side heat exchanger and another unit incorporating a user-side heat exchanger, the units being remotely spaced away from each other.

Tenth Embodiment

Figure 25:
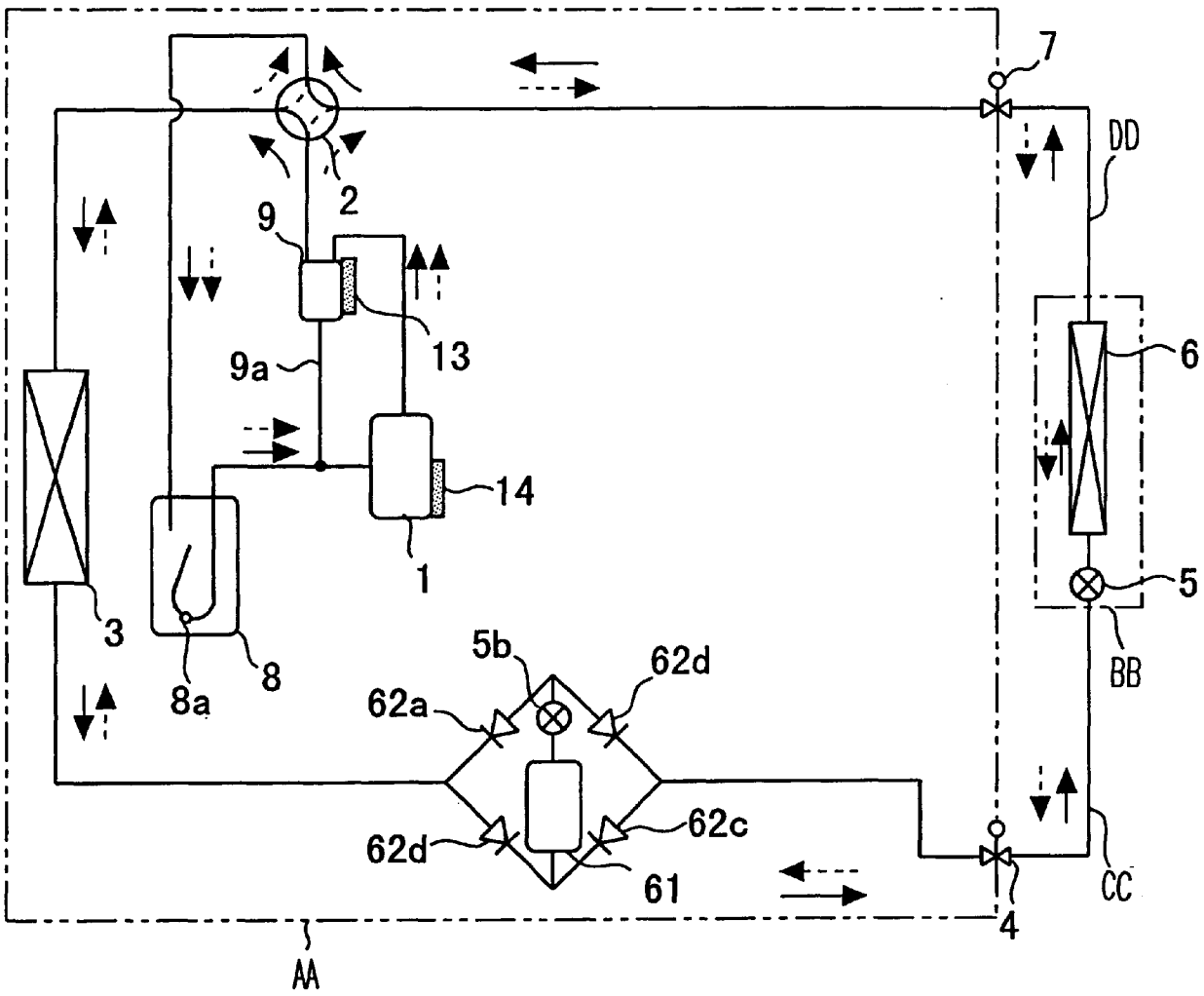
FIG. 25 is a schematic diagram showing a refrigerant circuit of an air conditioner, as an example refrigeration system according to a tenth embodiment of the present invention.

FIG. 25 is a schematic diagram showing a refrigerant circuit of an air conditioner, as an example air conditioner (or a refrigeration air conditioner) according to a tenth embodiment of the present invention. In FIG. 25, reference symbols AA to DD, reference numerals 1 through 9, and reference numerals 8*a* and 9*a* are the same as those employed in the ninth embodiment, and hence repetition of their detailed explanations is omitted here. The air conditioner uses, as refrigerant, R407C, which is an HFC and corresponds to non-azeotropic mixture refrigerant. For example, alkylbenzene oil—which has very low mutual solubility with respect to R407C and has a density lower than that of liquid refrigerant—is used as refrigeration oil.

In FIG. 25, reference numeral 61 designates a sump (a container for storing excessive refrigerant) provided between the heat-source-unit-side heat exchanger 3 and the first control valve 4 and is arranged so as to cause refrigerant to flow in one direction, regardless of whether a cooling operation or a heating operation is performed, by means of a selector valve consisting of check valves 62*a*, 62*b*, 62*c*, and 62*d*. Reference numeral 5*b* designates a second flow rate regulator (i.e., a heat-source-unit-side diaphragm) disposed at an outlet pipe of the sump 61.

Reference numeral 13 designates a liquid back flow prevention mechanism (corresponding to liquid back flow prevention means); and 14 designates heating means provided in the compressor 1.

The compressor 1 designates a compressor of high-pressure shell type.

Next will be described procedures for replacing a deteriorated air conditioner using a CFC (chlorofluorocarbon) or HCFC (hydrofluorocarbon) (which are hereinafter called "old refrigerant," as required) with a air conditioner using a new refrigerant HFC. Old refrigerant CFC or HCFC is recovered from the existing air conditioner, and the heat source unit AA is replaced with a new heat source unit AA as shown in FIG. 25. The first connecting pipe CC, the second connecting pipe DD, and the indoor unit BB used for the air conditioner using the old HCFC refrigerant are reused. Since the new heat source unit AA has been charged with new refrigerant HFC in advance, the air conditioner is evacuated while the first control valve 4 and the second control valve 7 remain closed and while the indoor unit BB, the first connecting pipe CC, and the second connecting pipe DD are connected to the air conditioner. Subsequently, the first control valve 4 and the second control valve 7 are opened, and the air conditioner is additionally charged with an HFC. The air conditioner performs an ordinary cooling operation without involvement of carrying out of a cleaning operation.

An ordinary air conditioning operation will now be described by reference to FIG. 25. Solid arrows in the drawing depict the flow of a refrigerant during a cooling operation of the air conditioner, and broken arrows depict the flow of a refrigerant during a heating operation.

First will be described the flow of a refrigerant during a cooling operation. The refrigerant is compressed by the compressor 1 to become a hot, high-temperature gas; is discharged from the compressor 1 together with alkylbenzene oil; and enters the oil separator 9. In the oil separator 9, the alkylbenzene oil is separated from the gaseous refrigerant, and the gaseous refrigerant containing a trace amount of alkylbenzene oil flows, via the four-way valve 2, into the heat-source-unit-side heat exchanger 3, where the gaseous refrigerant exchanges heat with a heat source medium, such as water or air, and is condensed. The thus-condensed refrigerant flows into the first connecting pipe CC, via the check valve 62*b*, the sump 61, the second flow rate regulator 5*b* in substantially fully-opened state, the check valve 62*d*, and the first control valve 4. Subsequently, the liquid refrigerant flows into the first flow rate regulator 5, where the liquid refrigerant is decompressed to a low pressure so as to assume a low-pressure, two-phase state. The refrigerant then exchanges heat with a user-side medium, such as air, in the user-side heat exchanger 6 and evaporates. The thus-evaporated refrigerant flows into the second connecting pipe DD and then returns to the compressor 1 via the second control valve 7, the four-way valve 2, and the accumulator 8.

Meanwhile, the alkylbenzene oil which has been separated from the gaseous refrigerant by the oil separator 9 returns to the compressor 1 via the bypass channel 9*a*.

Next will be described the flow of a refrigerant during a heating operation of the air conditioner. The refrigerant is compressed by the compressor 1 to become a hot, high-pressure gas; is discharged from the compressor 1 together with alkylbenzene oil; and enters the oil separator 9, where the alkylbenzene oil is separated from the gaseous refrigerant. A trace amount of alkylbenzene oil and the gaseous refrigerant flow into the second connecting pipe DD via the four-way valve 2 and the second control valve 7. The gaseous refrigerant flows into the user-side heat exchanger 6, where the liquid refrigerant exchanges heat with a user-side medium, such as air, and evaporates. The thus-evaporated refrigerant flows into the first flow rate regulator 5, where the refrigerant is slightly decompressed. The thus-decompressed refrigerant flows into the first connecting pipe CC. Subsequently, the refrigerant flows via the first control valve 4, the check valve 62*c*, and the sump 61 into second flow rate regulator 5*b*, where the refrigerant is decompressed to a low-pressure two-phase state and flows into the heat-source-unit-side heat exchanger 3. In the heat-source-unit-side heat exchanger 3, the refrigerant exchanges heat with heat source medium, such as air or water, evaporates. The thus-evaporated refrigerant returns to the compressor 1 via the four-way valve 2 and the accumulator 8.

Meanwhile, the alkylbenzene oil which has been separated from the gaseous refrigerant by the oil separator 9 returns to the compressor 1 via the bypass channel 9*a*.

Since the behavior of alkylbenzene oil in the refrigeration cycle and the oil separator 9 is the same as that described in connection with the ninth embodiment, repetition of explanation is omitted here.

The behavior of alkylbenzene oil in and around the oil separator 9 at a low ambient temperature will now be described. In the case of a low ambient temperature, the outlet pipe or the oil separator 9 still remains cold during, particularly, a certain period of time after the compressor 1 has been started up. Some of gaseous refrigerant discharged from the compressor 1 is cooled by the outlet pipe or the oil separator 9 and is condensed. In the oil separator 9, the liquid refrigerant and alkylbenzene oil are mixed together. However, alkylbenzene oil exists in an appropriately large amount, and hence the liquid refrigerant and alkylbenzene oil do not dissolve into each other but remain separated from each other. If the liquid return capacity of the bypass channel 9*a* is set to be sufficient for returning the alkylbenzene oil, the liquid refrigerant and alkylbenzene oil coexist while the alkylbenzene oil is floating on the liquid refrigerant in the oil separator 9. Only the liquid solvent is supplied to the bypass channel 9*a* extending from the bottom of the oil separator 9, so that alkylbenzene oil does not return to the compressor 1 for a while. If the liquid return capacity of the bypass channel 9*a* is large (sufficient for returning alkylbenzene oil together with another substance), neither the liquid refrigerant nor an alkylbenzene oil remains in the oil separator 9. Liquid refrigerant resulting from condensation of some of discharged gas returns to the compressor 1 at one time, thus increasing the amount of liquid refrigerant to be returned. Accordingly, there is a large possibility of the compressor 1 being susceptible to compression of a liquid or seizing of a bearing.

The present invention can avoid occurrence of such a phenomenon by means of the liquid back flow prevention mechanism 13 provided in the oil separator 9. For example, the liquid back flow prevention mechanism 13 corresponds to an electric heater disposed so as to surround the shell of the oil separator 9. In a case where the compressor 1 is in a stationary state or an ambient temperature is low, the oil separator 9 is heated by application of power by way of a heater provided in the liquid back flow prevention mechanism 13, thereby evaporating the liquid refrigerant in the oil separator 9 again. As a result, retention of an alkylbenzene oil in the oil separator 9 or back flow of liquid refrigerant can be prevented, so that the compressor 1 can operate properly.

Cold start of the compressor 1 will next be described. In a case where the refrigerant has entered a cold liquid state within the shell of the compressor 1 while the compressor 1 is in a stationary state, alkylbenzene oil and the liquid refrigerant are separated into two layers. Since the density of alkylbenzene oil is lower than that of refrigerant, the alkylbenzene oil floats over the liquid refrigerant. Since a fuel oil pump of the compressor 1 is disposed at the bottom of the shell of the compressor 1, the fuel oil pump supplies the liquid refrigerant to the bearing if the compressor 1 is started in its present state, thus seizing up the bearing for reasons of a lubrication failure. A crankcase heater is wrapped around the outer periphery of the shell (corresponding to a refrigeration oil reservoir) of the compressor 1, or a heater is inserted into the shell of the compressor 1. Alternatively, the heating means 14, which is energized to such an extent that a motor does not cause rotation (if a three-phase power supply is employed, a single-phase current is applied to the heating means 14), is provided in the compressor 1. Therefore, occurrence of a lubrication failure can be prevented. More specifically, if power remains on, the heating means 14 is continuously heated while the compressor 1 is in a stationary state, thus heating the inside of the shell and preventing the refrigerant from entering a cold liquid state. If the power is shut off, the compressor 1 is inevitably heated by use of the heating means 14 for a predetermined period of time before starting of the compressor 1, thereby evaporating the liquid refrigerant. Therefore, the refrigerant is prevented from entering a cold liquid state at the time of startup of the compressor 1. Therefore, even when there is used refrigeration oil having no mutual solubility with respect to HFC refrigerant or very low mutual solubility, as is the case with alkylbenzene oil, there can be prevented occurrence of a lubrication failure, which would otherwise be caused when the compressor 1 is subjected to cold start.

The refrigerant can be prevented from entering a cold liquid state in the compressor 1, by use of a non-azeotropic mixture refrigerant as well as refrigeration oil having no mutual solubility with respect to HFC refrigerant or very low mutual solubility. Since the refrigeration oil has no mutual solubility with respect to HFC refrigerant or very low mutual solubility, no increase arises in the liquid refrigerant to be dissolved into the refrigeration oil even when the compressor 1 is cooled by the surrounding refrigeration cycle. consequently, a drop arising in the interior pressure of the shell of the compressor 1 is small. Further, in a case where the refrigerant corresponds to a non-azeotropic mixture refrigerant, the compressor 1 is cooled by a surrounding refrigeration cycle, whereupon the gaseous refrigerant is temporarily cooled. At this time, a high-fusing-point component of the gaseous refrigerant stored in the shell of the compressor 1 is condensed, and the proportion of a low-fusing-point component contained in the gaseous refrigerant is increased, thereby resulting in an increase in the interior pressure of the shell; i.e. saturation pressure at the same temperature. As a result, supply of new gaseous refrigerant is suspended, thus preventing an increase in the amount of refrigerant which enters a cold liquid state.

Back flow of a liquid to the compressor 1 will now be described. In the event of occurrence of back flow of a liquid to the compressor 1, in the case of the compressor 1 of low-pressure shell type, there is a large chance of refrigeration oil being supplied to an oil reservoir provided within the compressor 1 while in a liquid form. In such a case, the refrigeration oil stored in the compressor 1 is separated into two layers; i.e., a layer of refrigeration oil and a layer of HFC refrigerant. Since a fuel oil pump of the compressor 1 is disposed at the bottom of the shell of the compressor 1, the fuel oil pump supplies the liquid refrigerant to the bearing if the compressor 1 is started in its present state, thus seizing up the bearing for reasons of a lubrication failure. In order to prevent such a failure, the present invention provides the following two means.

A compressor of high-pressure shell type is employed as the compressor 1. An oil reservoir of the refrigeration system is disposed in the atmosphere of discharged gas. Even if liquid refrigerant enters the inside of the shell, the liquid refrigerant is heated and evaporated. Further, even if the liquid refrigerant returns to the compressor 1, the refrigerant is heated and evaporated during the course of traveling through a compression section.

Next, the sump 61 is disposed in front of the diaphragm (i.e., the first flow rate regulator 5 or the second flow rate regulator 5*b*), and hence superfluous refrigerant which would arise according to an operating state of the air conditioner is accumulated in the sump 61. By means of the diaphragm (i.e., the first flow rate regulator 5 or the second flow rate regulator 5*b*) there is performed a control operation so as to bring the exit of an evaporator (i.e., the user-side heat exchanger 6 during a cooling operation or the heat-source-unit-side heat exchanger 3 during a heating operation) into an overheating state, thus preventing constant accumulation of liquid refrigerant in the accumulator 8. Thus, the function of the accumulator 8 can be specialized to a transient liquid back flow absorbing function, thereby considerably reducing the possibility of back flow of the liquid refrigerant to the compressor 1.

As mentioned above, use of refrigeration oil which has no mutual solubility with respect to new HFC refrigerant or has very low mutual solubility enables replacement of a deteriorated air conditioner using old refrigerant CFC or HCFC with another air conditioner using new refrigerant HFC, involving replacement of the heat source unit AA with a new one and without involvement of replacement of the first and second connecting pipes CC and DD and the indoor unit BB.

In contrast with the conventional first cleaning method, the method of reusing existing pipes and indoor unit according to the present invention eliminates a necessity of cleaning the air conditioner with a specifically-designed cleaning solvent (HCFC 141b or HCFC 225) through use of specialized cleaning equipment. Therefore, the method completely eliminates the possibility of depletion of the ozone layer, the use of a flammable and toxic substance, a fear of existence of residual cleaning solvent, and a necessity for recovery of a cleaning solvent.

In contrast with the conventional second cleaning method, the method of the present invention eliminates a necessity of operating the air conditioner three times repeatedly for cleaning, as well as a necessity of replacing an HFC refrigerant and HFC refrigeration oil with new refrigerant and oil three times. The method of the present invention involves use of only the amount of HFC refrigerant and HFC refrigeration oil required for one air conditioner, thus yielding an advantage in terms of cost and environmental cleanliness. Further, the method completely eliminates a necessity of managing refrigeration oil for replacement purpose and the chance of excess or insufficient refrigeration oil. Further, there is no chance of the HFC refrigeration oil being incompatible with the HFC refrigerant or being deteriorated.

The tenth embodiment has described a case where alkylbenzene oil is used as a refrigeration oil. However, in the case of use of new refrigerant HFC, there may be used a refrigeration oil whose principal constituent includes at least one substance selected from the group consisting of alkylbenzene, a polyalphaolefine, paraffin-based oil, a naphthene-based oil, a polyphenylether oil, polyphenythioether, and chlorinated paraffin. Even in such a case, there can be yielded the same advantage as that yielded when alkylbenzene oil is used as a refrigeration oil. The only essential requirement is selective use of a refrigeration oil which has no mutual solubility with respect to new refrigerant or has very low mutual solubility.

Further, the present embodiment has described an example in which one indoor unit BB is connected to the air conditioner. Needless to say, the present invention yields the same advantage as that yielded in the embodiment even when applied to an air conditioner comprising a plurality of indoor units BB connected in series or parallel.

As is obvious, the same advantage is yielded even when a thermal storage ice bath or a thermal storage water bath (including hot water) is connected in parallel or series with the heat-source-unit-side heat exchanger 3.

The same advantage as that yielded by the previous embodiment is not limited to the air conditioner; the same advantage as in the previously-described embodiment is yielded so long as a thermo-compression refrigeration application system comprises a unit incorporating a heat-source-unit-side heat exchanger and another unit incorporating a user-side heat exchanger, the units being remotely spaced away from each other.

Eleventh Embodiment

Figure 26:
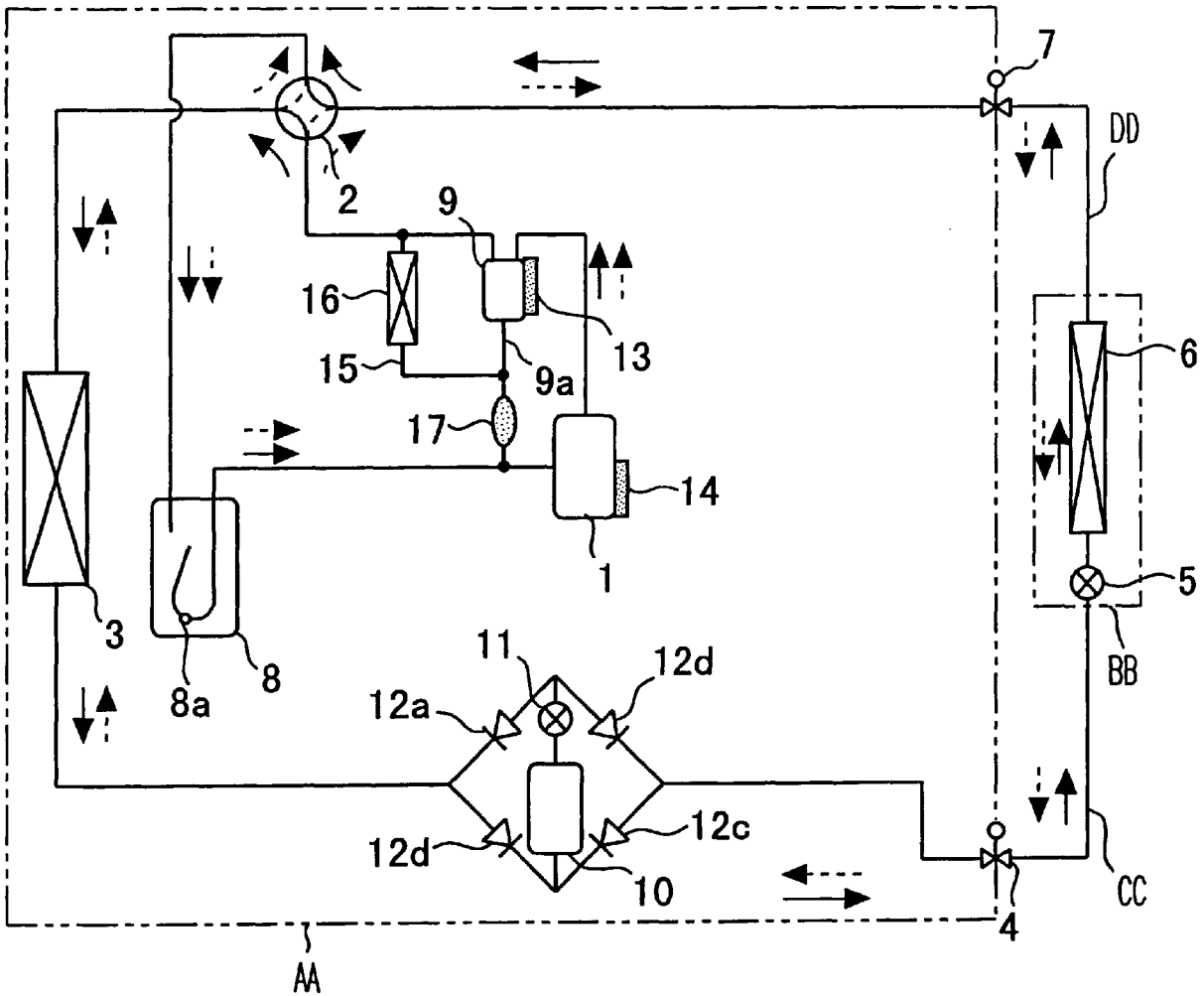
FIG. 26 is a schematic diagram showing a refrigerant circuit of an air conditioner, as an example refrigeration system according to an eleventh embodiment of the present invention.
Figure 27:
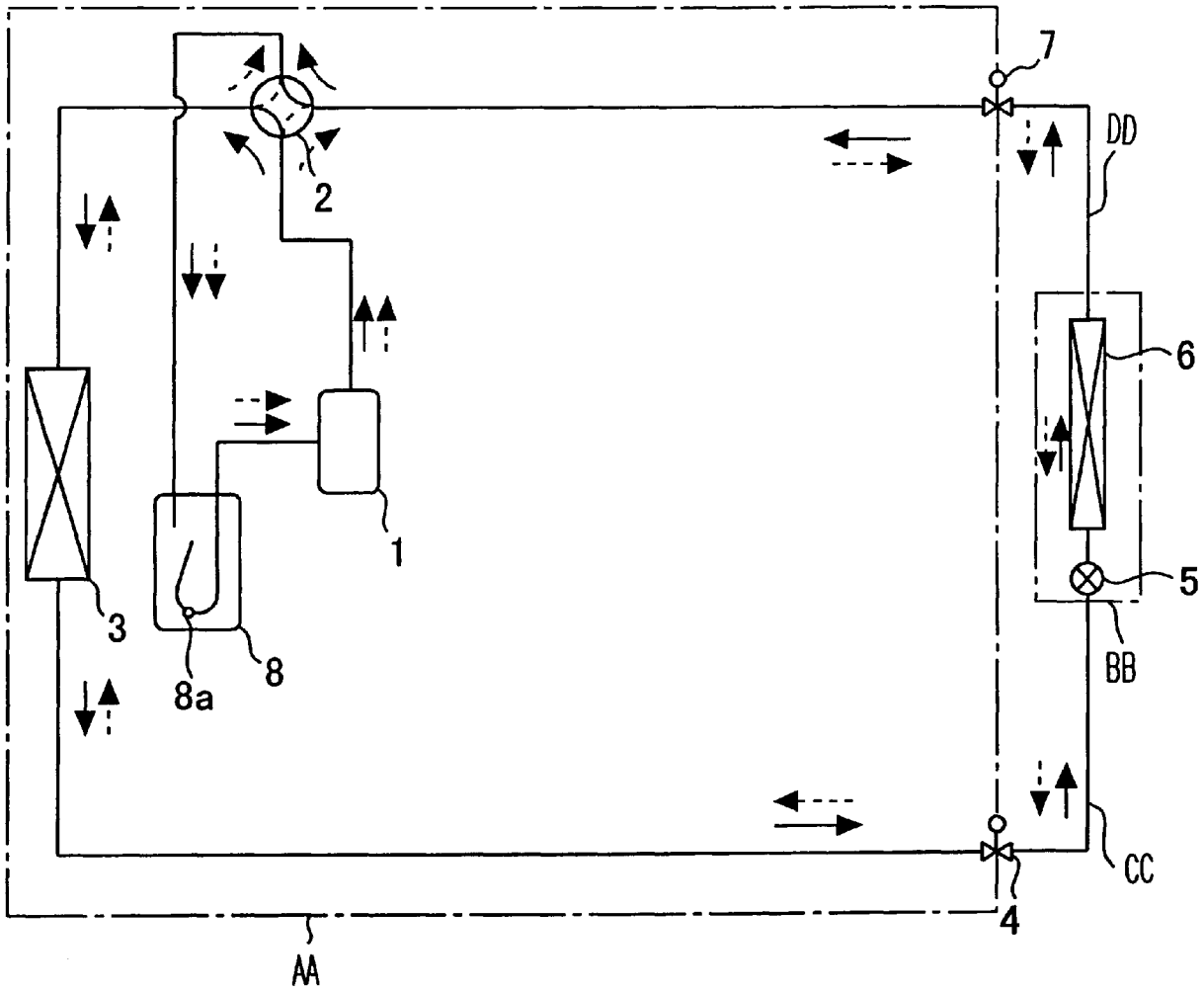
Fig. 27 Background Art
FIG. 27 is a schematic diagram showing a refrigerant circuit of a conventional separate-type refrigeration system.
Figure 28:
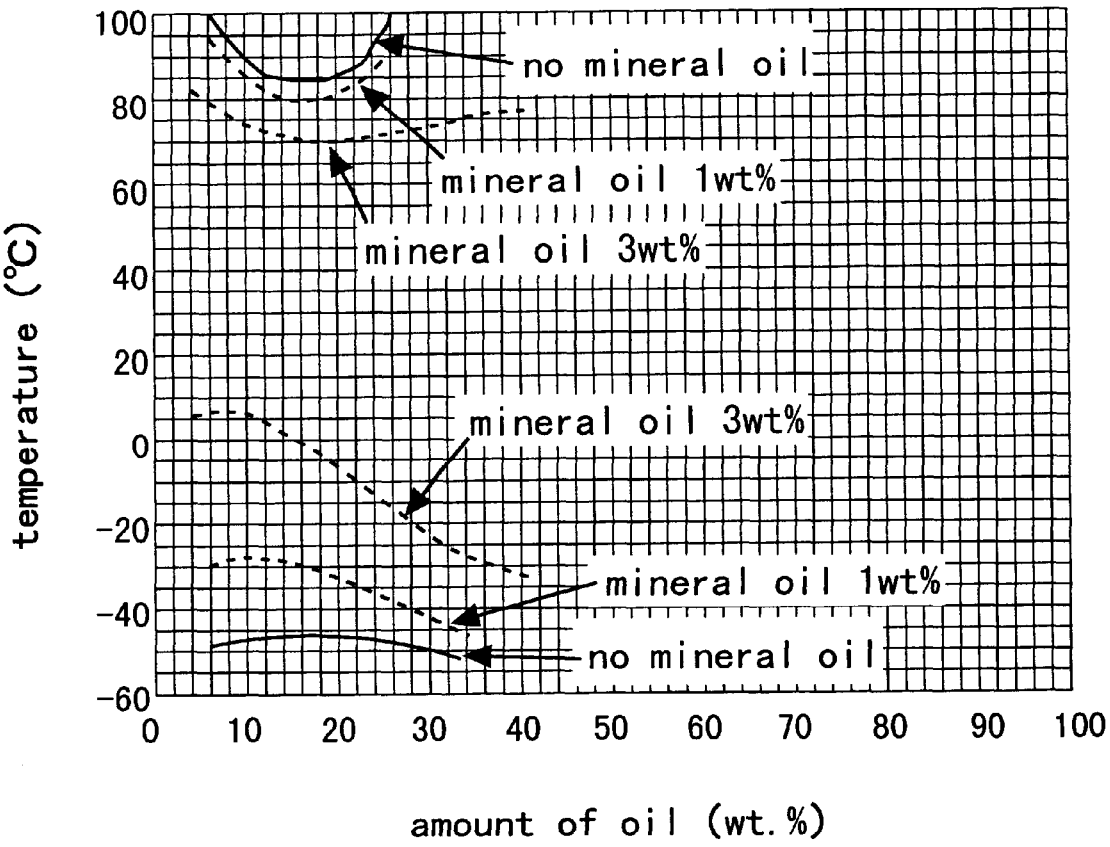
Background Art Fig. 28
FIG. 28 is a graph showing critical solubility curves which represent the solubility of an oil for use with an HFC-using refrigerator into an HFC refrigerant when the HFC refrigeration oil is mixed with a mineral oil.
Figure 29:
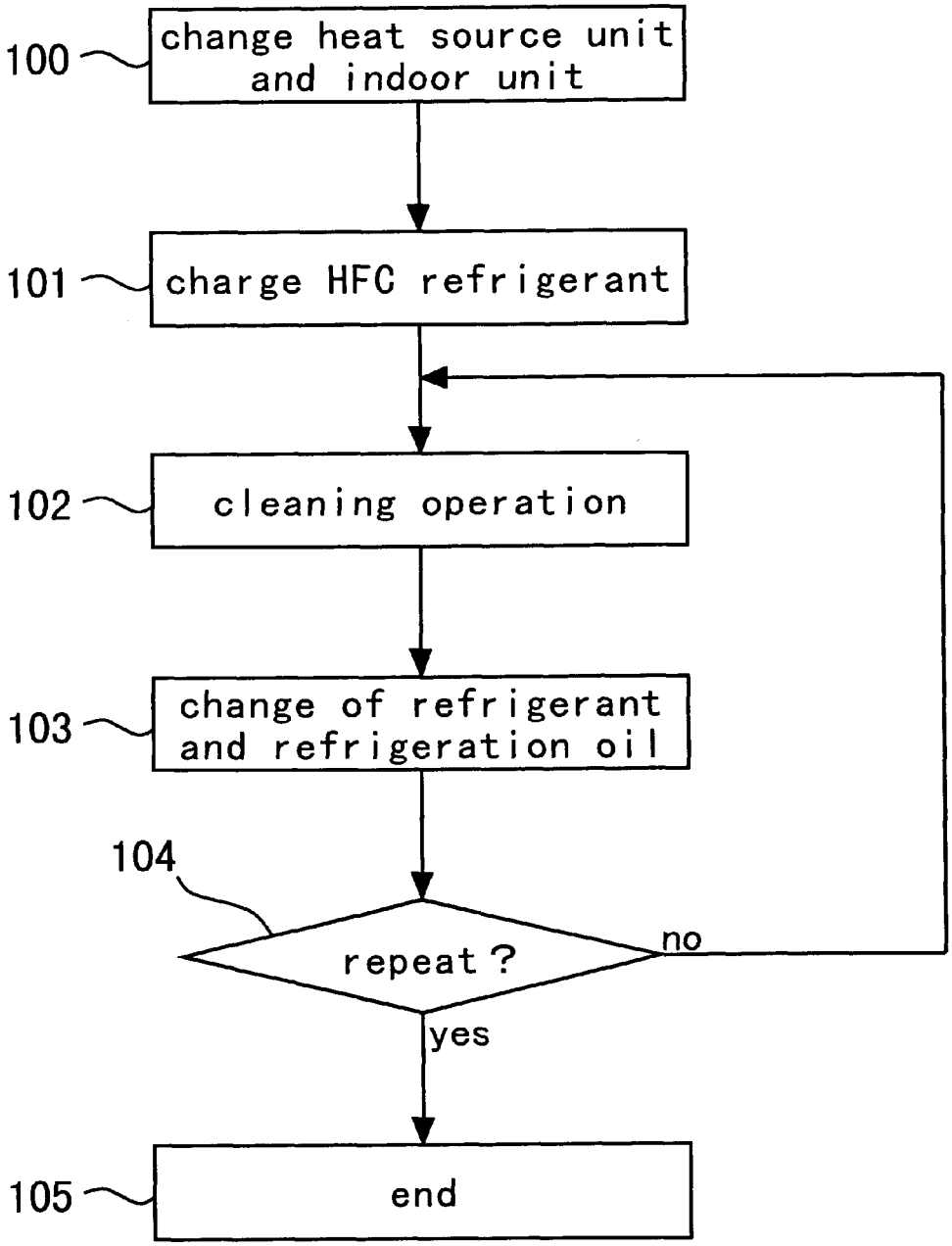
Background Art Fig. 29
FIG. 29 is a flowchart for describing a method of cleaning a conventional refrigeration system.

FIG. 26 is a schematic diagram showing a refrigerant circuit of an air conditioner, serving as an example air conditioner (or a refrigeration air conditioner) according to an eleventh embodiment of the present invention. In FIG. 26, reference symbols AA to DD, reference numerals 1 through 14, and reference numerals 8*a*, 9*a*, 12*a*, 12*b*, 12*c*, and 12*d* are the same as those employed in the tenth embodiment, and hence repetition of their detailed explanations is omitted here.

The air conditioner uses as refrigerant R407C, which is an HFC and corresponds to non-azeotropic mixture refrigerant. For example, alkylbenzene oil—which has very low mutual solubility with respect to R407C and is lower in density than liquid refrigerant—is used as refrigeration oil.

Reference numeral 15 designates a fluid refrigerant injection circuit interconnecting a downstream position on the outlet pipe of the oil separator 9 and the bypass circuit 9*a* of the oil separator 9; 16 designates a cooler placed in an intermediate position in the fluid injection circuit 15; and 17 designates extraneous-matter trapping means inserted at an intermediate position in the bypass channel 9*a*. The extraneous-matter trapping means 17 is connected to a junction where the bypass channel 9*a* and the fluid injection circuit 15 meet or a position downstream of the junction.

The refrigeration oil included in the refrigerant is separated by the oil separator 9, and the thus-separated refrigeration oil flows into the bypass channel 9*a*. Some of the refrigerant which has passed through the oil separator 9 is split into the fluid refrigerant injection circuit 16, where the refrigerant is cooled and condensed by the cooler 16. The thus-condensed refrigerant merges with the refrigeration oil flowing through the bypass channel 9*a*, and the thus-merged stream enters the extraneous-matter trapping means 17. As will be described later, a sintered metal filter having fine pores of, for example, 5 micrometers, is housed in the extraneous-matter trapping means 17. The refrigerant and refrigeration oil from which extraneous matter has been separated and trapped by the extraneous-matter trapping means 17 merge with the main stream of refrigerant at a downstream position, and the thus-merged stream returns to the compressor 1.

Since the main stream of refrigerant contains the extraneous matter removed from the first and second connecting pipes CC and DD and the extraneous matter removed from the user-side heat exchanger 6, the HFC refrigeration oil is mixed with the extraneous matter. However, in the present embodiment, alkylbenzene oil is used as an HFC refrigeration oil, and hence base refrigeration oil is stable with respect to residual extraneous matter and poses no problem.

An additive, such as an extreme-pressure agent, an oxygen trapping agent, or an oxidation inhibitor, may be added to alkylbenzene oil. In such a case, the residual extraneous matter deteriorates the additive, thus generating sludge. Generation of sludge is attributable to chemical reaction and does not proceed abruptly.

The sludge component dissolves into the refrigeration oil well but does not dissolve into the HFC refrigerant.

The higher the temperature of the refrigeration oil, the higher the solubility of sludge component to the refrigeration oil. More specifically, the sludge component is dissolved in the refrigeration oil in a state in which the interior temperature of the compressor 1 is high and the proportion of HFC liquid refrigerant is low.

The sludge component is discharged from the compressor 1 together with the refrigeration oil. In the oil separator 9, the sludge component is substantially completely separated from the gaseous refrigerant together with the refrigeration oil, and the thus-separated sludge component flows into the bypass channel 9*a*. The refrigerant, which has been condensed by the cooler 16 provided at a position in the fluid injection circuit 16, is injected to the refrigeration oil, thereby increasing the proportion of liquid refrigerant. Therefore, the sludge component dissolved in the refrigeration oil hardly dissolves into the liquid refrigerant and precipitates. The thus-precipitated sludge is trapped by the extraneous-matter trapping means 17, thereby decreasing the sludge content of the refrigeration oil and preventing clogging of the refrigerant circuit, which would otherwise be caused by adhesion of sludge to refrigerant circuit components.

An example structure of the extraneous-matter trapping means 17 has already been described by reference to FIG. 9. An outlet pipe 55 of such an extraneous-matter trapping means 17 is connected in FIG. 26 to the refrigerant circuit returning from the accumulator 8 to the compressor 1, and the inlet pipe 52 of the same is connected to a downstream position relative to a junction where the fluid injection circuit 15 and the bypass channel 9*a* meet.

The sludge component, which has flowed into the bypass channel 9*a* while being dissolved in the refrigeration oil, is mixed with the liquid refrigerant charged by the fluid refrigerant injection circuit 15, thus becoming supersaturated and precipitated. The sludge flows into the extraneous-matter trapping means 17 from the inlet pipe 52 and passes through the minute pores 52*a* of the inlet pipe 52. When the sludge comes into contact with the filter 53, adhesion of the sludge to the filter 53 is accelerated, and the sludge adheres to the side or lower surface of the filter 53 or is deposited and trapped. Further, the refrigerant and refrigeration oil flow out from the outlet pipe 55.

Of the extraneous matter, the component, which dissolves into the old refrigerant CFC or HCFC but does not dissolve into new refrigerant HFC, is trapped by the extraneous-matter trapping means 17, as in the case of the sludge component.

As mentioned above, replacement of a deteriorated air conditioner using old refrigerant CFC or HCFC with another air conditioner using new refrigerant HFC can be achieved, by means of using a refrigeration oil which has no mutual solubility with respect to new HFC refrigerant or has very low mutual solubility; disposing the oil separator 9 at a position in the outlet pipe of the compressor 1; providing a circuit for causing all or some of the refrigeration oil to return to the compressor 1 from the oil separator 9; and by disposing the extraneous-matter trapping means 17 having minute pores formed therein at the junction or a position downstream of the junction, involving replacement of the heat source unit AA with a new one and without involvement of replacement of the first and second connecting pipes CC and DD and the indoor unit BB.

In contrast with the conventional first cleaning method, the method of reusing existing pipes and indoor unit according to the present invention eliminates a necessity of cleaning the air conditioner with a specifically-designed cleaning solvent (HCFC 141b or HCFC 225) through use of cleaning equipment. Therefore, the method completely eliminates the possibility of depletion of the ozone layer, the use of a flammable and toxic substance, a fear of existence of residual cleaning solvent, and a necessity for recovery of a cleaning solvent.

In contrast with the conventional second cleaning method, the method of the present invention eliminates a necessity of operating the air conditioner three times repeatedly for cleaning, as well as a necessity of replacing an HFC refrigerant and HFC refrigeration oil with new refrigerant and oil three times. The method of the present invention involves use of only the amount of HFC refrigerant and HFC refrigeration oil required for one air conditioner, thus yielding an advantage in terms of cost and environmental cleanliness. Further, the method completely eliminates a necessity of managing refrigeration oil for replacement purpose and the chance of excess or insufficient refrigeration oil. Further, there is no chance of the HFC refrigeration oil being incompatible with the HFC refrigerant or being deteriorated.

The eleventh embodiment has described a case where alkylbenzene oil is used as a refrigeration oil. However, in the case of use of new refrigerant HFC, there may be used a refrigeration oil whose principal constituent includes at least one substance selected from the group consisting of alkylbenzene, a polyalphaolefine, paraffin-based oil, a naphthene-based oil, a polyphenylether oil, polyphenythioether, and chlorinated paraffin. Even in such a case, there can be yielded the same advantage as that yielded when alkylbenzene oil is used as a refrigeration oil. The only essential requirement is selective use of a refrigeration oil which has no mutual solubility with respect to new refrigerant or has very low mutual solubility.

Further, the present embodiment has described an example in which one indoor unit BB is connected to the air conditioner. Needless to say, the present invention yields the same advantage as that yielded in the embodiment even when applied to an air conditioner comprising a plurality of indoor units BB connected in series or parallel.

As is obvious, the same advantage is yielded even when a thermal storage ice bath or a thermal storage water bath (including hot water) is connected in parallel or series with the heat-source-unit-side heat exchanger 3.

The same advantage as that yielded by the previous embodiment is not limited to the air conditioner; the same advantage as in the previously-described embodiment is yielded so long as a thermo-compression refrigeration application system comprises a unit incorporating a heat-source-unit-side heat exchanger and another unit incorporating a user-side heat exchanger, the units being remotely spaced away from each other.

The features and the advantages of the present invention as exemplified by the ninth and the eleventh embodiments may be summarized as follows.

According to one aspect of the present invention, there is employed refrigeration oil which has no mutual solubility with respect to HFC or has very low mutual solubility. The user-side heat exchanger for use with the old refrigerant as well as the first and second connecting pipes can be reused, thereby embodying an environmentally-friendly, efficient refrigeration system (or refrigeration air conditioner).

In another aspect of the present invention, there is employed refrigeration oil which has no mutual solubility with respect to HFC or has very low mutual solubility. Hence, the user-side heat exchanger for use with the old refrigerant as well as the first and second connecting pipes can be reused, even in the case of a refrigeration system in which a value resulting from division of the maximum amount of fluid retained by the accumulator by the amount of fluid returned from the accumulator is set to exceed a value resulting from division of the amount of refrigeration oil retained by the compressor by the rate at which the compressor discharges refrigeration oil, thereby embodying an environmentally-friendly, efficient refrigeration system.

In another aspect of the present invention, there is employed refrigeration oil which has no mutual solubility with respect to HFC or has very low mutual solubility, and a reflux circuit for returning, to the compressor, the refrigeration oil which has been separated from the refrigerant by an oil separator disposed at a position on a discharge pipe of the compressor, thereby enabling reuse of the first and second connecting pipes and/or the user-side heat exchanger for use with the old refrigerant.

In another aspect of the present invention, there is employed refrigeration oil which has no mutual solubility with respect to HFC or has very low mutual solubility. Further, the refrigeration system is provided with an oil separator disposed at a position on the outlet pipe of the compressor, a diversion circuit for causing some or all of the refrigerant returning from the oil separator to the compressor to merge with liquid refrigerant, and extraneous-matter trapping means which has minute pores and is disposed at a junction where the refrigeration oil is merged with liquid refrigerant, thereby enabling reuse of the first and second connecting pipes and/or the user-side heat exchanger for use with the old refrigerant.

In another aspect of the present invention, there is employed refrigeration oil which has no mutual solubility with respect to HFC or has very low mutual solubility. Further, the refrigeration system is equipped with liquid back flow prevention means for preventing abrupt reverse flow of liquid refrigerant from the oil separator to the compressor, thereby enabling reuse of the first and second connecting pipes and/or the user-side heat exchanger for use with the old refrigerant.

In another aspect of the present invention, there is employed refrigeration oil which has no mutual solubility with respect to HFC or has very low mutual solubility. Further, the refrigeration system is equipped with compressor heating means which prevents liquid refrigerant from staying in the compressor and which heats the liquid refrigerant stored in the compressor to evaporate, after the compressor is stopped and energy supply is stopped, from the time energy is supplied to the compressor until the compressor starts up, thereby enabling reuse of the first and second connecting pipes and/or the user-side heat exchanger for use with the old refrigerant.

In another aspect of the present invention, there is employed refrigeration oil which has no mutual solubility with respect to HFC or has very low mutual solubility. Further, a superfluous refrigerant reservoir which stores superfluous refrigerant arising according to the operating state of the refrigeration system is provided at an upstream position relative to the diaphragm, thereby enabling reuse of the first and second connecting pipes and/or the user-side heat exchanger for use with the old refrigerant.

In another aspect of the present invention, there is employed refrigeration oil which has no mutual solubility with respect to HFC or has very low mutual solubility. Further, the amount of refrigeration oil circulating through the refrigerant circuit is set to be equal to or smaller than the amount corresponding to the solubility of liquid refrigerant at the minimum temperature of the air conditioner, and the mass ratio of refrigeration oil to a liquid refrigerant in gas-liquid coexisting regions of the refrigeration cycle is set to be equal to or lower than the solubility of liquid refrigerant. Consequently, there can be reused the first and second connecting pipes and/or the user-side heat exchanger for use with the old refrigerant.

In another aspect of the present invention, there is employed refrigeration oil which has no mutual solubility with respect to HFC or has very low mutual solubility.

Further, a non-azeotropic mixture refrigerant is used as HFC refrigerant, thereby enabling reuse of the first and second connecting pipes and/or the user-side heat exchanger for use with the old refrigerant.

In another aspect of the present invention, there is employed refrigeration oil which has no mutual solubility with respect to HFC or has very low mutual solubility. Further, the compressor is of high-pressure shell type. Consequently, there can be reused the first and second connecting pipes and/or the user-side heat exchanger for use with the old refrigerant.

According to another aspect of the present invention, an existing refrigeration system using old refrigerant can be updated to a new refrigeration system using HFC refrigerant by means of replacing an existing heat source unit employed in the existing refrigeration system with a heat source unit using refrigeration oil which has no mutual solubility with respect to HFC or has very low mutual solubility, and replacing the old refrigerant with HFC refrigerant.

Obviously many modifications and variations of the present invention are possible in the light of the above teachings. It is therefore to be understood that within the scope of the appended claims the invention may by practiced otherwise than as specifically described.

The entire disclosure of (1) a Japanese Patent Application No. 11-140304, filed on May 20, 1999 including specification, claims, drawings and summary, (2) a Japanese Patent Application No. 11-303188, filed on Oct. 25, 1999 including specification, claims, drawings and summary, (3) a Japanese Patent Application No. 11-303189, filed on Oct. 25, 1999 including specification, claims, drawings and summary, on which the Convention priority of the present application is based, are incorporated herein by reference in its entirety.

What is claimed is:

1. A method of operating a refrigeration system which replaces an old first type refrigerant used in a refrigerant circuit with a new second type refrigerant, different from the old first type refrigerant, said refrigerant circuit comprising a compressor;

a heat-source-unit-side heat exchanger;

a user-side heat exchanger;

a first connecting pipe interconnecting one end of said heat-source-unit-side heat exchanger and one end of said user-side heat exchanger;

a second connecting pipe interconnecting the other end of said user-side heat exchanger and said compressor, and an extraneous-matter trapping apparatus for trapping extraneous matter contained in the refrigerant inserted in the refrigerant circuit upstream of said compressor, wherein, after replacement of said old refrigerant, said new refrigerant is caused to flow while said compressor is taken as a drive source, thereby cleaning said refrigerant circuit.

2. The method of operating a refrigeration system according to claim 1, wherein, after replacement of the old refrigerant with the new refrigerant, the new refrigerant is caused to flow into said first connecting pipe or said second connecting pipe while said compressor is taken as a drive source, such that the new refrigerant flows from an upstream, larger-diameter pipe to a downstream, smaller-diameter pipe, thereby cleaning said refrigerant circuit.

3. The method of operating a refrigeration system according to claim 1, wherein, after replacement of the old refrigerant with the new refrigerant, the new refrigerant is caused to flow into said first connecting pipe and said second connecting pipe, in the sequence given, and then flow into said first and second connecting pipes, in the reverse sequence, while said compressor is taken as a drive source, thereby cleaning said refrigerant circuit.

4. The method of operating a refrigeration system according to claim 1, wherein, after replacement of the old refrigerant with the new refrigerant, the new refrigerant is caused to flow at a mass velocity greater than a predetermined value into said first connecting pipe and said second connecting pipe, while said compressor is taken as a drive source, thereby cleaning said refrigerant circuit.

5. The method of operating a refrigeration system according to claim 1, wherein, after replacement of old refrigerant with new refrigerant, the new refrigerant is caused to flow into a plurality of user-side refrigerant circuit portions by means of sequentially selecting the plurality of user-side refrigerant circuits while the compressor is taken as a drive source, thereby cleaning the refrigerant circuit.

6. A method of replacing an old refrigeration system to a new refrigeration system, wherein, said old refrigeration system using first refrigerant and comprising:

a first heat source unit including at least a compressor and a heat-source-unit-side heat exchanger;

an indoor unit including at least a user-side heat exchanger and a flow rate regulator; and first and second connecting pipes interconnecting said first heat source unit and said indoor unit, to thereby constitute a refrigerant circuit, wherein said new refrigeration system is constituted by means of:

replacing at least said first heat source unit with a second heat source unit, said second heat source unit using second refrigerant and comprising:

a heat source unit refrigerant circuit including at least a heat source refrigerant and a heat-source-unit-side heat exchanger, an oil separation apparatus which is inserted in said heat source unit refrigerant circuit, separates refrigeration oil from the refrigerant of said heat source unit refrigerant circuit, and returns the refrigeration oil to said compressor, and extraneous-matter trapping means for separating and trapping extraneous matter from the refrigeration oil separated by said oil separation apparatus, and replacing the first refrigerant with the second refrigerant.

7. The method of replacing a refrigeration system according to claim 6, wherein said second heat source unit comprises a branch refrigerant circuit which causes the refrigerant diverted from the heat source unit refrigerant circuit to merge with the refrigeration oil separated by said oil separation means and which causes the refrigerant and the refrigeration oil to flow into said extraneous-matter trapping means.

8. A refrigeration system comprising, at least:

a compressor;

a heat-source-unit-side heat exchanger;

a user-side diaphragm;

a user-side heat exchanger;

an accumulator;

a first connecting pipe for interconnecting said heat-source-unit-side-unit heat exchanger and said user-side diaphragm; and a second connecting pipe for interconnecting said user-side heat exchanger and said compressor, wherein at least said compressor and said heat-source-unit-side heat exchanger are replaced with a new compressor and a new heat-source-unit-side heat exchanger which use HFC refrigerant;

a refrigerant circuit is constituted by use of at least said first and second connecting pipes, as well as by use of said user-side heat exchanger and said user-side diaphragm;

refrigerant used in said refrigeration system is replaced with HFC refrigerant; and a refrigeration oil which has no mutual solubility with respect to HFC refrigerant or has very low mutual solubility.

9. The refrigeration system according to claim 8, wherein a value resulting from division of the maximum amount of fluid retained by said accumulator by the amount of fluid returned from said accumulator is set to exceed a value resulting from division of the amount of refrigeration oil retained by said compressor by the rate at which said compressor discharges refrigeration oil.

10. The refrigeration system according to claim 8, further comprising:

an oil separator for separating a refrigeration oil from refrigerant which is disposed at a downstream position on the refrigerant circuit relative to said compressor; and a reflux circuit for returning, to said compressor, the refrigeration oil which has been separated from the refrigerant by said oil separator.

11. The refrigeration system according to claim 8, wherein there is provided a diversion circuit for diverting some of the refrigerant flowing in a downstream portion of the refrigerant circuit relative to said oil separator, for cooling the diverted portion of refrigerant, and causing the diverted portion of refrigerant to merge with a flow to the reflux circuit which returns refrigerant from said oil separator to said compressor, and extraneous-matter trapping means for trapping extraneous matter contained in the refrigeration oil and the refrigerant is disposed at a junction where the diverted portion of refrigerant merges with the flow to the reflex circuit or an upstream position relative to the junction.

12. The refrigeration system according to claim 8, wherein said oil separator is provided with liquid back flow prevention means for preventing abrupt reverse flow of liquid refrigerant from said oil separator to said compressor.

13. The refrigeration system according to claim 8, wherein said compressor is provided with compressor heating means for heating the refrigerant stored in said compressor.

14. The refrigeration system according to claim 8, wherein a superfluous refrigerant reservoir is provided between said heat-source-unit-side heat exchanger and said first connecting pipe and is connected to said heat source unit such that refrigerant flows to said user-side heat exchanger by way of said superfluous refrigerant reservoir and said first diaphragm when said user-side heat exchanger acts as an evaporator and such that refrigerant flows to said heat-source-unit-side heat exchanger by way of said superfluous refrigerant reservoir and said second diaphragm when said heat-source-unit-side heat exchanger acts as an evaporator.

15. The refrigeration system according to claim 8, wherein the amount of refrigeration oil circulating through the refrigerant circuit is set to be equal to or smaller than the amount corresponding to the solubility of liquid refrigerant at the minimum temperature of the air conditioner, and the mass ratio of refrigeration oil to a liquid refrigerant in gas-liquid coexisting areas of the refrigeration cycle is set to be equal to or lower than the solubility of liquid refrigerant.

16. The refrigeration system according to claim 8, wherein a non-azeotropic mixture refrigerant is used as said HFC refrigerant.

17. The refrigeration system according to claim 8, wherein said compressor is of high-pressure shell type.

18. A method of operating a refrigeration system, the system using a first refrigerant and including a first heat source unit which comprises at least a compressor and a heat-source-unit-side heat exchanger, an indoor unit connecting at least a user-side heat exchanger and a user-side flow rate regulator, a first connecting pipe interconnecting the heat-source-unit-side heat exchanger and the flow rate regulator, a second connecting pipe interconnecting the user-side heat exchanger and the first heat source unit, wherein the system constitute either a first refrigerant circuit extending from and returning to the compressor by way of the second connecting pipe, the user-side heat exchanger, the user-side flow rate regulator, the first connecting pipe, and the heat-source-unit-side heat exchanger, in the sequence given, or a second refrigerant circuit extending from and returning to the compressor, the heat-source-unit-side heat exchanger, the first connecting pipe, the user-side flow rate regulator, the user-side heat exchanger, and the second connecting pipe, in the sequence given, the method comprising replacing the first heat source unit with a second heat source unit and replacing the first refrigerant with second refrigerant, wherein the second heat source unit using the second refrigerant comprises a heat source unit refrigerant circuit including at least a heat source refrigerant and a heat-source-unit-side heat exchanger;

inserting an oil separation apparatus in the heat source unit refrigerant circuit, separating refrigeration oil from the refrigerant of the heat source unit refrigerant circuit, and returning the refrigeration oil to the compressor; and separating and trapping extraneous matter from the refrigeration oil separated by the oil separation apparatus, and after replacing the first refrigerant with the second refrigerant, circulating the second refrigerant within at least one of the first refrigerant circuit and the second refrigerant circuit by using the compressor as the drive source, thereby cleaning the refrigeration system.

19. The method of operating a refrigeration system according to claim 18, the method further comprising sequentially circulating the second refrigerant through the compressor, the second connecting pipe, the user-side heat exchanger, the user-side flow rate regulator, the first connecting pipe, and the heat-source-unit-side heat exchanger by using the compressor as a drive source, thereby cleaning the refrigeration system.

20. The method of operating a refrigeration system according to claim 18, the method further comprising sequentially flowing the second refrigerant to a plurality of indoor units after replacing the first refrigerant with the second refrigerant by using the compressor as a drive source, thereby cleaning the refrigeration system.

21. The method of operating a refrigeration system according to claim 18, the method further comprising sequentially flowing the second refrigerant to a plurality of indoor units after replacing the first refrigerant with the second refrigerant by using the compressor as a drive source, thereby cleaning the refrigeration system.

22. The method of operating a refrigeration system according to claim 18, wherein the first refrigerant comprises at least one of a chlorogluorocarbon (CFC) type refrigerant or a hydrochlorofluorcarbon (HCFC) type refrigerant, and the second refrigerant comprises a hydrofluorocarbon (HFC) type refrigerant.

23. A method of replacing a refrigeration system using a first refrigerant and including a refrigerant circuit having a first heat source unit including at least a compressor and a heat-source-unit-side heat exchanger, an indoor unit including at least a user-side heat exchanger and a flow rate regulator, and first and second connecting pipes interconnecting the first heat source unit and the indoor unit, the method comprising:

replacing at least the first heat source unit with a second heat source unit which uses a second refrigerant and comprises a heat source unit refrigerant circuit which includes at least a heat source refrigerant and a heat-source-unit-side heat exchanger, an oil separation apparatus which is inserted in the heat source unit refrigerant circuit, separates refrigeration oil from the refrigerant of the heat source unit refrigerant circuit, and returns the refrigeration oil to the compressor, and an extraneous-matter trapping apparatus which separates and traps extraneous matter from the refrigeration oil separated by the oil separation means; and replacing the first refrigerant with the second refrigerant using the indoor unit, the first connecting pipe, and the second connecting pipe.

* * * * *

UNITED STATES PATENT AND TRADEMARK OFFICE

CERTIFICATE OF CORRECTION

PATENT NO. : 6,510,698 B2
DATED : January 28, 2003
INVENTOR(S) : Kasai et al.

It is certified that error appears in the above-identified patent and that said Letters Patent is hereby corrected as shown below:

Title page,
Item [45] and the Notice information should read:

-- [45] **Date of Patent: *Jan. 28, 2003** --

-- [*] Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days. --

Signed and Sealed this

Third Day of June, 2003

JAMES E. ROGAN
*Director of the United States Patent and Trademark Office*